US008526836B2

(12) United States Patent
Mitsuoka et al.

(10) Patent No.: US 8,526,836 B2
(45) Date of Patent: Sep. 3, 2013

(54) FIXING DEVICE, IMAGE FORMING APPARATUS, AND TEMPERATURE CONTROL METHOD FOR FIXING DEVICE

(75) Inventors: Tetsunori Mitsuoka, Osaka (JP); Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 303 days.

(21) Appl. No.: 12/962,830

(22) Filed: Dec. 8, 2010

(65) Prior Publication Data

US 2011/0142472 A1 Jun. 16, 2011

(30) Foreign Application Priority Data

Dec. 11, 2009 (JP) ..... 2009-282188
Nov. 24, 2010 (JP) ..... 2010-261457

(51) Int. Cl.
*G03G 15/20* (2006.01)
*H05B 11/00* (2006.01)

(52) U.S. Cl.
USPC ..... 399/69; 399/33; 399/67; 219/216

(58) Field of Classification Search
USPC ..... 399/33, 67, 69; 219/216
See application file for complete search history.

(56) References Cited

U.S. PATENT DOCUMENTS 5,444,521 A * 8/1995 Tomoyuki et al. ..... 399/69
5,701,554 A * 12/1997 Tanaka et al. ..... 399/69
5,819,149 A * 10/1998 Watanabe et al. ..... 399/330
7,003,240 B2 * 2/2006 Omoto et al. ..... 399/69
7,945,181 B2 * 5/2011 Okada ..... 399/69
2007/0196119 A1 * 8/2007 Fujita ..... 399/68
2009/0237623 A1 * 9/2009 Yamauchi ..... 353/85
2010/0322657 A1 * 12/2010 Kumada et al. ..... 399/69

FOREIGN PATENT DOCUMENTS

JP 04113378 A * 4/1992
JP 09-258601 A 10/1997
JP 2000-330418 A 11/2000
JP 2004-233543 A 8/2004
JP 2006-259004 A 9/2006
JP 2006259004 A * 9/2006
JP 2007-003663 A 1/2007
JP 2008-134377 A 6/2008

* cited by examiner

*Primary Examiner* — David Gray
*Assistant Examiner* — Francis Gray
(74) *Attorney, Agent, or Firm* — Renner, Otto, Boisselle & Sklar, LLP

(57) ABSTRACT

First, a first temperature difference and a second temperature difference are calculated. The first temperature difference is a difference between (a) a first detected temperature that is a current temperature of the fixing member and (b) a difference of a control target temperature for the fixing member. The second temperature difference is a difference between (a) the first detected temperature and (b) a past temperature of the fixing member which past temperature was detected a predetermined time earlier than the current time. Then, by reading out, from a table prepared in advance, an amount of power to be supplied to a heating member which amount corresponds to a combination of the first temperature difference and the second temperature difference, the amount of power to be supplied to the heating member is determined. In accordance with this amount of power determined, an actual amount of power supplied to the heating member is controlled. This makes it possible to simply and effectively suppress a temperature ripple of the fixing member.

28 Claims, 37 Drawing Sheets

FIG. 7

| | | FIRST TEMPERATURE DIFFERENCE ΔT1 [°C] | | | | | | | |
|---|---|---|---|---|---|---|---|---|---|
| | | ΔT1<-7 | -7≦ΔT1<-3 | -3≦ΔT1<-2 | -2≦ΔT1<-1 | -1≦ΔT1<0 | 0≦ΔT1<2 | 2≦ΔT1<6 | 6≦ΔT1 |
| SECOND TEMPERATURE DIFFERENCE ΔT2 [°C] | ΔT2<-6 | 50 % | 50 % | 50 % | 50 % | 50 % | 50 % | 50 % | 50 % |
| | -6≦ΔT2<-3 | 50 % | 50 % | 50 % | 50 % | 50 % | 50 % | 50 % | -50 % |
| | -3≦ΔT2<0 | 50 % | 28.8 % | 28.8 % | 13 % | 6.3 % | -2.8 % | -27.5 % | -50 % |
| | 0≦ΔT2<3 | 50 % | 28.8 % | 28.8 % | 13 % | 6.3 % | -2.8 % | -27.5 % | -50 % |
| | 3≦ΔT2<6 | 50 % | 28.8 % | 28.8 % | 13 % | 6.3 % | -2.8 % | -27.5 % | -50 % |
| | 6≦ΔT2 | 50 % | 28.8 % | 28.8 % | 13 % | 6.3 % | -2.8 % | -27.5 % | -50 % |

FIG. 9 (a) COMPARATIVE EXAMPLE 1
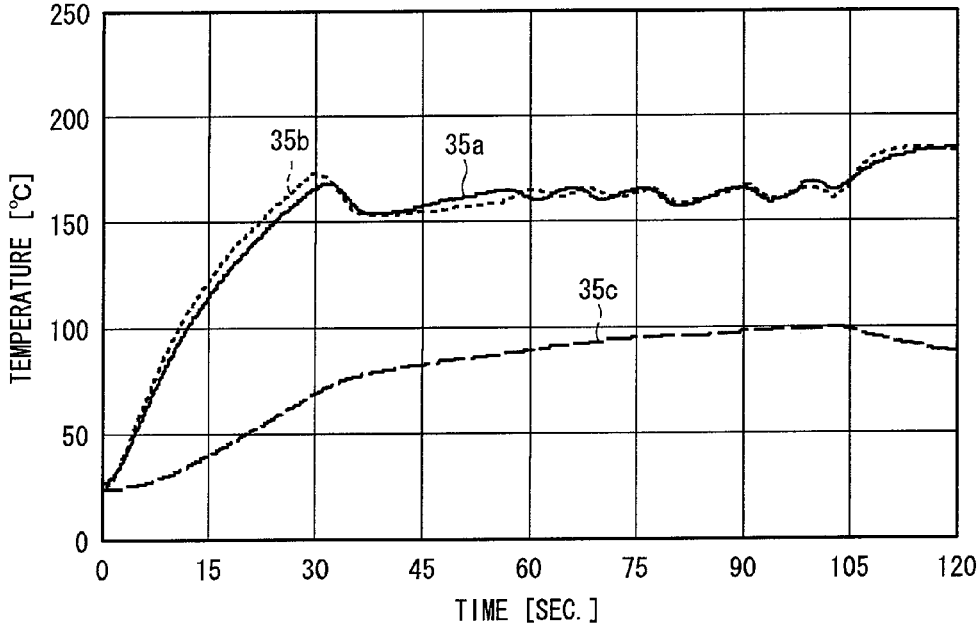
FIG. 9 (b) EXAMPLE 1
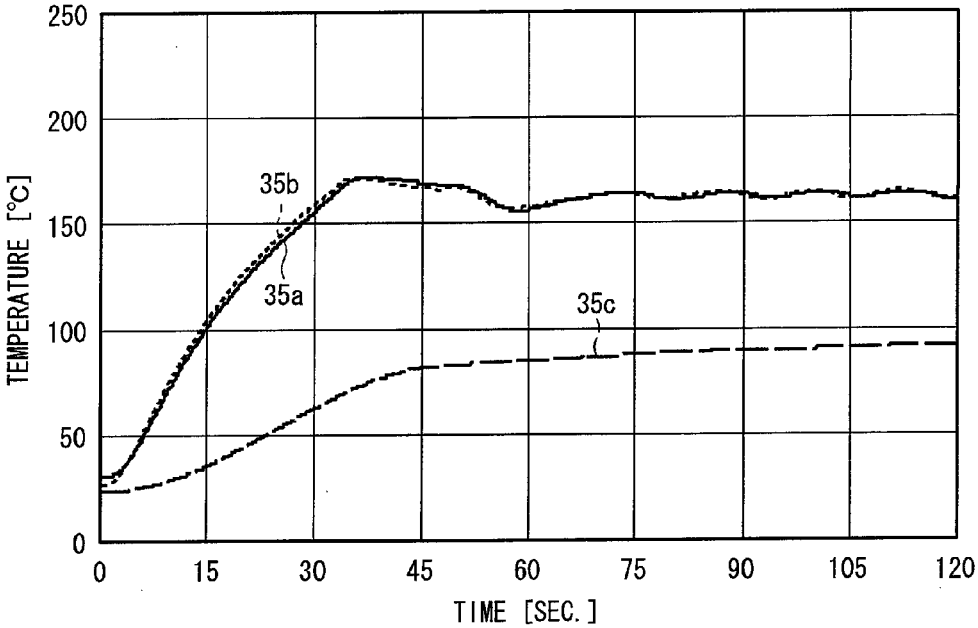

FIG. 10

| | | FIRST TEMPERATURE DIFFERENCE ΔT1 [°C] | | | | | | | |
|---|---|---|---|---|---|---|---|---|---|
| | | ΔT1<-7 | -7≦ΔT1<-3 | -3≦ΔT1<-2 | -2≦ΔT1<-1 | -1≦ΔT1<0 | 0≦ΔT1<2 | 2≦ΔT1<6 | 6≦ΔT1 |
| SECOND TEMPERATURE DIFFERENCE ΔT2 [°C] | ΔT2<-6 | 100 % | 100 % | 100 % | 100 % | 100 % | 100 % | 100 % | 100 % |
| | -6≦ΔT2<-3 | 100 % | 100 % | 100 % | 100 % | 100 % | 100 % | 100 % | 0 % |
| | -3≦ΔT2<0 | 100 % | 78.8 % | 78.8 % | 63 % | 56.3 % | 47.3 % | 22.5 % | 0 % |
| | 0≦ΔT2<3 | 100 % | 78.8 % | 78.8 % | 63 % | 56.3 % | 47.3 % | 22.5 % | 0 % |
| | 3≦ΔT2<6 | 100 % | 78.8 % | 78.8 % | 63 % | 56.3 % | 47.3 % | 22.5 % | 0 % |
| | 6≦ΔT2 | 100 % | 78.8 % | 78.8 % | 63 % | 56.3 % | 47.3 % | 22.5 % | 0 % |

FIG. 13 (a) OUTPUT SPECIFYING TABLE

| LEVEL | OUTPUT VALUE | POSITION |
|---|---|---|
| 1 | 100 | |
| 2 | 75 | |
| 3 | 70 | |
| 4 | 60 | |
| 5 | 50 | ● |
| 6 | 35 | |
| 7 | 30 | |
| 8 | 28 | |
| 9 | 25 | |
| 10 | 21 | |
| 11 | 10 | |
| 12 | 7 | |
| 13 | 5 | |
| 14 | 3 | |
| 15 | 0 | |

FIG. 13 (b) LEVEL CHANGE VALUE TABLE

| | | FIRST TEMPERATURE DIFFERENCE ΔT1 [°C] | | | | | | | |
|---|---|---|---|---|---|---|---|---|---|
| | | ΔT1<−5 | −5≦ΔT1<−3 | −3≦ΔT1<−1 | −1≦ΔT1<0 | 0≦ΔT1<1 | 1≦ΔT1<3 | 3≦ΔT1<6 | 6≦ΔT1 |
| SECOND TEMPERATURE DIFFERENCE ΔT2 [°C] | ΔT2<−5 | 4 | 3 | 1 | 1 | ±0 | -1 | -1 | -1 |
| | −5≦ΔT2<−2 | 2 | 2 | 1 | 1 | ±0 | -1 | -1 | -1 |
| | −2≦ΔT2<0 | 1 | 1 | ±0 | ±0 | ±0 | -1 | -1 | -1 |
| | 0≦ΔT2<3 | ±0 | ±0 | ±0 | ±0 | ±0 | -1 | -1 | -1 |
| | 3≦ΔT2<6 | ±0 | ±0 | ±0 | ±0 | ±0 | -1 | -1 | -1 |
| | 6≦ΔT2 | ±0 | ±0 | ±0 | ±0 | -2 | -2 | -3 | -4 |

FIG. 14 (a) COMPARATIVE EXAMPLE 2
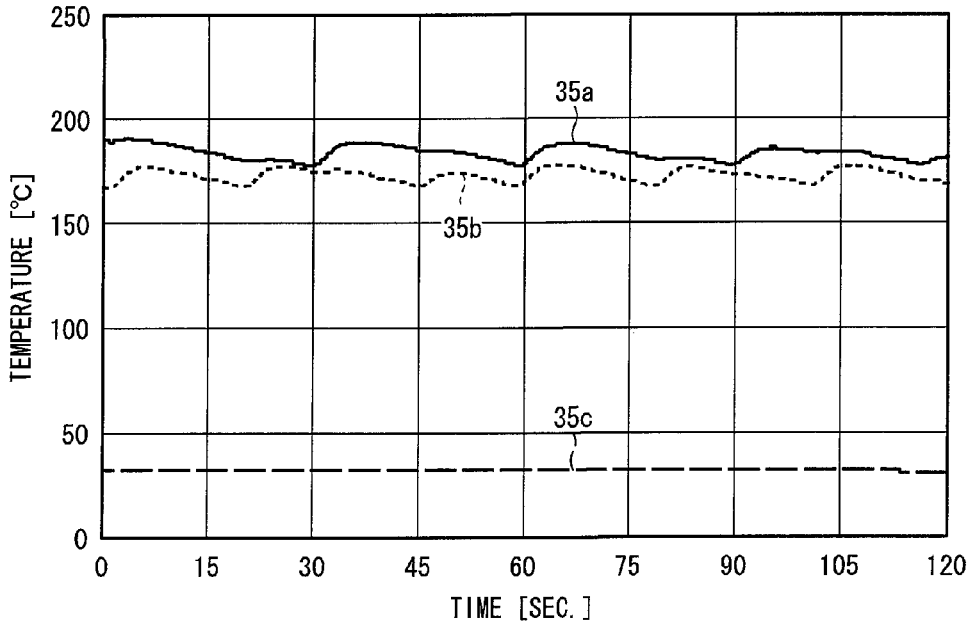
FIG. 14 (b) EXAMPLE 2
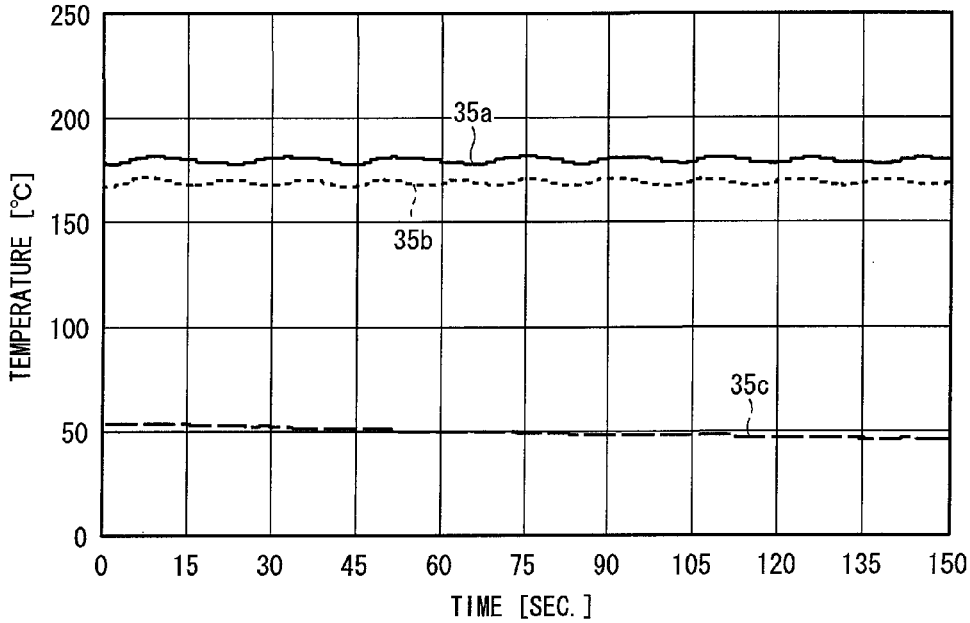

FIG. 15

| SECOND TEMPERATURE DIFFERENCE ΔT2 [°C] | FIRST TEMPERATURE DIFFERENCE ΔT1 [°C] | | | | | | | |
|---|---|---|---|---|---|---|---|---|
| | ΔT1<-5 | -5≦ΔT1<-3 | -3≦ΔT1<-1 | -1≦ΔT1<0 | 0≦ΔT1<1 | 1≦ΔT1<3 | 3≦ΔT1<6 | 6≦ΔT1 |
| ΔT2<-6 | 4 | 4 | 3 | 2 | 2 | 1 | 1 | ±0 |
| -6≦ΔT2<-3 | 4 | 3 | 2 | 2 | 1 | 1 | 1 | ±0 |
| -3≦ΔT2<0 | 2 | 2 | 1 | 1 | 1 | 1 | ±0 | -1 |
| 0≦ΔT2<3 | 1 | 1 | ±0 | ±0 | ±0 | -1 | -1 | -1 |
| 3≦ΔT2<6 | 1 | ±0 | ±0 | ±0 | -1 | -1 | -1 | -1 |
| 6≦ΔT2 | -1 | -1 | -1 | -1 | -2 | -2 | -1 | -1 |

FIG. 16

| OUTPUT SETTING TABLE | | | | | |
|---|---|---|---|---|---|
| OUTPUT SPECIFYING TABLE | OUTPUT SETTING TABLE A | | OUTPUT SETTING TABLE B | | |
| | OUTPUT SPECIFYING TABLE A | OUTPUT SPECIFYING TABLE B | OUTPUT SPECIFYING TABLE A | OUTPUT SPECIFYING TABLE B | |
| OUTPUT VALUE | OUTPUT: MAXIMUM | OUTPUT: LARGE | OUTPUT: SMALL | OUTPUT: MINIMUM | |

FIG. 19

| SECOND TEMPERATURE DIFFERENCE ΔT2 [°C] | | FIRST TEMPERATURE DIFFERENCE ΔT1 [°C] | | | | | | |
|---|---|---|---|---|---|---|---|---|
| | | ΔT1<−5 | −5≦ΔT1<−3 | −3≦ΔT1<−1 | −1≦ΔT1<0 | 0≦ΔT1<1 | 1≦ΔT1<3 | 3≦ΔT1<6 |
| ΔT2<−6 | RATE OF CHANGE: POSITIVE | 4 | 4 | 3 | 2 | 2 | 1 | 1 |
| | RATE OF CHANGE: NEGATIVE | 5 | 5 | 4 | 3 | 3 | 2 | 2 |
| −6≦ΔT2<−3 | RATE OF CHANGE: POSITIVE | 4 | 3 | 2 | 2 | 1 | 1 | 1 |
| | RATE OF CHANGE: NEGATIVE | 5 | 4 | 3 | 3 | 2 | 2 | 2 |
| −3≦ΔT2<0 | RATE OF CHANGE: POSITIVE | 2 | 2 | 1 | 1 | 1 | 1 | ±0 |
| | RATE OF CHANGE: NEGATIVE | 3 | 3 | 2 | 2 | 2 | 2 | 1 |
| 0≦ΔT2<3 | RATE OF CHANGE: POSITIVE | 1 | 1 | ±0 | ±0 | ±0 | -1 | -1 |
| | RATE OF CHANGE: NEGATIVE | 2 | 2 | 1 | 1 | 1 | ±0 | ±0 |
| 3≦ΔT2<6 | RATE OF CHANGE: POSITIVE | 1 | ±0 | ±0 | ±0 | -1 | -1 | -1 |
| | RATE OF CHANGE: NEGATIVE | | | | | | | |
| 6≦ΔT2 | RATE OF CHANGE: POSITIVE | -1 | -1 | -1 | -1 | -2 | -2 | -1 |
| | RATE OF CHANGE: NEGATIVE | | | | | | | |

FIG. 23

| TYPE OF IMAGE FORMING APPARATUS | FIXING SYSTEM | COPYING SPEED | PROCESS SPEED | OUTPUT SETTING TABLE | SET TEMPERATURE |
|---|---|---|---|---|---|
| IMAGE FORMING APPARATUS A | ROLLER FIXING | 20 SHEETS/MIN | 104mm/s | TABLE A | 160℃ |
| IMAGE FORMING APPARATUS B | BELT FIXING | 23 SHEETS/MIN | 104mm/s | TABLE A | 145℃ |
| IMAGE FORMING APPARATUS C | BELT FIXING | 26 SHEETS/MIN | 140mm/s | TABLE B | 150℃ |
| IMAGE FORMING APPARATUS D | BELT FIXING | 31 SHEETS/MIN | 140mm/s | TABLE B | 155℃ |
| IMAGE FORMING APPARATUS E | BELT FIXING | 36 SHEETS/MIN | 165mm/s | TABLE C | 160℃ |

FIG. 24

TABLE A

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | −7≧ΔT1 | −7<ΔT1≦−4 | −4<ΔT1≦−2 | −2<ΔT1<1 | 1≦ΔT1<3 | 3≦ΔT1<5 | ΔT1≧5 |
| −6≧ΔT2 | 100 % | 100 % | 70 % | 60 % | 50 % | 30 % | 0 % |
| −6<ΔT2≦−2 | 100 % | 85 % | 60 % | 45 % | 35 % | 10 % | 0 % |
| −2<ΔT2<1 | 100 % | 70 % | 40 % | 25 % | 20 % | 10 % | 0 % |
| 1≦ΔT2<6 | 100 % | 60 % | 30 % | 20 % | 10 % | 5 % | 0 % |
| ΔT2≧6 | 100 % | 40 % | 10 % | 5 % | 5 % | 0 % | 0 % |

TABLE B

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | −7≧ΔT1 | −7<ΔT1≦−4 | −4<ΔT1≦−2 | −2<ΔT1<1 | 1≦ΔT1<3 | 3≦ΔT1<5 | ΔT1≧5 |
| −6≧ΔT2 | 100 % | 100 % | 90 % | 80 % | 70 % | 55 % | 0 % |
| −6<ΔT2≦−2 | 100 % | 90 % | 90 % | 80 % | 60 % | 30 % | 0 % |
| −2<ΔT2<1 | 100 % | 80 % | 75 % | 70 % | 40 % | 15 % | 0 % |
| 1≦ΔT2<6 | 100 % | 75 % | 70 % | 65 % | 30 % | 10 % | 0 % |
| ΔT2≧6 | 100 % | 50 % | 45 % | 35 % | 10 % | 0 % | 0 % |

TABLE C

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | A | B | C | D | E | F | G |
| | −7≧ΔT1 | −7<ΔT1≦−4 | −4<ΔT1≦−2 | −2<ΔT1<1 | 1≦ΔT1<3 | 3≦ΔT1<5 | ΔT1≧5 |
| −6≧ΔT2 | 100 % | 100 % | 100 % | 100 % | 90 % | 80 % | 0 % |
| −6<ΔT2≦−2 | 100 % | 100 % | 100 % | 100 % | 85 % | 65 % | 0 % |
| −2<ΔT2<1 | 100 % | 100 % | 95 % | 85 % | 55 % | 35 % | 0 % |
| 1≦ΔT2<6 | 100 % | 95 % | 90 % | 80 % | 45 % | 30 % | 0 % |
| ΔT2≧6 | 100 % | 70 % | 65 % | 45 % | 25 % | 0 % | 0 % |

FIG. 25

TABLE D

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | −5≧ΔT1 | −5<ΔT1≦−3 | −3<ΔT1≦−1 | −1<ΔT1<1 | 1≦ΔT1<3 | 3≦ΔT1<5 | ΔT1≧5 |
| −6≧ΔT2 | 100 % | 100 % | 100 % | 100 % | 100 % | 100 % | 0 % |
| −6<ΔT2≦−2 | 100 % | 100 % | 100 % | 100 % | 55 % | 45 % | 0 % |
| −3<ΔT2<2 | 100 % | 90 % | 55 % | 45 % | 35 % | 20 % | 0 % |
| 2≦ΔT2<6 | 100 % | 85 % | 35 % | 20 % | 20 % | 10 % | 0 % |
| ΔT2≧6 | 100 % | 70 % | 30 % | 15 % | 10 % | 0 % | 0 % |

FIG. 26

TABLE E

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | −5≧ΔT1 | −5<ΔT1≦−3 | −3<ΔT1≦−1 | −1<ΔT1<1 | 1≦ΔT1<3 | 3≦ΔT1<5 | ΔT1≧5 |
| −6≧ΔT2 | 100 % | 100 % | 65 % | 40 % | 35 % | 25 % | 0 % |
| −6<Δ2T≦−2 | 100 % | 70 % | 40 % | 35 % | 30 % | 20 % | 0 % |
| −3<ΔT2<2 | 100 % | 60 % | 30 % | 25 % | 25 % | 15 % | 0 % |
| 2≦ΔT2<6 | 100 % | 50 % | 15 % | 10 % | 10 % | 0 % | 0 % |
| ΔT2≧6 | 100 % | 40 % | 10 % | 0 % | 0 % | 0 % | 0 % |

FIG. 27 (a)

| IDLING TIME (SEC.) | 5 OR LESS | MORE THAN 5 TO 10 | MORE THAN 10 TO 20 | MORE THAN 20 TO 30 | MORE THAN 30 TO 45 | MORE THAN 45 TO 60 | MORE THAN 60 |
|---|---|---|---|---|---|---|---|
| CORRECTION VALUE | −2% | −5% | −10% | −15% | −20% | −25% | −30% |

FIG. 27 (b)

| ROTATION SPEED | LOW SPEED | MIDDLE SPEED 1 | MIDDLE SPEED 2 | MIDDLE SPEED 3 | HIGH SPEED |
|---|---|---|---|---|---|
| CORRECTION VALUE | −5% | −10% | −15% | −15% | −20% |

FIG. 27 (c)

| | HIGHER THAN CONTROL TARGET TEMPERATURE | | | LESS THAN CONTROL TARGET TEMPERATURE | IN PRINTING |
|---|---|---|---|---|---|
| | IN TEMPERATURE RISE | AT TEMPERATURE EQUILIBRIUM | IN TEMPERATURE FALL | | |
| IMAGE FORMING APPARATUS A | −18% | −19% | −21% | ±0% | ±0% |
| IMAGE FORMING APPARATUS B | −21% | −22% | −24% | | |
| IMAGE FORMING APPARATUS C | −30% | −32% | −34% | | |
| IMAGE FORMING APPARATUS D | | | | | |
| IMAGE FORMING APPARATUS E | −32% | −34% | −36% | | |

FIG. 28

FOR PRINTING MODE

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | -5≧ΔT1 | -5<ΔT1≦-3 | -3<ΔT1≦-1 | -1<ΔT1<1 | 1≦ΔT1<3 | 3≦ΔT1<5 | ΔT1≧5 |
| -6≧ΔT2 | 100 % | 100 % | 100 % | 100 % | 100 % | 100 % | 0 % |
| -6<ΔT2≦-2 | 100 % | 100 % | 95 % | 85 % | 50 % | 40 % | 0 % |
| -2<ΔT2<2 | 100 % | 90 % | 55 % | 45 % | 30 % | 15 % | 0 % |
| 2≦ΔT2<6 | 100 % | 85 % | 35 % | 25 % | 15 % | 10 % | 0 % |
| ΔT2≧6 | 100 % | 70 % | 30 % | 15 % | 10 % | 0 % | 0 % |

FOR PRELIMINARY ROTATION, POST-ROTATION, PRINTING-INTERRUPTION IDLING MODE

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | -5≧ΔT1 | -5<ΔT1≦-3 | -3<ΔT1≦-1 | -1<ΔT1<1 | 1≦ΔT1<3 | 3≦ΔT1<5 | ΔT1≧5 |
| -6≧ΔT2 | 100 % | 100 % | 65 % | 40 % | 35 % | 25 % | 0 % |
| -6<ΔT2≦-2 | 100 % | 70 % | 40 % | 37 % | 32 % | 22 % | 0 % |
| -2<ΔT2<2 | 100 % | 60 % | 30 % | 27 % | 25 % | 15 % | 0 % |
| 2≦ΔT2<6 | 100 % | 50 % | 17 % | 10 % | 10 % | 0 % | 0 % |
| ΔT2≧6 | 100 % | 40 % | 12 % | 0 % | 0 % | 0 % | 0 % |

FOR STANDBY MODE

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | -4≧ΔT1 | -5<ΔT1≦-3 | -3<ΔT1≦-1 | -1<ΔT1<1 | 1≦ΔT1<3 | 3≦ΔT1<5 | ΔT1≧5 |
| -6≧ΔT2 | 100 % | 100 % | 65 % | 35 % | 20 % | 5 % | 0 % |
| -6<ΔT2≦-3 | 100 % | 35 % | 15 % | 15 % | 10 % | 0 % | 0 % |
| -3<ΔT2<2 | 100 % | 15 % | 7 % | 7 % | 5 % | 0 % | 0 % |
| 2≦ΔT2<6 | 100 % | 15 % | 7 % | 0 % | 0 % | 0 % | 0 % |
| ΔT2≧6 | 100 % | 15 % | 7 % | 0 % | 0 % | 0 % | 0 % |

FIG. 29

FOR 100V

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | −7≧ΔT1 | −7<ΔT1≦−4 | −4<ΔT1≦−2 | −2<ΔT1<1 | 1≦ΔT1<3 | 3≦ΔT1<5 | ΔT1≧5 |
| −6≧ΔT2 | 100 % | 100 % | 100 % | 93 % | 83 % | 64 % | 0 % |
| −6<ΔT2≦−2 | 100 % | 100 % | 93 % | 78 % | 69 % | 44 % | 0 % |
| −2<ΔT2<1 | 100 % | 98 % | 74 % | 59 % | 54 % | 44 % | 0 % |
| 1≦ΔT2<6 | 100 % | 93 % | 64 % | 54 % | 44 % | 37 % | 0 % |
| ΔT2≧6 | 100 % | 74 % | 44 % | 37 % | 37 % | 0 % | 0 % |

FOR 120V

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | −7≧ΔT1 | −7<ΔT1≦−4 | −4<ΔT1≦−2 | −2<ΔT1<1 | 1≦ΔT1<3 | 3≦ΔT1<5 | ΔT1≧5 |
| −6≧ΔT2 | 100 % | 100 % | 100 % | 93 % | 83 % | 64 % | 0 % |
| −6<ΔT2≦−2 | 100 % | 100 % | 93 % | 80 % | 71 % | 45 % | 0 % |
| −2<ΔT2<1 | 100 % | 98 % | 75 % | 61 % | 54 % | 44 % | 0 % |
| 1≦ΔT2<6 | 100 % | 93 % | 65 % | 56 % | 43 % | 37 % | 0 % |
| ΔT2≧6 | 100 % | 74 % | 45 % | 38 % | 37 % | 0 % | 0 % |

FOR 230V

| SECOND TEMPERATURE DIFFERENCE ΔT2 (°C) | FIRST TEMPERATURE DIFFERENCE ΔT1 (°C) | | | | | | |
|---|---|---|---|---|---|---|---|
| | −7≧ΔT1 | −7<ΔT1≦−4 | −4<ΔT1≦−2 | −2<ΔT1<1 | 1≦ΔT1<3 | 3≦ΔT1<5 | ΔT1≧5 |
| −6≧ΔT2 | 100 % | 100 % | 70 % | 60 % | 50 % | 30 % | 0 % |
| −6<ΔT2≦−2 | 100 % | 85 % | 60 % | 45 % | 35 % | 10 % | 0 % |
| −2<ΔT2<1 | 100 % | 70 % | 40 % | 25 % | 20 % | 10 % | 0 % |
| 1≦ΔT2<6 | 100 % | 60 % | 30 % | 20 % | 10 % | 5 % | 0 % |
| ΔT2≧6 | 100 % | 40 % | 10 % | 5 % | 5 % | 0 % | 0 % |

FIG. 30

| FOR FULL-WIDTH HEATING SECTION | | FIRST TEMPERATURE DIFFERENCE ΔT1 (°C) | | | | | | |
|---|---|---|---|---|---|---|---|---|
| | | $-5 \geqq \Delta T1$ | $-5 < \Delta T1 \leqq -3$ | $-3 < \Delta T1 \leqq -1$ | $-1 < \Delta T1 < 1$ | $1 \leqq \Delta T1 < 3$ | $3 \leqq \Delta T1 < 5$ | $\Delta T1 \geqq 5$ |
| SECOND TEMPERATURE DIFFERENCE ΔT2 (°C) | $-6 \geqq \Delta T2$ | 100 % | 100 % | 100 % | 100 % | 100 % | 100 % | 0 % |
| | $-6 < \Delta 2T \leqq -2$ | 100 % | 100 % | 100 % | 100 % | 95 % | 80 % | 0 % |
| | $-2 < \Delta T2 < 2$ | 100 % | 100 % | 100 % | 85 % | 75 % | 55 % | 0 % |
| | $2 \leqq \Delta T2 < 6$ | 100 % | 100 % | 70 % | 55 % | 55 % | 45 % | 0 % |
| | $\Delta T2 \geqq 6$ | 100 % | 100 % | 65 % | 50 % | 45 % | 0 % | 0 % |

| FOR CENTER HEATING SECTION | | FIRST TEMPERATURE DIFFERENCE ΔT1 (°C) | | | | | | |
|---|---|---|---|---|---|---|---|---|
| | | $-5 \geqq \Delta T1$ | $-5 < \Delta T1 \leqq -3$ | $-3 < \Delta T1 \leqq -1$ | $-1 < \Delta T1 < 1$ | $1 \leqq \Delta T1 < 3$ | $3 \leqq \Delta T1 < 5$ | $\Delta T1 \geqq 5$ |
| SECOND TEMPERATURE DIFFERENCE ΔT2 (°C) | $-6 \geqq \Delta T2$ | 100 % | 100 % | 100 % | 100 % | 100 % | 100 % | 0 % |
| | $-6 < \Delta 2T \leqq -2$ | 100 % | 100 % | 100 % | 100 % | 99 % | 80 % | 0 % |
| | $-2 < \Delta T2 < 2$ | 100 % | 100 % | 100 % | 100 % | 88 % | 55 % | 0 % |
| | $2 \leqq \Delta T2 < 6$ | 100 % | 100 % | 100 % | 80 % | 65 % | 45 % | 0 % |
| | $\Delta T2 \geqq 6$ | 100 % | 100 % | 100 % | 70 % | 55 % | 0 % | 0 % |

FIG. 31 (a)

FOR FULL-WIDTH HEATING SECTION (%)

| TABLE a POWER SUPPLY VOLTAGE: 220V TO 240V ON STANDBY | | | TEMPERATURE DIFFERENCE BETWEEN TARGET TEMPERATURE AND CURRENT TEMPERATURE | | | | | | |
|---|---|---|---|---|---|---|---|---|---|
| | | | A | B | C | D | E | F | G |
| | | | 4 | 3 | 1 | — | 1 | 3 | 5 |
| TEMPERATURE DIFFERENCE BETWEEN LAST AND CURRENT TEMPERATURES (TEMPERATURE SLOPE) | A | 5 | 100 | 100 | 100 | 100 | 100 | 0 | 0 |
| | B | 1 | 100 | 100 | 100 | 100 | 0 | 0 | 0 |
| | C | — | 100 | 100 | 100 | 0 | 0 | 0 | 0 |
| | D | 2 | 100 | 100 | 100 | 0 | 0 | 0 | 0 |
| | E | 6 | 100 | 100 | 0 | 0 | 0 | 0 | 0 |

(%)

| TABLE b POWER SUPPLY VOLTAGE: 220V TO 240V IN PRINTING | | | TEMPERATURE DIFFERENCE BETWEEN TARGET TEMPERATURE AND CURRENT TEMPERATURE | | | | | | |
|---|---|---|---|---|---|---|---|---|---|
| | | | A | B | C | D | E | F | G |
| | | | 5 | 3 | 1 | — | 1 | 3 | 5 |
| TEMPERATURE DIFFERENCE BETWEEN LAST AND CURRENT TEMPERATURES (TEMPERATURE SLOPE) | A | 6 | 100 | 100 | 100 | 100 | 100 | 100 | 0 |
| | B | 2 | 100 | 100 | 100 | 100 | 90 | 80 | 0 |
| | C | — | 100 | 100 | 90 | 80 | 70 | 55 | 0 |
| | D | 2 | 100 | 100 | 70 | 55 | 55 | 45 | 0 |
| | E | 6 | 100 | 100 | 65 | 50 | 45 | 0 | 0 |

(%)

| TABLE c POWER SUPPLY VOLTAGE: 100V AND 120V ON STANDBY | | | TEMPERATURE DIFFERENCE BETWEEN TARGET TEMPERATURE AND CURRENT TEMPERATURE | | | | | | |
|---|---|---|---|---|---|---|---|---|---|
| | | | A | B | C | D | E | F | G |
| | | | 4 | 3 | 1 | — | 1 | 3 | 5 |
| TEMPERATURE DIFFERENCE BETWEEN LAST AND CURRENT TEMPERATURES (TEMPERATURE SLOPE) | A | 5 | 100 | 100 | 65 | 35 | 20 | 5 | 0 |
| | B | 1 | 100 | 35 | 15 | 15 | 10 | 0 | 0 |
| | C | — | 100 | 15 | 7 | 7 | 5 | 0 | 0 |
| | D | 2 | 100 | 15 | 7 | 0 | 0 | 0 | 0 |
| | E | 6 | 100 | 15 | 7 | 0 | 0 | 0 | 0 |

(%)

| TABLE d POWER SUPPLY VOLTAGE: 100V AND 120V IN PRINTING | | | TEMPERATURE DIFFERENCE BETWEEN TARGET TEMPERATURE AND CURRENT TEMPERATURE | | | | | | |
|---|---|---|---|---|---|---|---|---|---|
| | | | A | B | C | D | E | F | G |
| | | | 5 | 3 | 1 | — | 1 | 3 | 5 |
| TEMPERATURE DIFFERENCE BETWEEN LAST AND CURRENT TEMPERATURES (TEMPERATURE SLOPE) | A | 6 | 100 | 100 | 100 | 100 | 100 | 100 | 0 |
| | B | 2 | 100 | 100 | 100 | 100 | 55 | 45 | 0 |
| | C | — | 100 | 90 | 55 | 45 | 35 | 20 | 0 |
| | D | 2 | 100 | 85 | 35 | 20 | 20 | 10 | 0 |
| | E | 6 | 100 | 70 | 30 | 15 | 10 | 0 | 0 |

FIG. 31 (b)

FOR CENTER HEATING SECTION (%)

| TABLE e POWER SUPPLY VOLTAGE: 220V TO 240V ON STANDBY | | | TEMPERATURE DIFFERENCE BETWEEN TARGET TEMPERATURE AND CURRENT TEMPERATURE | | | | | | |
|---|---|---|---|---|---|---|---|---|---|
| | | | A | B | C | D | E | F | G |
| | | | 4 | 3 | 1 | — | 1 | 3 | 5 |
| TEMPERATURE DIFFERENCE BETWEEN LAST AND CURRENT TEMPERATURES (TEMPERATURE SLOPE) | A | 5 | 100 | 100 | 100 | 100 | 100 | 0 | 0 |
| | B | 1 | 100 | 100 | 100 | 100 | 0 | 0 | 0 |
| | C | — | 100 | 100 | 100 | 0 | 0 | 0 | 0 |
| | D | 2 | 100 | 100 | 100 | 0 | 0 | 0 | 0 |
| | E | 6 | 100 | 100 | 0 | 0 | 0 | 0 | 0 |

(%)

| TABLE f POWER SUPPLY VOLTAGE: 220V TO 240V IN PRINTING | | | TEMPERATURE DIFFERENCE BETWEEN TARGET TEMPERATURE AND CURRENT TEMPERATURE | | | | | | |
|---|---|---|---|---|---|---|---|---|---|
| | | | A | B | C | D | E | F | G |
| | | | 5 | 3 | 1 | — | 1 | 3 | 5 |
| TEMPERATURE DIFFERENCE BETWEEN LAST AND CURRENT TEMPERATURES (TEMPERATURE SLOPE) | A | 6 | 100 | 100 | 100 | 100 | 100 | 100 | 0 |
| | B | 2 | 100 | 100 | 100 | 100 | 95 | 80 | 0 |
| | C | — | 100 | 100 | 100 | 95 | 80 | 55 | 0 |
| | D | 2 | 100 | 100 | 100 | 80 | 65 | 45 | 0 |
| | E | 6 | 100 | 100 | 100 | 70 | 55 | 0 | 0 |

(%)

| TABLE g POWER SUPPLY VOLTAGE: 100V AND 120V ON STANDBY | | | TEMPERATURE DIFFERENCE BETWEEN TARGET TEMPERATURE AND CURRENT TEMPERATURE | | | | | | |
|---|---|---|---|---|---|---|---|---|---|
| | | | A | B | C | D | E | F | G |
| | | | 4 | 3 | 1 | — | 1 | 3 | 5 |
| TEMPERATURE DIFFERENCE BETWEEN LAST AND CURRENT TEMPERATURES (TEMPERATURE SLOPE) | A | 5 | 100 | 100 | 65 | 35 | 20 | 5 | 0 |
| | B | 1 | 100 | 35 | 15 | 15 | 10 | 0 | 0 |
| | C | — | 100 | 15 | 7 | 7 | 5 | 0 | 0 |
| | D | 2 | 100 | 15 | 7 | 0 | 0 | 0 | 0 |
| | E | 6 | 100 | 15 | 7 | 0 | 0 | 0 | 0 |

(%)

| TABLE h POWER SUPPLY VOLTAGE: 100V AND 120V IN PRINTING | | | TEMPERATURE DIFFERENCE BETWEEN TARGET TEMPERATURE AND CURRENT TEMPERATURE | | | | | | |
|---|---|---|---|---|---|---|---|---|---|
| | | | A | B | C | D | E | F | G |
| | | | 5 | 3 | 1 | — | 1 | 3 | 5 |
| TEMPERATURE DIFFERENCE BETWEEN LAST AND CURRENT TEMPERATURES (TEMPERATURE SLOPE) | A | 6 | 100 | 100 | 100 | 100 | 100 | 100 | 0 |
| | B | 2 | 100 | 100 | 100 | 100 | 60 | 45 | 0 |
| | C | — | 100 | 90 | 65 | 50 | 35 | 20 | 0 |
| | D | 2 | 100 | 85 | 45 | 25 | 20 | 10 | 0 |
| | E | 6 | 100 | 70 | 35 | 20 | 10 | 0 | 0 |

FIG. 34 (a)

| TIME FOR WHICH CONTROL TARGET TEMPERATURE IS NOT REACHED (SEC.) | LESS THAN 10 | LESS THAN 15 | LESS THAN 20 | LESS THAN 25 | LESS THAN 30 | 30 OR MORE |
|---|---|---|---|---|---|---|
| CORRECTION VALUE | +5% | +10% | +15% | +20% | +25% | +30% |

FIG. 34 (b)

| TIME FOR WHICH CONTROL TEMPERATURE IS EXCEEDED (SEC.) | LESS THAN 10 | LESS THAN 15 | LESS THAN 20 | LESS THAN 25 | LESS THAN 30 | 30 OR MORE |
|---|---|---|---|---|---|---|
| CORRECTION VALUE | −3% | −7% | −11% | −15% | −18% | −23% |

FIG. 34 (c)

| TIME FOR WHICH CONTROL TARGET TEMPERATURE IS NOT REACHED (SEC.) | LESS THAN 20 | LESS THAN 30 | LESS THAN 40 | 40 OR MORE |
|---|---|---|---|---|
| CORRECTION VALUE | +20% | +40% | +50% | 100% |

FIXING DEVICE, IMAGE FORMING APPARATUS, AND TEMPERATURE CONTROL METHOD FOR FIXING DEVICE

This Nonprovisional application claims priority under 35 U.S.C. §119(a) on Patent Applications No. 2009-282188 filed in Japan on Dec. 11, 2009 and No. 2010-261457 filed in Japan on Nov. 24, 2010, the entire contents of which are hereby incorporated by reference.

TECHNICAL FIELD

The present invention relates to a fixing device provided to an electrophotographic image forming apparatus and a temperature control method for the fixing device.

BACKGROUND ART

As a fixing device used in an electrophotographic image forming apparatus such as a copying machine or a printer, a fixing device employing a heat roller fixing system is often used. The fixing device employing the heat roller fixing device includes a pair of rollers (a fixing roller and a pressure roller) that press against each other. Inside both or either one of this pair of rollers, heating means made of, for example, a halogen heater is provided. After the pair of rollers are heated to a predetermined temperature (target fixing temperature) by the heating means, recording paper on which unfixed toner image is formed is fed into a pressure area (fixing nip area) between the pair of rollers. When the recording paper passes through the pressure area, the unfixed toner image is fixed by heat and pressure.

Note that in a fixing device provided in a color image forming apparatus, it is common to use an elastic roller which has an elastic layer made of, for example, silicone rubber which elastic layer is provided on a surface layer of the fixing roller. Because the fixing roller is an elastic roller, a surface of the fixing layer is elastically deformed in accordance with an uneven surface of the unfixed toner image. Accordingly, the fixing roller touches a toner image surface a part by a part so as to cover the toner image surface a part by a part. Therefore, heat fixing can be preferably performed on an unfixed color toner image which contains more toner than an unfixed monochrome image.

Further, due to an effect of restoration from the deformation of the elastic layer at an exit of the fixing nip area, it becomes possible to improve releasability from color toner whose offset occurs more easily as compared with offset of monochrome toner.

Furthermore, a nip shape of the fixing nip area has an upward convexity (toward a fixing roller side) (so-called, a reverse nip shape). This makes it possible to improve paper stripping performance. As a result, without any stripping means such as a stripping claw, paper can be stripped (self-stripping). This consequently solves an image defect caused by the stripping means.

Further, in such a color fixing device, a nip width of the fixing nip area is required to be wider for increasing a process speed (a speed for carrying recording material). As methods for widening the nip width, there are two methods, i.e., a method in which a thickness of the elastic layer of the fixing roller is increased and a method in which a diameter of the fixing roller is increased.

However, in a case where a process speed is increased in a conventional configuration in which heating means is in a fixing roller, the method in which a thickness of an elastic layer is increased may result in insufficient heat supply to a surface of the fixing roller. This is because the elastic layer has a low heat conductivity. This may consequently lower a temperature of the surface of the fixing roller. Meanwhile, in the above case in the conventional configuration, the method in which a diameter of the fixing roller is increased may result in a larger heat capacity of each roller. This may lengthens a time for warming up or increases power consumption.

In order to solve such problems, in recent years, a color fixing device of a belt fixing system has been used increasingly. The belt fixing system is configured by stretching a fixing belt over a fixing roller and a heat roller and causing the fixing roller and the pressure roller to press against each other via the fixing belt.

This type of the fixing device of the belt fixing system has a short warming-up time because the fixing belt to be heated has a small heat capacity. Further, in this type of the fixing device, it is not necessary to provide a heat source such as a halogen lamp inside the fixing roller. This makes it possible to provide a thicker elastic layer which has a low hardness. For example, the elastic layer may be made of sponge rubber. As a result, a wide nip area can be ensured.

For further shortening the warming-up time in the fixing device of the heat roller fixing system or the belt fixing system as described above, (i) a heat capacity of a member to be heated (a fixing roller or a fixing belt) may be lowered or alternatively (ii) an output of heating means for heating the member to be heated may be increased. However, in a case where the heat capacity of the member to be heated is lowered or the output of the heating means is increased, an optimal temperature control becomes difficult. As a result, a temperature of a member to be heated varies to a large extent in the vicinity of a target temperature. This consequently causes a temperature change (temperature ripple) having a wide temperature range.

In a temperature control method of a conventional fixing device, temperature control is carried out on a temperature control target object such as the fixing member or the pressure member. In the temperature control, electricity to the heating means is turned on if the current temperature of the temperature control target object is lower than a target temperature; electricity to the heating means is turned off if the current temperature of the temperature control target object is higher than the target temperature. However, in the above temperature control, temperature rise may not stop immediately when the temperature of the temperature control target object reaches the target temperature and the temperature control target object may be overheated. Such a problem may occur in the following cases: (i) a case where the heat capacity of the temperature control target object is low; (ii) a case where an amount of heat supplied by the heating means is large; (iii) a case where a thermal time constant of the temperature control target object is small; or (iv) a case where a thermal time constant of temperature detection means is small which temperature detection means detects a temperature of the temperature control target object. Further, when heating by the heating means is stopped, a drastic temperature fall may occur due to an influence of heat dissipation or heat load.

In a case where a large temperature ripple occurs, toner may excessively melt and the melted toner may act as an adhesive between recording paper and the member to be heated (the fixing roller or the fixing belt). In such a case, the recording paper may wind around the heating member or, even if a problem does not occur to the extent that the recording paper winds around the heating member, an image surface after fixing may become coarse and image deterioration may occur. Meanwhile, overheating means supply of excessive thermal energy. Accordingly, overheating increases power consumption. In addition, a fixing error may also be caused by insufficiently melt toner due to an insufficient amount of heat supplied to the member to be heated.

In order to solve the above problems, Patent Literature 1 discloses PID control as a method for precisely controlling power supply to the heating means.

In this PID control, proportional control (P-operation), integral control (I-operation), derivative control (D-operation) are combined, and a current output to the heating means is determined based on a current temperature state, a past control state, and the like. If respective parameters of these three operations are well adjusted for a control target object, the temperature ripple can be drastically suppressed.

In Patent Literature 1, an output value of the heating means is calculated in detail based on temperature information from temperature detection means that detects a temperature of the member to be heated. In accordance with the calculated output value, an amount of power to be supplied is precisely controlled so that the temperature ripple is suppressed.

However, in the technique of Patent Literature 1, it is required to shorten a control cycle of power supply to the heating means, for suppressing the temperature ripple. Accordingly, a high-speed control system is required.

Further, in a case where the temperature of the member to be heated drastically changes in a short period of time, an output to the heating means is required to promptly increase to the maximum value for effectively suppressing a decrease in temperature and/or the temperature ripple. However, in the case where the PID control as disclosed in Patent Literature 1 is used, a delay may occur in an operation for suppressing the decrease in temperature by increasing the output to the heating means to the maximum. In such a case, the decrease in temperature may not be sufficiently suppressed. Further, in the configuration of Patent Literature 1, if the output to the heating means is promptly changed in a case where the temperature of the member to be heated drastically changes in a short period of time, the temperature control may become unsteady. As a result, the temperature ripple may not be sufficiently suppressed.

In addition, according to the technique of Patent Literature 1, for enhancing a temperature ripple suppressing effect provided by a control system, control is carried out in a very-short control cycle. Accordingly, a cycle of change in output becomes short. This may cause a higher harmonic noise in an AC supply. Further, in a case where the control cycle is shortened, each parameter cannot be easily fixed. Therefore, adjustment of the various parameters is often troublesome.

In order to solve the above problems, Patent Literatures 2 to 4 disclose a method for controlling the temperature ripple by a simpler control system. In this method, a duty ratio of a power waveform of power supply to the heating means is determined, based on (i) a temperature difference between the current temperature and a target temperature and (ii) a state of current temperature transition. Then, the power supply to the heating means is subjected to duty control.

More specifically, in Patent Literature 2, a table to be used in temperature control is chosen from among a plurality of tables, in accordance with a time taken for a rise of a temperature to a predetermined temperature at the time when the power supply is turned on. Then, by using the table selected, the duty control is performed.

In Patent Literature 3, a temperature division is determined based on a temperature difference between the current temperature and a target temperature. Then, in accordance with a change between the current temperature division and a previous temperature division, the duty control is performed.

In Patent Literature 4, according to a change in a state of feeding recording material, the power supply to the heating means is subjected to the duty control. Here, the duty ratio is set at 100% when the recording material passes. Meanwhile, the duty ratio is set based on a temperature difference and a temperature transition state in a period after a sheet of recording material has passed and before a next sheet of recording material is fed.

Citation List

[Patent Literature]

Patent Literature 1

Japanese Patent Application Publication, Tokukaihei, No. 9-258601 A (Publication Date: Oct. 3, 1997)

Patent Literature 2

Japanese Patent Application Publication, Tokukai, No. 2000-330418 A (Publication Date: Nov. 30, 2000)

Patent Literature 3

Japanese Patent Application Publication, Tokukai, No. 2007-3663 A (Publication Date: Jan. 11, 2007)

Patent Literature 4

Japanese Patent Application Publication, Tokukai, No. 2008-134377 A (Publication Date: Jun. 12, 2008)

SUMMARY OF INVENTION

Technical Problem

However, according to methods disclosed in Patent Literatures 2 to 4, a sufficient temperature ripple suppressing effect may not be obtained.

More specifically, in the Patent Literature 2, a period from a time when a power is turned on to a time when a temperature reaches up to a predetermined temperature is not uniform due to an external disturbance factor such as a change in environment conditions or supply voltage. This makes it difficult to select an optimum duty ratio setting table. As a result, a sufficient temperature ripple suppressing effect may not be obtained.

In Patent Literature 3, a temperature division is determined based on a temperature difference between the current temperature and a target temperature. Then, in accordance with a change between the current temperature division and a previous temperature division, duty control is performed. However, it is difficult to predict, from a change of the temperature division, a trend of temperature change right after determination of the current temperature division. Accordingly, a sufficient temperature ripple suppressing effect may not be obtained.

In Patent Literature 4, a duty ratio is set at 100% when recording material passes. Meanwhile, the duty ratio is set based on a temperature difference and a temperature transition state in a period after a sheet of recording material has passed and before a next sheet of recording material is fed. However, in a case where a speed for carrying the recording material is high or in a case where an interval at which sheets of recording material are fed is short, a time for the temperature control by use of the duty ratio set based on the temperature difference and the temperature transition state is short. Accordingly, a sufficient temperature ripple suppressing effect may not be obtained.

The present invention is attained in view of the above problems. An object of the present invention is to provide a fixing device and a fixing method each of which makes it possible to simply and effectively suppress a temperature ripple of a fixing member.

Solution to Problem

In order to solve the above problems, a fixing device of the present invention includes: a fixing member; a pressure member; a heating member for heating the fixing member at a heat quantity corresponding to an amount of power supplied; and a temperature control section for controlling an amount of power to be supplied to the heating member, the fixing member and the pressure member being rotatably provided, the fixing member and the pressure member carrying recording material provided between the fixing member and the pressure member while sandwiching the recording material between the fixing member and the pressure member, the fixing member and the pressure member fixing, onto the recording material, an unfixed image formed on the recording material by heat and pressure while carrying the recording material, the control section including: a temperature detecting section for detecting a temperature of the fixing device; a temperature storage section for storing a temperature detection result obtained by the temperature detecting section; a temperature difference calculating section for calculating a first temperature difference and a second temperature difference, the first temperature difference being a difference between (a) a first detected temperature that is a current temperature of the fixing member which temperature is detected by the temperature detecting section and (b) a control target temperature of the fixing member, the second temperature difference being a difference between (a) the first detected temperature and (b) a past temperature of the fixing member which past temperature was detected by the temperature detecting section a predetermined time earlier than the current time; a table storage section for storing an output setting table in which a combination of the first temperature difference and the second temperature difference is associated with information for specifying the amount of power to be supplied to the heating member; an output determining section for reading out, from the output setting table, the information corresponding to the combination of the first temperature difference and the second temperature difference which are calculated by the temperature difference calculating section and for determining the amount of power to be supplied to the heating member based on the information; and a power control section for controlling an actual amount of power supplied to the heating member in accordance with the amount of power to be supplied to the heating member which amount is determined by the output determining section.

Further, a method of controlling a temperature of a fixing device of the present invention, the fixing device including: a fixing member; a pressure member; and a heating member for heating the fixing member at a heat quantity corresponding to an amount of power supplied, the fixing member and the pressure member being rotatably provided, the fixing member and the pressure member carrying recording material provided between the fixing member and the pressure member while sandwiching the recording material between the fixing member and the pressure member, the fixing member and the pressure member fixing, onto the recording material, an unfixed image formed on the recording material by heat and pressure while carrying the recording material, the method comprising the steps of: (i) detecting a temperature of the fixing device; (ii) storing a temperature detection result obtained in the step (i); (iii) calculating a first temperature difference and a second temperature difference, the first temperature difference being a difference between (a) a first detected temperature that is a current temperature of the fixing member which temperature is detected in the step (i) and (b) a control target temperature of the fixing member, the second temperature difference being a difference between (a) the first detected temperature and (b) a past temperature of the fixing member which past temperature was detected in the step (i) a predetermined time earlier than the current time; (iv) determining an amount of power to be supplied to the heating member based on information corresponding to a combination of the first temperature difference and the second temperature difference which are calculated in the step (iii), by reading out the information from an output setting table in which the information is associated with the combination of the first temperature difference and the second temperature difference, the information being for specifying the amount of power to be supplied to the heating member; and (v) controlling an actual amount of power supplied to the heating member in accordance with the amount of power to be supplied to the heating member which amount is determined in the step (iv).

According to the above fixing device and the above method of controlling a temperature of a fixing device, the first temperature difference reflects how close to the control target temperature the temperature of the fixing device reaches; the second temperature difference reflects a trend of a change in the current temperature of the fixing member. Accordingly, in consideration of a degree of closeness to the control target temperature and the trend of the change in the current temperature, the amount of power to be supplied to the heating member can be appropriately controlled so that overheating or shortage of heating can be prevented. This makes it possible to reduce a temperature ripple. Consequently, it becomes possible to prevent winding of recording material onto the fixing member, hot offset, or a resultant coarse image each caused by excessive melting of toner or a defect in fixing caused by insufficient melting of toner. In addition, it is also possible to reduce power consumption. Further, as compared to a case where a PID control is performed, complex tuning in determining parameters for the PID control is not necessary. Therefore, it becomes possible to realize a fixing device capable of appropriately controlling an amount of power to be supplied to the heating member in a simple configuration.

Advantageous Effects of Invention

As described above, a fixing device of the present invention includes: a temperature detecting section for detecting a temperature of the fixing device; a temperature storage section for storing a temperature detection result obtained by the temperature detecting section; a temperature difference calculating section for calculating a first temperature difference and a second temperature difference, the first temperature difference being a difference between (a) a first detected temperature that is a current temperature of the fixing member which temperature is detected by the temperature detecting section and (b) a control target temperature of the fixing member, the second temperature difference being a difference between (a) the first detected temperature and (b) a past temperature of the fixing member which past temperature was detected by the temperature detecting section a predetermined time earlier than the current time; a table storage section for storing an output setting table in which a combination of the first temperature difference and the second temperature difference is associated with information for specifying the amount of power to be supplied to the heating member; an output determining section for reading out, from the output setting table, the information corresponding to the combination of the first temperature difference and the second temperature difference which are calculated by the temperature difference calculating section and for determining the amount of power to be supplied to the heating member based on the information; and a power control section for controlling an actual amount of power supplied to the heating member in accordance with the amount of power to be supplied to the heating member which amount is determined by the output determining section.

Further, a method of controlling a temperature of a fixing device of the present invention includes the steps of: (i) detecting a temperature of the fixing device; (ii) storing a temperature detection result obtained in the step (i); (iii) calculating a first temperature difference and a second temperature difference, the first temperature difference being a difference between (a) a first detected temperature that is a current temperature of the fixing member which temperature is detected in the step (i) and (b) a control target temperature of the fixing member, the second temperature difference being a difference between (a) the first detected temperature and (b) a past temperature of the fixing member which past temperature was detected in the step (i) a predetermined time earlier than the current time; (iv) determining an amount of power to be supplied to the heating member based on information corresponding to a combination of the first temperature difference and the second temperature difference which are calculated in the step (iii), by reading out the information from an output setting table in which the information is associated with the combination of the first temperature difference and the second temperature difference, the information being for specifying the amount of power to be supplied to the heating member; and (v) controlling an actual amount of power supplied to the heating member in accordance with the amount of power to be supplied to the heating member which amount is determined in the step (iv).

Therefore, according to the fixing device and the method of controlling a temperature of the fixing device, it is possible to reduce a temperature ripple in a simple configuration.

BRIEF DESCRIPTION OF DRAWINGS

FIG. 1 is a flowchart illustrating a flow of a temperature control process in a fixing device according to one embodiment of the present invention.

FIG. 2 is a cross sectional view of an image forming apparatus according to one embodiment of the present invention.

FIG. 3 is a cross sectional view of a fixing device provided to the image forming apparatus of FIG. 2.

FIG. 4 is a cross sectional view of a heating member which is provided in the fixing device of FIG. 3.

FIG. 5 is a plan view of a heating member which is provided in the fixing device of FIG. 3.

FIG. 6 is a block diagram of a control section provided in the fixing device of FIG. 3.

FIG. 7

FIG. 7 is a table showing an example of an output setting table used in the fixing device of FIG. 3.

FIG. 8(*a*) is a graph showing a waveform of a power supply voltage to the heating member in the fixing device of FIG. 3.

FIG. 8(*b*)

FIG. 8(*b*) is a graph showing a waveform of a power supply voltage to the heating member in the fixing device of FIG. 3.

FIG. 9(*a*)

FIG. 9(*a*) is a graph showing results of detection of temperatures of a fixing belt and a pressure roller in a case where temperature control is performed according to a conventional control method.

FIG. 9(*b*)

FIG. 9(*b*) is a graph showing results of detection of temperatures of a fixing belt and a pressure roller in a case where temperature control is performed according to a control method of the present invention shown in FIG. 1.

FIG. 10

FIG. 10 is a table showing another example of an output setting table used in the fixing device of FIG. 3.

FIG. 11 is a cross sectional view of a fixing device according to another embodiment of the present invention.

FIG. 12 is a flowchart of a flow of a temperature control process in the fixing device of FIG. 11.

FIG. 13(*a*)

FIG. 13(*a*) is a table showing an example of an output specifying table used in the fixing device of FIG. 11.

FIG. 13(*b*)

FIG. 13(*b*) is a table showing an example of a level change value table used in the fixing device of FIG. 11.

FIG. 14(*a*)

FIG. 14(*a*) is a graph showing results of detection of temperatures of a fixing belt and a pressure roller in a case where temperature control is performed according to a conventional control method.

FIG. 14(*b*)

FIG. 14(*b*) is a graph showing results of detection of temperatures of a fixing belt and a pressure roller in a case where temperature control is performed according to a control method of the present invention as shown in FIG. 11.

FIG. 15

FIG. 15 is a table showing an example of a level change value table used in the fixing device of FIG. 11.

FIG. 16

FIG. 16 is a table illustrating a relation between an output value and a combination of an output specifying table and a level change value table, in a case where a plurality of output specifying tables and a plurality of level change value tables are used in the fixing device of FIG. 11.

FIG. 17 is a flowchart showing a flow of a temperature control process in a case where a plurality of output specifying tables and a plurality of level change value tables are used in the fixing device of FIG. 11.

FIG. 18 is a flow chart illustrating a temperature control process in the fixing device of FIG. 11 which temperature control process uses (i) a process for determining an amount of power to be supplied, by use of an output setting table and (ii) a process for determining an amount of power to be supplied, by use of a level change value table and an output specifying table and in which temperature control process the processes (i) and (ii) are switched from each other.

FIG. 19

FIG. 19 is a table showing an example of a level change value table in a case where a power to be supplied to a heating member is set in accordance with a rate of change in second temperature difference in the fixing device of FIG. 11.

FIG. 20 is a cross sectional view illustrating a modified example of a fixing device of the present invention.

FIG. 21 is a cross sectional view illustrating a modified example of a fixing device of the present invention.

FIG. 22 is a cross sectional view illustrating a modified example of a fixing device of the present invention.

FIG. 23

FIG. 23 is an explanatory diagram illustrating modified examples of a fixing device according to one embodiment of the present invention and operation conditions of the modified examples.

FIG. 24

FIG. 24 shows tables that are examples of output setting tables used in fixing devices according to one embodiment of the present invention.

FIG. 25

FIG. 25 is a table showing an example of an output setting table used in a fixing device according to one embodiment of the present invention.

FIG. 26

FIG. 26 is a table showing an example of an output setting table used in a fixing device according to one embodiment of the present invention.

FIGS. 27(*a*), 27(*b*), and 27(*c*)

FIGS. 27(*a*), 27(*b*), and 27(*c*) are tables illustrating examples of correction methods in a case where an amount of power calculated based on an output setting table is corrected in accordance with a change in load on an image forming apparatus, in a fixing device according to one embodiment of the present invention.

FIG. 28

FIG. 28 shows tables that are examples of output setting tables each set for each operation mode, in an fixing device according to one embodiment of the present invention.

FIG. 29

FIG. 29 shows tables that are examples of output setting tables each set for each power supply voltage, in an fixing device according to one embodiment of the present invention.

FIG. 30

FIG. 30 shows tables that are examples of output setting tables in a case where an output setting table for a full-width heating section and an output setting table for a center heating section are separately set, in an fixing device according to one embodiment of the present invention.

FIGS. 31(*a*) and 31(*b*)

FIGS. 31(*a*) and 31(*b*) show tables that are examples of output setting tables in a case where (i) an output setting table for a full-width heating section and an output setting table for a center heating section are separately set and (ii) outputting setting tables are switched depending on power supply voltages and operation modes.

FIG. 32 is a block diagram illustrating a configuration of a control section provided in a fixing device according to a still another embodiment of the present invention.

FIG. 33 is a flowchart showing an operation flow of the control section shown in FIG. 32.

FIGS. 34(*a*), 34(*b*), and 34(*c*)

FIGS. 34(*a*), 34(*b*), and 34(*c*) are tables showing examples of correction value tables used in the fixing device shown in FIG. 32; FIG. 34(*a*) shows an example of a correction value table for a case where a temperature does not reach a control target temperature; FIG. 34(*b*) shows an example of a correction value table for a case where the temperature exceeds the control target temperature; FIG. 34(*c*) shows another example of a correction value table for a case where the temperature does not reach the control target temperature.

FIG. 35 is a flowchart illustrating a flow of a process in a fixing device according to yet another embodiment of the present invention.

FIG. 36 is a graph showing transition over time of a first detected temperature, an amount of power set based on an output setting table (an amount of power that has not been corrected yet), an integral correction value, a derivative correction value, and a corrected amount of power, in a case where temperature control is performed according to still another embodiment of the present invention.

FIG. 37 is a graph showing on/off states of heater lamps and temperature detection results obtained by thermistors, in a case where a temperature of each of the heater lamps in the fixing device shown in FIG. 11 is controlled based on an amount of power set based on an output setting table.

FIG. 38 is a graph showing on/off states of heater lamps and temperature detection results obtained by thermistors, in a case where a temperature of each of the heater lamps in the fixing device shown in FIG. 11 is controlled based on an amount of power obtained by correcting an amount of power set based on an output setting table by use of a correction value for integral control and a correction value for derivative control described above.

DESCRIPTION OF EMBODIMENTS

[Embodiment 1]

The following explains one embodiment of the present invention. Note that the present embodiment mainly explains a case where the present invention is applied to a color printer; however, an object to which the present invention is applied is not to such a color printer. The present invention is applicable to any electrophotographic image forming apparatus. For example, the present invention is applicable to a color multifunction peripheral, a color copying machine, a monochrome multifunction peripheral, a monochrome copying machine, a monochrome printer, etc., other than the color printer.

Figure 2:
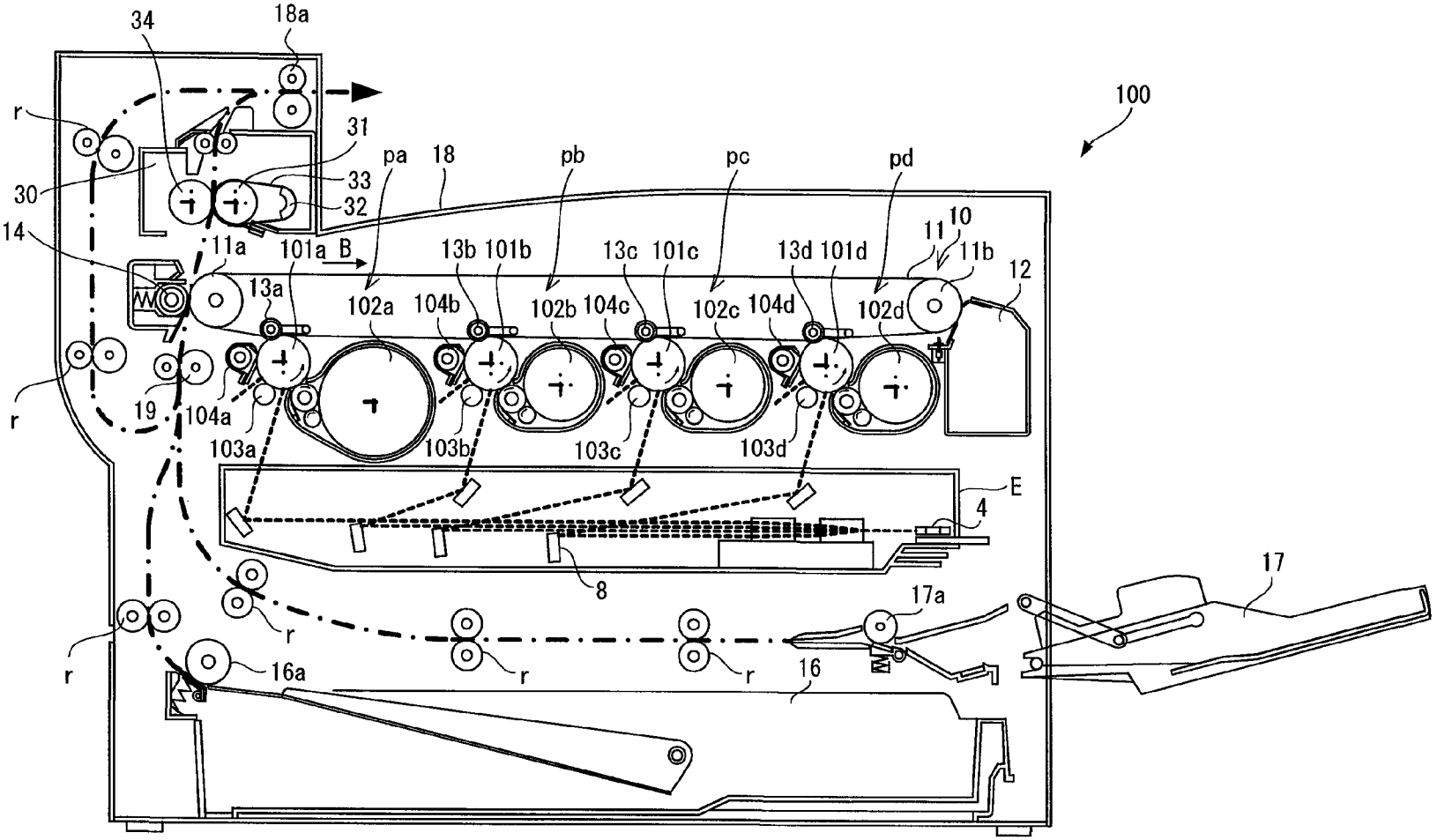
FIG. 2

FIG. 2 is a cross sectional view illustrating an image forming apparatus (color printer) 100 of the present embodiment. As shown in FIG. 2, the image forming apparatus 100 includes an exposure unit (optical unit) E, four visible image forming units pa to pd, an intermediate transfer belt unit 10, a second transfer unit 14, a fixing device 30, an internal paper feeding unit 16, and a manual paper feeding unit 17. Note that operations of respective members included in the image forming apparatus 100 are controlled by a main control section made of a CPU (not shown), for example.

Image data handled in the image forming apparatus 100 corresponds to a color image formed by use of colors including black (K), cyan (C), magenta (M), and yellow (Y). Accordingly, as shown in FIG. 2, the image forming apparatus 100 is provided with the four visible image forming units pa to pd respectively corresponding to the above colors. In the image forming apparatus 100, each of four color toner images respectively formed by these four visible image forming units pa to pd are superposed on an intermediate transfer belt 11 provided in the intermediate transfer belt unit 10.

The visible image forming unit pa is configured to include a photoreceptor 101*a*, a developing unit 102*a*, a charging unit 103*a*, and a cleaning unit 104*a*. The photoreceptor 101*a* is a toner image bearing member and rotatably provided. The charging unit 103*a*, the developing unit 102*a*, and the cleaning unit 104*a* are provided around the photoreceptor 101*a*, in this order in a direction of rotation of the photoreceptor 101*a*.

The charging unit 103*a* is for uniformly charging a surface of the photoreceptor 101*a* to a predetermined potential. The present embodiment employs, as the charging unit 103*a*, a charging roller system (contact charge system). This is for suppressing as much as possible generation of ozone in uniformly charging the surface of the photoreceptor 101*a*. However, note that the configuration of the charging unit 103*a* is not limited to this. The present embodiment may employ, for example, a non-contact charger such as a corona discharge system or a contact charger such as a charging brush.

The developing unit 102*a* performs a developing process for making, by use of a developer, a static latent image visible which static latent image is formed on the photoreceptor 101*a*. As the developer, for example, a nonmagnetic single component developer (nonmagnetic toner), a nonmagnetic two component developer (nonmagnetic toner and carrier), or a magnetic developer (magnetic toner) can be used.

The cleaning unit 104*a* is for removing and collecting toner remaining on the surface of the photoreceptor 101*a* after transfer of the toner image onto an intermediate transfer belt 111.

Note that respective configurations of the visible image forming units pb to pd are substantially the same as the configuration of the visible image forming unit pa, except that colors of toner to be used in the developing process are different from a color used in the visible image forming unit pa. That is, the visible image forming unit pa contains black (B) toner; the visible image forming unit pb contains yellow (Y) toner; the visible image forming unit pc contains magenta (M) toner; and the visible image forming unit pd contains cyan (C) toner.

The exposure unit E exposes photoreceptors 101*a* to 101*d* respectively charged by charging units 103*a* to 103*d*, in accordance with image data, and thereby forms static latent images on respective surfaces of the photoreceptors 101*a* to 101*d*. As the exposure unit E, a laser scanning unit (LSU) including a laser irradiation section 4, a reflective mirror 8, and the like is used. Note that as the exposure unit E, it is also possible to use, for example an EL or LED writing head in which light emitting elements are arranged in an array.

The intermediate transfer belt unit 10 includes the intermediate transfer belt 11, an intermediate transfer belt drive roller (tension roller) 11*a*, an intermediate transfer belt driven roller (tension roller) 11*b*, an intermediate transfer belt cleaning unit 12, and intermediate transfer rollers 13*a* to 13*d*.

The intermediate transfer belt 11 is an endless belt made of a film having a thickness in a range of approximately 100 μm to 150 μm. The intermediate transfer belt 11 is provided in a tensioned state over the intermediate transfer rollers 13*a* to 13*d*, the intermediate transfer belt drive roller 11*a*, and the intermediate transfer belt driven roller 11*b*. The intermediate transfer belt 11 is driven to rotate in a direction of an arrow B shown in FIG. 2. The toner images of respective colors which toner images are respectively formed on the photoreceptors 101*a* to 101*d* are transferred so that the toner images are sequentially superposed on the intermediate transfer belt 11. As a result, a color toner image (multicolor toner image) is formed on the intermediate transfer belt 11. Note that each of the intermediate transfer rollers 13*a* to 13*d* is provided so as to be opposed to corresponding one of the photoreceptors 101*a* to 101*d* via the intermediate transfer belt 11 in a position between (i) a section where corresponding one of the photoreceptors 101*a* to 101*d* is opposed to corresponding one of the developer units 102*a* to 102*d* and (ii) a section where corresponding one of the photoreceptors 101*a* to 101*d* is opposed to corresponding one of the cleaning units 104*a* to 104*d*. By applying, to the intermediate transfer rollers 113*a* to 113*d*, a high voltage whose polarity (+) is opposite to a polarity (−) of charge of toner, the respective toner images on the photoreceptors 101*a* to 101*d* are transferred onto the intermediate transfer belt 11. Further, the toner image formed on the intermediate transfer belt 11 is carried to a section where the intermediate transfer belt drive roller 11*a* and the second transfer unit 14 are opposed to each other, and then transferred onto recording paper carried to this section. Note that the intermediate transfer belt cleaning unit 12 abuts on the intermediate transfer belt 11 and removes and collects toner remaining on the intermediate transfer belt 11 after the transfer of the toner image onto the recording paper.

The fixing device 30 includes a fixing roller (belt supporting member) 31, a heating member (belt supporting member) 32, a fixing belt (fixing member) 33 supported by the fixing roller 31 and the heating member 32, and a pressure roller (pressure member) 34 that presses against the fixing roller 31 at a predetermined load via the fixing belt 33. The recording material onto which the toner image is transferred by the second transfer unit 14 is fed, at a predetermined fixing speed and at a predetermined sheet interval, to a pressure area (fixing nip area N) where the pressure roller 34 presses against the fixing belt 33 which is heated by the heating member 32. Then, by causing the recording material to pass through this pressure area, the fixing device 30 fixes the toner image onto the recording material by heat and pressure. Note that the fixing speed is a speed (so-called process speed) at which the recording material is carried. In the present embodiment, the fixing speed is set at 225 mm/sec. Further, note that in the present embodiment, an interval at which sheets of recording material are carried is set so that a copying speed (number of copies per minute) is 51 sheets/min. This copying speed is on an assumption that sheets of A4 size are carried so that a length side of each sheet is along a sheet carrying path that is described below.

Note that a surface of the recording material on which surface the unfixed toner image (unfixed image) is formed abuts on the fixing belt 33, whereas another surface of the recording material which another surface is opposite to the surface on which the unfixed toner image is formed abuts on the pressure roller 34. The fixing device 30 is explained in detail later.

The internal paper feeding unit 16 is for storing sheets of recording material to be used in image formation. The manual paper feeding unit 17 is for feeding recording material manually and provided on a side wall of the image forming apparatus 100 so that the manual paper feeding unit 17 can be freely folded. The paper output tray 18 is a tray for placing recording material on which image formation has been completed.

The image forming apparatus 100 is also provided with the sheet carrying path. The sheet carrying path is for carrying, ultimately to the output tray 18 through the second transfer unit 14 and the fixing device 30, a sheet of recording material fed by a pickup roller 16*a* from the internal paper feeding unit 16 and a sheet of paper material fed by a pickup roller 17*a* from the manual paper feeding unit 17. Along the sheet carrying path, a plurality of rollers r for carrying sheets of recording material are provided.

Figure 3:
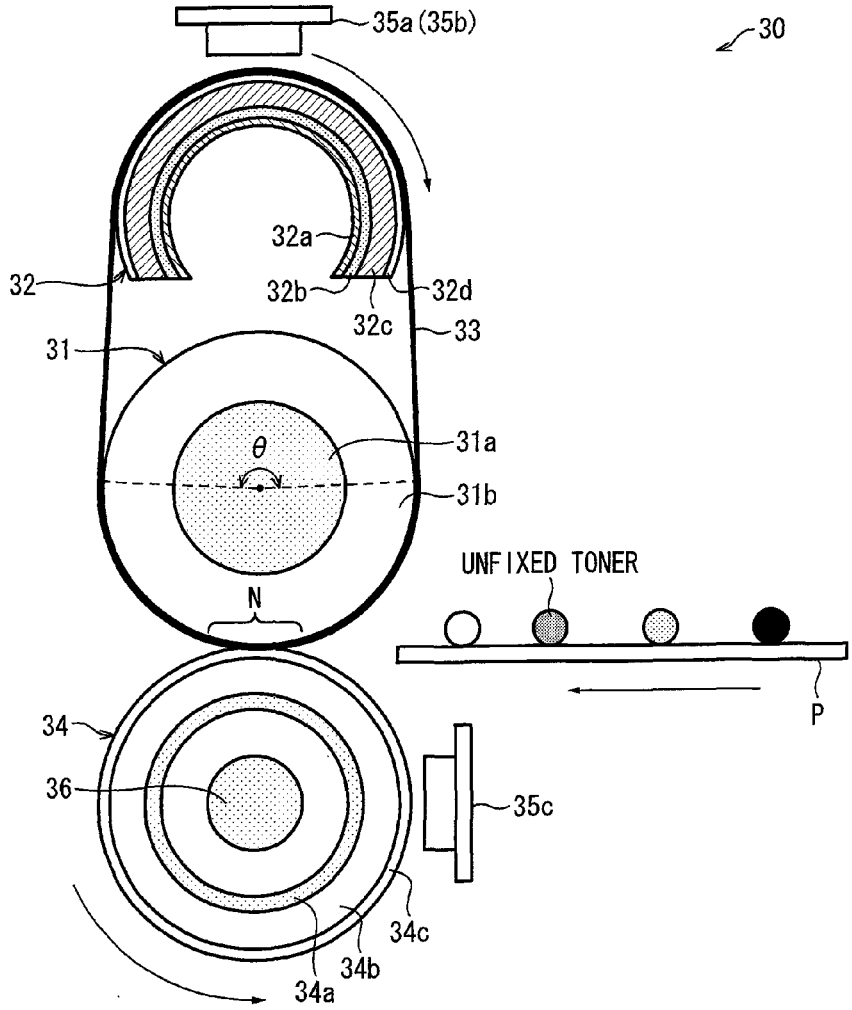
FIG. 3

Next, the following explains a configuration of the fixing device 30. FIG. 3 is a cross sectional view of the fixing device 30. As shown in FIG. 3, the fixing device 30 includes the fixing roller 31, the heating member 32, the fixing belt 33 supported by the fixing roller 31 and the heating member 32, and the pressure roller (pressure member) 34 pressing against the fixing roller 31 at a predetermined load (216 N in the present embodiment) via the fixing belt 33. Note that in the present embodiment, a nip width of the fixing nip area N (a width of an area where the fixing belt 33 abuts on the pressure roller 34, in a direction for carrying sheets of recording material) is set at 7 mm.

The fixing device 30 further includes a thermistor (a temperature detecting section, a center temperature detecting section) 35*a* and a thermistor (a temperature detecting section, an end section temperature detecting section) 35*b* in a position opposing to the fixing belt 33. The thermistors 35*a* and 35*b* are for detecting temperatures of the fixing belt 33. In addition, the fixing device 30 includes a thermistor (temperature detecting section, a pressure member temperature detecting section) 35*c* in a position opposing to the pressure roller 34. This thermistor 35*c* is for detecting a temperature of the pressure roller 34. Note that the thermistor 35*a* is provided at a position opposing to substantially a center of the fixing belt 33 in a width direction of the fixing belt 33 (hereinafter, the center is also expressed as a center in a width direction of the fixing belt 33) (more specifically, at a position that is 25 mm apart from the center of the width direction) in a region where the fixing belt 33 is wound around the heating member 32. Further, the thermistor 35*b* is provided at a position opposing to the vicinity of an end of the fixing belt 33 in the width direction of the fixing belt 33 (hereinafter, the end is also expressed as an end in a width direction of the fixing belt 33) (more specifically, at a position 150 mm apart from the center of the width direction) in the region where the fixing belt 33 is wound around the heating member 32. Furthermore, the thermistor 35*c* is provided so as to be opposed to the pressure roller 34, in a position 150 mm apart, along an axis direction of the pressure roller 34, from a center of the pressure roller 34 in the axis direction. Inside the pressure roller 34, a heater lamp (a halogen lamp, a pressure member heating section) 36 is provided. The heater lamp 36 is for heating the pressure roller 34. Temperature detection results of the thermistors 35*a*, 35*b*, and 35*c* are transmitted to a temperature control section 42 (See FIG. 6 explained later). Then, the temperature control section 42 controls, based on the temperature detection results, whether to turn on or off electricity to the heating member 32 and the heater lamp 36 so that each of surface temperatures of the fixing belt 33 and the pressure roller 34 comes closer to a predetermined temperature. Note that in the present embodiment, a non-contact thermistor is used as the thermistor 35*a* and contact thermistors are used as the thermistors 35*b* and 35*c*.

The fixing roller 31 presses against the pressure roller 34 via the fixing belt 33, thereby forming the fixing nip area N. The fixing roller 31 is driven to rotate in a direction shown by an arrow in FIG. 3, by rotation drive means made of, for example, a motor, a gear, an actuator, a conduction element, and the like (each of which are not shown). Then, when the fixing roller 31 is driven to rotate, the fixing belt 33 provided over this fixing roller 31 rotates so as to follow the fixing roller 31. Further, the pressure roller 34 pressing against the fixing belt 33 is also rotated so as to follow the fixing belt 33. Note that in the present embodiment, the fixing belt 31 is driven to rotate, and subsequently the fixing belt 33 and the pressure roller 34 are driven to rotate so as to follow the fixing roller 31. However, the present invention is not limited to this. For example, it may be arranged such that: the pressure roller 34 is driven to rotate; or both the fixing roller 31 and the pressure roller 34 are driven to rotate. Alternatively, a drive roller may be provided so as to abut on the fixing belt 33 and this drive roller may be driven to rotate.

In the present embodiment, the fixing roller 31 employed is a 2-layer structure roller having an elastic layer 31*b* formed around a columnar core metal 31*a*. A material of the core metal 31*a* is not specifically limited, and may be, for example, metal such as iron, stainless steel, aluminum, copper, titanium or magnesium, or an alloy thereof. A material of the elastic layer 31*b* is not specifically limited as long as the material has sufficient heat resistance and elasticity. An example of such a material of the elastic layer 31*b* is rubber material such as silicone rubber and fluorine rubber. Further, the core metal 31*a* is not limited to a solid columnar core metal but may be a hollow cylinder core metal. Note that the fixing roller 31 in the present embodiment is a columnar roller member whose diameter is 28 mm and whose length is 320 mm which columnar roller member is obtained by forming the elastic layer 31*b* made of a silicone sponge rubber having a thickness of 5 mm around the core metal 31*a* made of columnar stainless steel having a diameter of 18 mm.

Further, in the present embodiment, the pressure roller 34 is a three-layer structure roller including a cylindrical core metal 34*a*, an elastic layer 34*b*, and a release layer 34*c* formed in this order from an inner side. A material of the core metal 34*a* is not specifically limited as long as the material has sufficient strength and thermal conductivity. Such a material of the core metal 34*a* may be, for example, metal such as iron, stainless steel, aluminum, copper, titanium or magnesium, or an alloy thereof. A material of the elastic layer 34*b* is not specifically limited as long as the material has sufficient heat resistance and elasticity. An example of such a material of the elastic layer 34*b* is rubber material such as silicone rubber and fluorine rubber. Further, a material of the release layer 34 may be any material that is excellent in heat resistance and releasability. As such a material, for example, fluorine resin such as PFA (tetrafluoroethylene/perfluoroalkylvinylether copolymers) and PTFE (polytetrafluoroethylene) are suitable. Note that in the present embodiment, as the pressure roller 34, a cylindrical roller member having an outer diameter of 30 mm is used. This roller member is obtained by forming the elastic layer 34*b* made of silicone solid rubber having a thickness of 3 mm around the core metal 34*a* made of an iron alloy (STKM) having a diameter of 24 mm and a wall thickness of 2 mm and further providing the release layer 34*c* made of PFA tube having a thickness of 30 μm around the elastic layer 34*b*.

Inside the pressure roller 34, the heater lamp 36 is provided. This heater lamp 34 is for heating the pressure roller 34 from an inner surface of the pressure roller 34. Note that the heater lamp 36 is operated by the temperature control section 42. More specifically, heat source drive means 45 controls power to be supplied (power supply) to the heater lamp 36 from a power supply circuit 43, in accordance with a control signal outputted form the temperature control section 42. As a result, the heater lamp 36 emits light in accordance with the power supplied and infrared ray is emitted from the heater lamp 36. Note that the heat source drive means 45 may be made of a drive element capable of handling a high voltage and a high current. Examples of such a heat source drive means 45 are a solid state relay (SSR), a triac, a thyristor, a mechanical relay (also simply called a relay), and an FET (Field Effect Transistor). As a result, an inner peripheral surface of the pressure roller 34 absorbs the infrared ray and is heated. Consequently, the whole pressure roller 34 is heated. In the present embodiment, a rated power of the heater lamp 36 is 300 W. Note that for making it easy to absorb the infrared lay emitted from the heater lamp 36, a heat-resistant black coating that has a preferable absorbing property in an wavelength range of the infrared ray may be applied to the inner surface of the pressure roller 34.

The fixing belt 33 is heated to a predetermined temperature by the heat generated by the heating member 32 and then heats recording material P which passes through the fixing nip area N and on which an unfixed toner image is formed.

The fixing belt 33 is rotatably provided in a tensioned state over the fixing roller 31 and the heating member 32. As a result, when the fixing roller 31 is driven to rotate, the fixing belt 33 is rotated so as to follow the fixing roller 31.

In the present embodiment, the fixing belt 33 is an endless belt member having a three-layer structure. This belt member is obtained by first forming an elastic layer (not shown) on a surface of a hollow cylinder base (not shown) and then forming a release layer (not shown) on a surface of the elastic layer. A material of the base is not specifically limited but may be, for example, heat resistant resin such as polyimide, polyamide, and aramid resin or metal material fabricated by rolling or electroforming stainless steel, nickel, or the like. Further, a material of the elastic layer is also not specifically limited as long as the material is excellent in heat resistance and elasticity. The elastic layer may be made of, for example, an elastomeric material such as silicone rubber and fluorine rubber. Furthermore, a material of the release layer is not specifically limited as long as the material is excellent in heat resistance and releasability. The release layer may be made of, for example, fluorine resin such as PFA and PTFE. The release layer may also be obtained by providing a tube member made of fluorine resin such as PFA and PTE onto an outer peripheral surface of the elastic layer or by coating (covering) the outer peripheral surface of the elastic layer by fluorine resin such as PTA and PTFE. In addition, in a case where heat-resistant resin such as polyimide is used as a base, fluorine resin may be added into the heat-resistant resin. This is for reducing frictional resistance to the heating member 32.

In the present embodiment, the endless belt member employed has an inner diameter (a value obtained by dividing an inner peripheral length by a circle ratio $\pi$) of 50 mm and a length of 315 mm. This endless belt is obtained by forming an elastic layer made of silicone rubber having a thickness of 150 μm on an outer peripheral surface of a base made of polyimide having a thickness of 70 μm and further providing a release layer made of a PFA tube having a thickness of 30 μM on an outer periphery surface of the elastic layer. As a result, an abutting angle $\theta$ at which the fixing belt 33 abuts on the fixing roller is at an angle of 185°. This abutting angle means an angle between (i) a line, on a cross sectional surface perpendicular to an axis direction of the fixing roller 31, connecting a center of an axis of the fixing roller 31 and a point where the fixing belt 33 starts to abut on the fixing roller 31 in rotation of the fixing belt 33 and (ii) a line, in the cross sectional surface perpendicular to the axis direction of the fixing roller 31, connecting the center of the axis of the fixing roller 31 and a point where the fixing belt 33 separates from the fixing roller 31 in the rotation.

Figure 4:
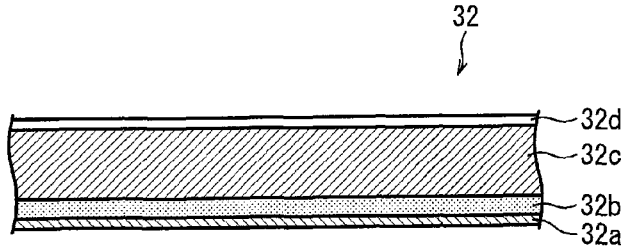
FIG. 4

The heating member 32 heats the fixing belt 33 as well as supporting, with the fixing roller 31, the fixing belt 33. FIG. 4 is a cross sectional view of the heating member 32. As shown in FIGS. 3 and 4, in the present embodiment, the heating member 32 is a planar heat generating body having a 4-layer structure. The planar heat generating body is obtained by forming, in a region where the heating member 32 abuts on the fixing belt 33, a resistive heat generating layer (planar heat generating body) 32*a*, an insulating layer 32*b*, a base layer 32*c*, and a coat layer 32*d* in this order from an inner side of the heating member 32. The coat layer 32*d* is for reducing frictional resistance between the heating member 32 and the fixing belt 33.

More specifically, in the present embodiment, the base layer 32*c* is made of a material obtained by cutting a part of an aluminum alloy pipe having an outer diameter of 28 mm and a thickness of 1 mm, along an axis of the aluminum alloy pipe. Then, on an outer peripheral surface of the base layer 32*c*, the coat layer 32*d* is formed. This coat layer 32*d* is made of PTFE (polytetrafluoroethylen resin) having a thickness of 20 μm. Further, the insulating layer 32*b* made of polyimide having a thickness of 30 μm is formed on an inner peripheral surface of the base layer 32*c*. In addition, the resistive heat generating layer 32*a* is provided on an inner peripheral surface of the insulating layer 32*b*. A resultant heating nip width is 44 mm. This heating nip width means a width of a contact area between the fixing belt 33 and the heating member 32 (the width is in a direction of rotation of the fixing belt 33).

Note that to regions where the heating member 32 does not abut on the fixing belt 33 at both ends of the heating member 32 in an axis direction of the heating member 32, supporting sections made of aluminum alloy pipe having a diameter of 20 mm are respectively attached. These supporting members are fixed to side frames of the fixing device 30. As a result, even when the fixing belt 33 rotates, the heating member 32 does not rotate and the fixing belt 33 slides on a surface of the heating member 32.

Figure 5:
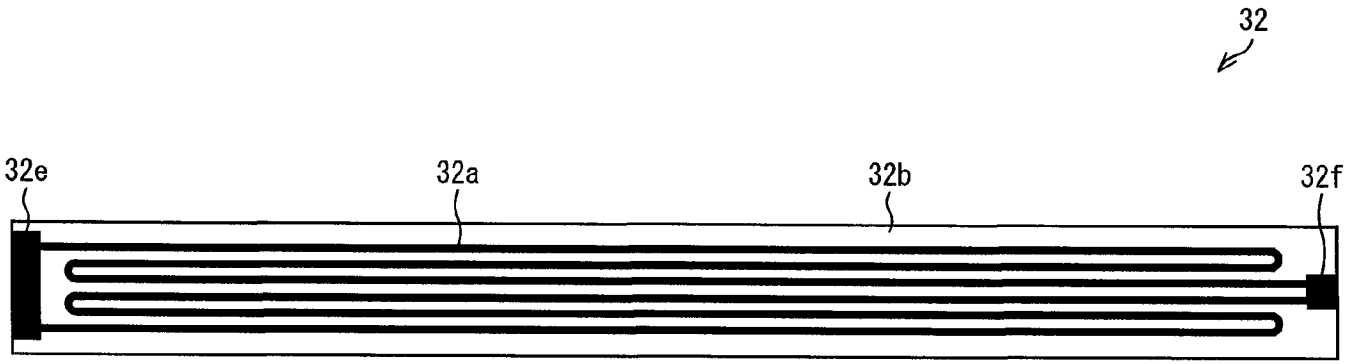
FIG. 5

FIG. 5 is a plan view obtained when the heating member 32 is viewed from an inner peripheral surface of the heating member 32. Note that the heating member 32 is curved in a circular arc as shown in FIG. 3. However, for convenience of explanation, in FIG. 5, the heating member 32 is flattened so as to be a flat plate.

As shown in FIG. 5, the resistive heat generating layer 32*a* is a planar heat generating body where a plurality of electric resistance lines are provided in a plane. The plurality of electric resistance lines run in a periphery direction (arc direction) of the heating member 32, and turn back at end sections of the heating member 32 in the periphery direction. One end of each of the plurality of electric resistance lines is connected to a power supply section 32*e* and the other end is connected to another power supply section 32*f*. Note that an electric resistance between the power supply lines 32*e* and 32*f* is 10Ω and thermal energy of approximately 1000 W is generated. This thermal energy is generated by supplying power from the power supply circuit 43 under control performed by the temperature control section 42 on an operation of the heat source drive means 45 and applying an alternating voltage of 100V to the power supply sections 32*e* and 32*f*.

In the present embodiment, a line width of each electric resistance line is arranged to be 2.4 mm and an interval between adjacent electric resistance lines (adjacent portions of one electric resistance line folded, inclusive) is arranged to be 2.4 mm. Further, a length of a portion of each electric resistor line which portion is running in the periphery direction of the heating member 32 (a length from a position where the electric resistance line is turned back at one end in the periphery direction of the heating member 32 to a position where the electric resistance line is turned back at the other end of the heating member) is arranged to be 320 mm; the number of the electric resistance lines are arranged to be 6; and the number of times each electric resistance line is turned back is 2 times. Note that, for convenience of explanation, FIG. 5 shows an example in a case where the number of the electric resistance lines is two.

The heat generated in the resistive heat generating layer 32*a* of the heating member 32 is transmitted to the fixing belt 33 via the insulating layer 32*b*, the base layer 32*c*, and the coat layer 32*d*. Further, in the present embodiment, the base layer 32*c* is made of aluminum alloy having a high thermal conductivity. Accordingly, the heat generated by each electric resistance line of the resistive heat generating layer 32*a* can be distributed all over a periphery surface of the heating member 32 by the base layer 32*c*. This reduces the occurrence of uneven heating of the fixing belt 33 due to a patterned form of each electric resistance line. In a case of sheets of small size recording material, a width of contact between each sheet of small size recording material and the fixing belt 33 in the axis direction of the fixing belt 33 is smaller than a width of contact between the fixing belt 33 and the heating member 32 in the axis direction of the fixing belt 33. Even in a case where sheets of such small recording material are successively fed, temperature distribution in the axis direction of the heating member 32 can be made uniform and it becomes possible to prevent an excessive temperature rise in the no-paper passing areas.

Figure 6:
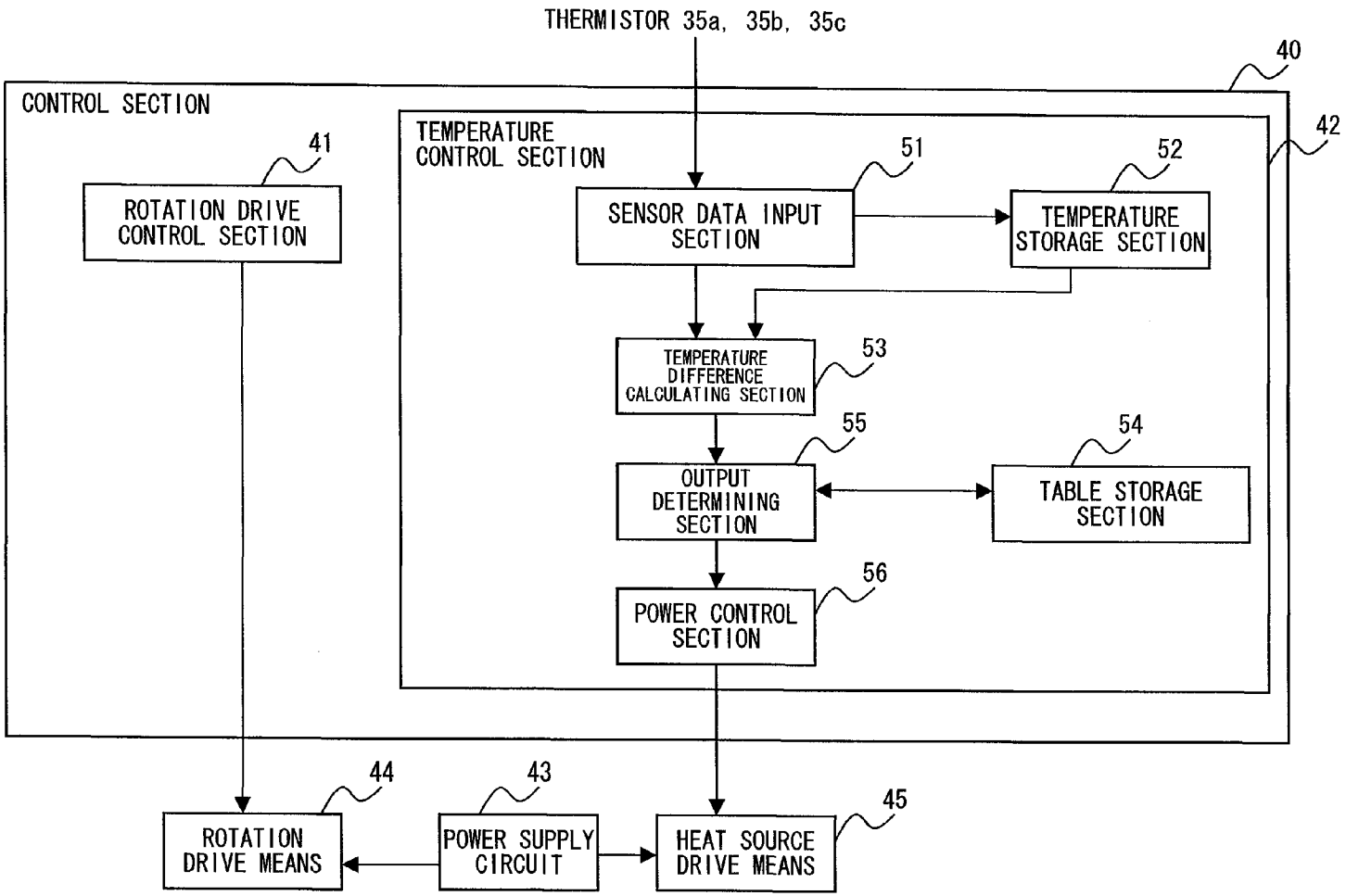
FIG. 6

Next, the following explains processing in a fixing process in the fixing device 30. FIG. 6 is a block diagram briefly illustrating a configuration of the control section 40 for controlling an operation of each section of the fixing device 30.

As shown in FIG. 6, the control section 40 includes a drive control section 41 and a temperature control section 42. Note that the control section 40 may be provided in a main control section of the image forming apparatus 100 or alternatively the control section 40 may be provided separately from the main control section so as to control an operation of the fixing device 30 in cooperation with the main control section. Further, the control section 40 includes a RAM (not shown) for temporarily storing various data. Each section provided in the control section 40 temporarily stores, according to need data, handled in the each section into the RAM, or reads out, according to need, data to be handled from the RAM.

The drive control section 41 controls an operation of rotation drive means 44 for driving the fixing roller 31. The drive control section 41 controls the rotation drive means 44 of the fixing roller 31 so that the fixing roller 31 is driven to rotate or stops rotating at a predetermined timing in accordance with (i) a control command from the main control section of the image forming apparatus 100 and/or temperature detection results of the thermistors 35*a*, 35*b* and 35*c*. The main control section transmits, to the drive control section 41, signals for controlling rotation of the fixing roller 31, in accordance with a user's input of instructions, a placement state of sheets of recording material, a carrying state of sheets of recording material, a result of detection of size of a sheet of recording material, an operation state of each section of the image forming apparatus 100, an image formation mode (e.g., a color mode or a monochrome mode) of the image forming apparatus 100, or detection results of various sensors provided in the image forming apparatus 100. The various sensors above includes, for example, a sensor for optically or mechanically detecting a position where recording material passes, a sensor for detecting a mechanical state of a motor or a movable section, a sensor for detecting a state in which a cover or a cleaning member is attached, and a sensor for detecting a pressure state of the pressure roller 34.

The temperature control section 42 outputs, to the heat source drive means 45, a control signal for controlling an amount of power (an amount of power to be supplied) to the resistive heat generating layer 32*a* provided in the heating member 32 and to the heater lamp 36 provided inside the pressure roller 34. The temperature control section 42 outputs the control signal in accordance with temperature detection results of the thermistors 35*a*, 35*b* and 35*c*, or the like. Thereby, the temperature control section 42 controls respective surface temperatures of the fixing belt 33 and the pressure roller 34.

As shown in FIG. 6, the temperature control section 42 includes a sensor data input section 51, a temperature storage section 52, a temperature difference calculating section 53, a table storage section 54, an output determining section 55, and a power control section 56.

The sensor data input section 51 detects a temperature change as a change in resistance value, based on an output signal from each of the thermistors 35*a* to 35*c*. Then, the sensor data input section 51 converts the change in resistance value to a change in voltage value and further converts this change in voltage value to a digital signal that can be processed in a computer. Then, the sensor data input section 51 outputs the signal indicative of the temperature detection result to the temperature storage section 52 and the temperature difference calculating section 53. Note that the thermistors 35*a* to 35*c* have a negative temperature coefficient. Accordingly, a resistance value of each of the thermistors 35*a* to 35*c* becomes lower when a temperature increases; meanwhile, a resistance value of each of the thermistors 35*a* to 35*c* increases when the temperature lowers.

The temperature storage section 52 stores the temperature detection results of a predetermined past period which temperature detection results are obtained by the thermistors 35*a* to 35*c*. The predetermined past period may be set to be an integral multiple of a temperature control cycle of the heating member 32 and the heater lamp 36 (a control cycle of the amount of power to each of the heating member 32 and the heater lamp 36). More specifically, in the present embodiment, the predetermined past period is set to be a period of last one second or last two seconds.

The temperature difference calculating section 53 calculates a first temperature difference and a second temperature difference. The first temperature difference is a difference between (a) a first detected temperature that is a temperature currently detected by the thermistor 35*a* and (b) a predetermined target temperature (control target temperature) of the fixing belt 33; the second temperature difference is a difference between (a) the first detected temperature and (b) a second detected temperature that is a temperature detected by the thermistor 35*a* at a time a predetermined period (e.g., one second or two seconds) earlier than the current time. Then, the temperature difference calculating section 53 outputs the first temperature difference and the second temperature difference to the output determining section 55. Note that the temperature difference calculating section 53 reads out the second detected temperature from the temperature storage section 52. The temperature difference calculating section 53 may also read out the first detected temperature from the temperature storage section 52 or alternatively, the first detected temperature may be inputted into the temperature difference calculating section 53 from the sensor data input section 51.

Similarly, regarding the temperature detection result obtained by the thermistor 35*c*, the temperature difference calculating section 53 calculates a third temperature difference and a fourth temperature difference. The third temperature difference is a difference between (a) a third detected temperature that is a temperature currently detected by the thermistor 35*c* and (b) a predetermined target temperature (control target temperature) of the pressure roller 34; the fourth temperature difference is a difference between (a) the third detected temperature and (b) a fourth detected temperature that is a temperature detected by the thermistor 35*c* at a time a predetermined period (e.g., one second or two seconds) earlier than the current time. Then, the temperature difference calculating section 53 outputs the third temperature difference and the fourth temperature difference to the output determining section 55

The table storage section 54 stores a first output setting table (an output direct setting table, a table for a center section, a center section table) and a second output setting table (a table for the pressure member, a pressure member table). In the first output setting table, a combination of the first temperature difference and the second temperature difference is associated with an amount of power to be supplied to the heating member 32. In the second output setting table, a combination of the third temperature difference and the fourth temperature difference is associated with an amount of power to be supplied to the heater lamp 36.

The output determining section 55 reads out, from the first output setting table stored in the table storage section 54, an amount of power in accordance with the first temperature difference and the second temperature difference which are inputted from the temperature difference calculating section 53. Then, the output determining section 55 determines the amount of power to the heating member 32 and transmits this amount of power to the power control section 56. Further, the output determining section 55 reads out, from the second output setting table stored in the table storage section 54, an amount of power in accordance with the third temperature difference and the fourth temperature difference which are inputted from the temperature difference calculating section 53. Then, the output determining section 55 determines the amount of power to the heater lamp 36 and transmits this amount of power to the power control section 56.

Note that an amount of power read out from the first output setting table may be corrected in accordance with a difference between the temperature detection result obtained by the thermistor 35*b* (a temperature in the vicinity of an end in the width direction of the fixing belt 33) and the temperature detection result obtained by the thermistor 35*a* (a temperature at a center section in the width direction of the fixing belt 33). For example, the amount of power read out may be corrected so that a temperature in a region where paper passes approaches a target temperature, in consideration of an amount of heat conducted to a center section in the width direction of the fixing belt 33 (a region, abutting on recording material, where paper passes) from an end section in the width direction of the fixing belt 33 (a region, abutting on no recording material, where no paper passes) and in accordance with the difference above. Alternatively, the output determining section 55 may correct the amount of power which is read out from the first output setting table in accordance with a difference between the temperature detected by the thermistor 35*b* at a time a predetermined time (e.g., 1 second or 2 seconds) earlier than a current time and a temperature currently detected by the thermistor 35*b*, after the temperature difference calculating section 53 calculates the difference.

The power control section 56 outputs, to the heat source drive means 45, a control signal for controlling the amount of power to be supplied to the heating member 32 from the power supply circuit 43. This control signal is outputted in accordance with the amount of power which is transmitted from the output determining section 55.

Figure 1:
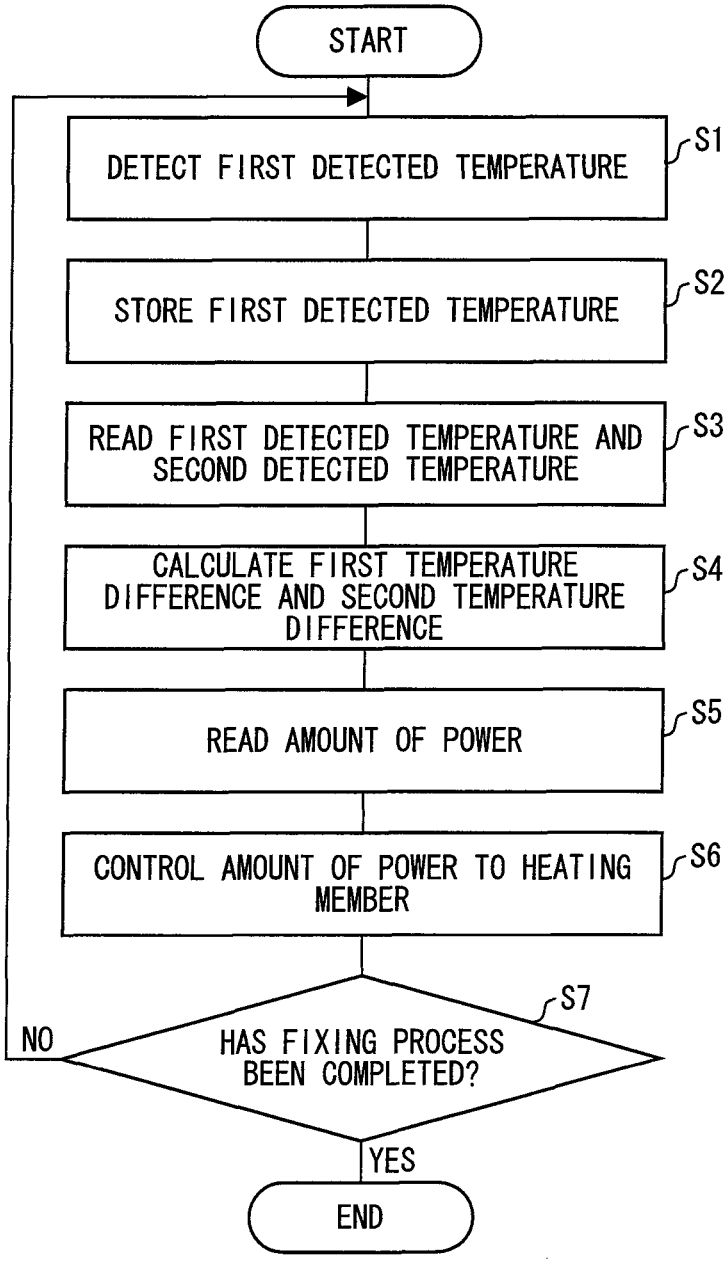
FIG. 1

FIG. 1 is a flowchart illustrating a flow of a temperature control process of the heating member 32 in the temperature control section 42.

First, the sensor data input section 51 receives a detection signal from the thermistor 35*a*, and detects (computes) the first detected temperature based on this detection signal (S1). Then, the sensor data input section 51 causes the temperature storage section 52 to store the first detected temperature that is detected (S2).

Then, the temperature difference calculating section 53 reads out the first detected temperature and the second detected temperature from the temperature storage section 52 (S3). Further, the temperature difference calculating section 53 calculates the first temperature difference and the second temperature difference based on the respective detected temperatures (S4), and outputs the first temperature difference and the second temperature difference to the output determining section 55.

Subsequently, the output determining section 55 reads out, from the first output setting table stored in the table storage section 54, an amount of power corresponding to a combination of the first temperature difference and the second temperature difference which are calculated by the temperature difference calculating section 53 (S5). Then, the output determining section 55 outputs the amount of power to the power control section 56.

FIG. 7 is a table showing an example of the first output setting table. In the example of this table, a reference amount of power (a reference power amount, a reference amount of power to be supplied) to the heating member 32 is preset. In the first setting table, a relative value with respect to a maximum value of an amount of power (rated power, a maximum amount of suppliable power) that is suppliable to the heating member 32 is stored so as to correspond to each combination of the first temperature difference and the second temperature difference. Then, an amount of power obtained by adding (a) an amount of power read out from the first output setting table to (b) the reference amount of power is set as the amount of power to the heating member 32.

For example, in a case where: (i) the target temperature is set at 165° C.; a detected temperature of the thermistor 35*a* (first detected temperature) is at 164° C.; and a detected temperature (second detected temperature) detected by the thermistor 35*a* at a time one second earlier than the current time is at 169° C., the first temperature difference and the second temperature difference are expressed as follows:

First Temperature Difference=First Detected Temperature−Target Temperature=164−165=−1° C.

Second Temperature Difference=First Detected Temperature−Second Detected Temperature=164−169=−5° C.

Accordingly, in this case, the amount of power to the heating member 32 is set at a value obtained by adding 50% of a maximum amount of suppliable power (rated power) to the reference amount of power, according to the first output setting table shown in FIG. 7. For example in a case where the reference amount of power is set at 50% of the maximum amount of suppliable power, the amount of power to the heating member 32 is set at 100%=50%+50%.

Further, in a case where: (i) the target temperature is set at 165° C.; a detected temperature of the thermistor 35*a* (first detected temperature) is 163° C.; and a detected temperature (second detected temperature) detected by the thermistor 35*a* at a time one second earlier than the current time is 163° C., the first temperature difference and the second temperature difference are expressed as follows:

First Temperature Difference=First Detected Temperature−Target Temperature=163−165=−2° C.

Second Temperature Difference=First Detected Temperature−Second Detected Temperature=163−163=0° C.

Accordingly, in this case, the amount of power to the heating member 32 is set at a value obtained by adding 13% of the maximum amount of suppliable power to the reference amount of power, according to the first output setting table shown in FIG. 7. For example in a case where the reference amount of power is set at 50% of the maximum amount of suppliable power, the amount of power to the heating member 32 is set at 63%=50%+13%.

Then, the power control section 56 controls an operation of the heat source drive means 45 in accordance with the amount of power which amount is determined by the output determining section 55. Thereby, the power control section 56 controls the amount of power to the heating member 32 from the power supply circuit 43 (S6).

Figure 8:
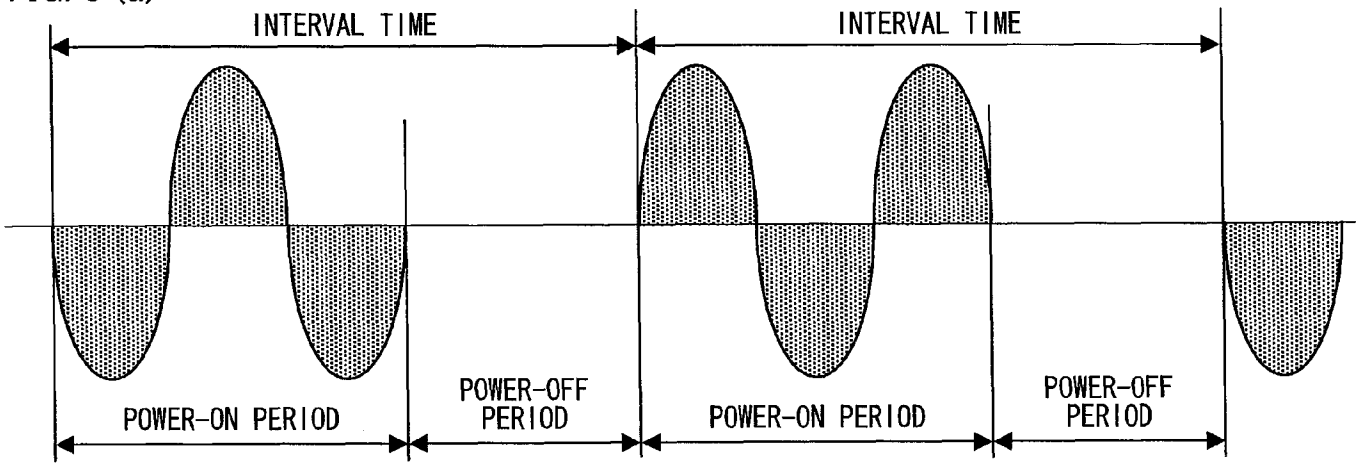
FIG. 8(*a*)
Figure 8:
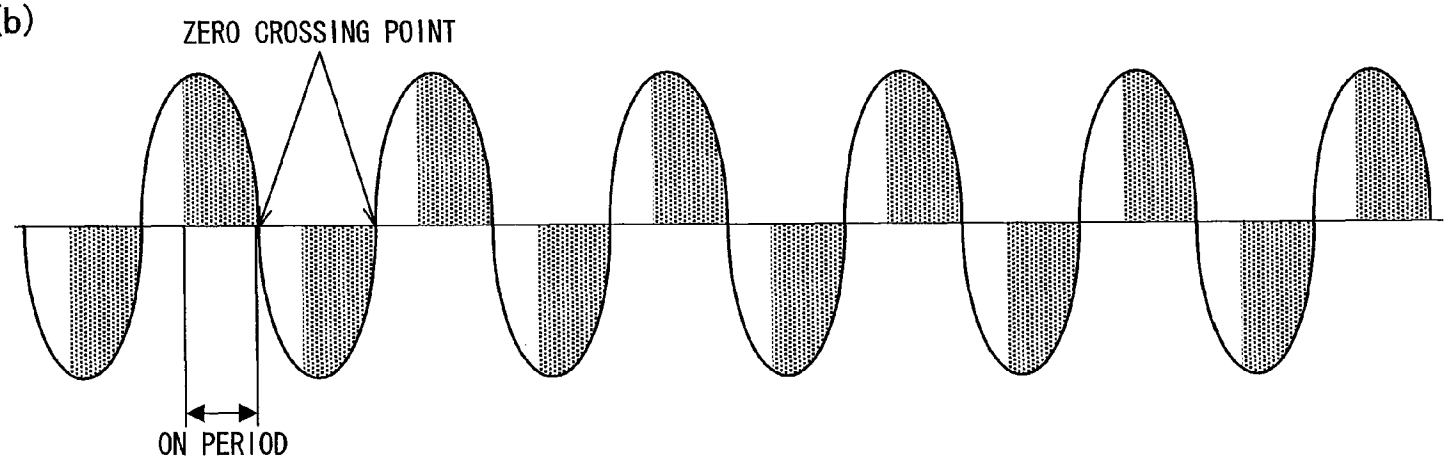

FIG. 8(*a*) is an explanatory diagram illustrating a control method (control waveform) of the amount of power to the heating member 32 which control method is implemented by the power control section 56. As shown in FIG. 8(*a*), the power control section 56 determines ratios (duty ratio) of ON period and OFF period of power supply to the heating member 32, based on the amount of power which amount is determined by the output determining section 55, and controls on/off of power supply to the heating member 32 according to a duty control method. For example, in a case where the amount of power to be supplied is set at the maximum amount of suppliable power, the electricity is turned on for all the time of an interval time (control cycle). Meanwhile, in a case where the amount of power to be supplied is set at 63% of the maximum amount of suppliable power, the power control section 56 turns on the electricity for a time corresponding to 63% of an interval time and turns off the electricity for a time corresponding to the remaining 37% of the interval time. Note that in the present embodiment, as the heating member 32, a resistive heat generating body (resistive heat generating layer 32*a*) is used. This makes it possible to prevent a flicker that may cause flickering. This is because such a resistive heat generating body has less inrush current caused by repeating turning on/off the electricity, as compared to a halogen lamp that is frequently used as heating means in fixing devices.

Note that the control method of the amount of power to the heating member 32 is not limited to the duty control as described above. For example, as shown in FIG. 8(*b*), it is also possible to employ a phase control method for controlling a phase of an AC supply voltage to be supplied to the heating member 32 via the heat source drive mean 45 from the power supply circuit 43. In this phase control method, a time in which the electricity is turned on is defined every half a wavelength of the alternate voltage so that power control is implemented by controlling a phase angle of an on-period, in accordance with the time in which the electricity is turned on for each half a wavelength of the alternate voltage. In the phase control method, the power control can be performed by suppressing inrush current into an inductive heat generation body such as a halogen lamp. In other words, by frequently turning on/off the electricity to an inductive heat generation body such as a halogen lamp, a change in current due to inductive load becomes greater. This induces a large change in the AC supply voltage. Therefore, in a case where such an inductive heat generation body is used, such phase control is preferably used for the power control.

Alternatively, the amount of power to be supplied to the heating member 32 may be controlled by a combination of the duty control and the phase control. In this case, for example, in accordance with the amount of power to be supplied which amount is determined by the output determining section 55, whether to perform the duty control or the phase control may be selected as appropriate in accordance with preset conditions. As another alternative, for example, in a configuration where pulse drive is performed by converting an AC voltage to a DC voltage with use of an inverter, an amplitude of the AC voltage may be controlled in accordance with the amount of power which amount is determined by the output determining section 55. As still another alternative, it is also possible to control an amount of power to be supplied by controlling a pulse width or the number of pulses of a DC voltage.

Subsequently, the temperature control section 42 determines whether or not to end the fixing process (S7). If the fixing process is not to be ended, the steps from S1 are repeated.

Note that though the temperature control process of the heating member 32 is explained in the example of FIG. 1, the temperature control section 42 applies the same method to temperature control of the heater lamp 36. That is, the sensor data input section 51 accepts a detection signal from the thermistor 35*c* and detects the third detected temperature. Then, the sensor data input section 51 stores the third detected temperature into the temperature storage section 52. Further, the temperature difference calculating section 53 reads out, from the temperature storage section 52, the third detected temperature and the fourth detected temperature. Based on these detected temperatures, the temperature difference calculating section 53 calculates the third temperature difference and the fourth temperature difference. Subsequently, the output determining section 55 reads out, from the second output setting table stored in the table storage section 54, an amount of power which amount corresponds to a combination of the third temperature difference and the fourth temperature difference. Finally, the power control section 56 controls an operation of the heat source drive control means 45 in accordance with the amount of power read out, and thereby controls the amount of power to be supplied to the heater lamp 36 from the power supply circuit 43.

FIG. 9(*a*) is a graph showing respective temperature detection results of the thermistors 35*a* to 35*c* in a case (Comparative Example 1) where temperature control on a fixing belt and a pressure roller was performed based on only respective current temperature detection results of the fixing belt and the pressure roller. FIG. 9(*b*) is a graph illustrating respective temperature detection results of the thermistors 35*a* to 35*c* in a case (Example 1) where the temperature control of the fixing belt and the pressure roller was performed according to the control method of the present embodiment. Note that in both of the comparative example and the present embodiment, warming up was started from a room temperature (25° C.) and image formation was performed onto A4 size sheets of recording material at a process speed of 140 mm/s and a copying speed of 25 sheets/min after completion of the warming up. Further, the amount of power to each of the heating member 32 and the heater lamp 36 was controlled based on an average value of amounts (two calculated values) of power which average value was calculated every 510 ms in an interval time. This calculation was on an assumption that: a calculation cycle (control cycle) of the amount of power to each of the heating member 32 and the heater lamp 36 was 510 ms; and an interval time was 1020 ms.

As shown in FIG. 9(*a*), in Comparative Example 1, a large temperature ripple occurred. In this temperature ripple, the temperature of the fixing belt 33 dropped by approximately 20° C. within approximately 5 seconds right after the completion of warming up and at start of fixing. If a fixing process were carried out in such a state, a melting state of toner at a high temperature would be different from a melting state of toner at a low temperature. This would cause difference in gloss in an image after a fixing operation and consequently image quality would deteriorate.

On the other hand, by using the temperature control method according to the present embodiment, the temperature ripple can be greatly reduced as shown in FIG. 9(*b*) and it becomes possible to prevent deterioration in image quality due to the temperature ripple.

As described above, in the fixing device 30 of the present embodiment, amounts of power to be supplied to the heating member 32 are preset so that each amount of power corresponds to a combination of a first temperature difference and a second temperature difference. Here, the first temperature difference is a difference between (a) a first detected temperature that is a current temperature detection result of the fixing belt 33 and (b) a target temperature of the fixing belt 33; the second temperature difference is a difference between (a) the first detected temperature and (b) a second detected temperature that is a temperature detection result of the fixing belt 33 which temperature detection result was obtained at a time a predetermined time (e.g., one second) earlier than the current time. Then, an amount of power to be supplied to the heating member 32 is controlled in accordance with a combination of the first temperature difference and the second temperature difference which are calculated based on the temperature detection results of the fixing belt 33. Further, amounts of power to be supplied to the heater lamp 36 are preset so that each amount corresponds to a combination of a third temperature difference and a fourth temperature difference. The third temperature difference is a difference between (a) a third detected temperature that is a current temperature detection result of the pressure roller 34 and (b) a target temperature of the pressure roller 34; the fourth temperature difference is a difference between (a) the third detected temperature and (b) a fourth detected temperature that is a temperature detection result of the pressure roller 34 which temperature detection result was obtained at a time a predetermined time (e.g., one second) earlier than the current time. Then, an amount of power to be supplied to the heater lamp 32 is controlled in accordance with a combination of the third temperature difference and the fourth temperature difference which are calculated based on the temperature detection results of the pressure roller 34.

This makes it possible to effectively suppress the temperature ripple of the fixing belt 33 and the pressure roller 34 in a simple configuration. Accordingly, it becomes possible to prevent a problem such as image quality deterioration or winding of recording material which are caused by an excessive heating or an insufficient amount of heat. Further, excessive heating of the fixing belt 33 and the pressure roller 34 can be prevented. Accordingly, an unnecessary energy consumption can be eliminated, which makes it possible to save energy.

Note that though the example of FIG. 7 explains a case where an amount of power is read out from the first output setting table and added to the reference amount of power, the present embodiment is not limited to this. It is also possible to store values each directly indicating an amount of power to be supplied to the heating member 32 which amount corresponds to a combination of the first temperature difference and the second temperature difference. FIG. 10 shows an example of the first output setting table in which values each indicating a ratio of an amount of power to be supplied to the heating member 32 with respect to the maximum amount (rated power) of power that is suppliable to the heating member 32 is stored as amounts of power each corresponding to a combination of the first temperature difference and the second temperature difference. For example, in a case where the first temperature difference $\Delta T1$ is −1° C. and the second temperature difference $\Delta T2$ is −5° C., the amount of power to be supplied to the heating member 32 is set at 100% of the rated power. Meanwhile, in a case where the first temperature difference $\Delta T1$ is −2° C. and the second temperature difference $\Delta T2$ is 0° C., the power to be supplied to the heating member 32 is set at 63% of the rated power.

Moreover, it is also possible to use a first output setting table in which each combination of the first temperature difference and the second temperature difference is associated with a value indicative of a level of a change from a current amount of power currently supplied to the heating member 32. For example, it is possible to store, in the first output setting table, an amount of power to be added to or subtracted from the current amount of power currently supplied to the heating member 32.

Further, the output determining section 55 may be arranged to correct an amount of power read out from the first output setting table, in accordance with an environmental temperature, an environmental humidity, a size of a sheet of recording material, a weight of a sheet of recording material, operation conditions of the fixing device 30 or the image forming apparatus 100, or the like.

For example, because a temperature of a sheet of recording material to be subjected to fixing is different depending on an environmental temperature, an amount of heat to be provided by the fixing device 30 is also different. Accordingly, it is possible to correct an amount of power read out from the first output setting table, in accordance with the environmental temperature. For example, in a case where the environmental temperature is in a range of 13° C. or more and less than 18° C. (an environment at 15° C.), 3% of the reference amount of power may be added to an amount of power read out from the first output setting table; in a case where the environmental temperature is in a range of 8° C. or more and less than 13° C. (an environment at 10° C.), 5% of the reference amount of power may be added to an amount of power read out from the first output setting table; in a case where the environmental temperature is less than 8° C. (an environment at 5° C.), 10% of the reference amount of power to be supplied may be added to an amount of power read out from the first output setting table; in a case where the environmental temperature is 30° C. or more (a high temperature environment), 5% of the reference amount of power may be subtracted from an amount of power read out from the first output setting table; and in a case where the environmental temperature is in a range of 18° C. or more and less than 30° C. (an environment at a normal temperature), the amount of power read out from the first output setting table can be directly used.

The present invention is not limited to a configuration in which an amount of power read out from the first setting table is corrected. Alternatively, it is also possible to correct the reference amount of power, in accordance with an environmental temperature, an environmental humidity, a size of a sheet of recording material, a weight of a sheet of recording material, operation conditions of the fixing device 30 or the image forming apparatus 100, or the like. Note that correction values or correction parameters that are used in the correction may be, for example, stored in the table storage section 54 together with the first output setting table or in other storage means.

For example, the reference amount of power at a normal temperature may be set at 50% of the maximum value (rated power) of an amount of power that can be outputted. Then, in the environment at 10° C., the reference amount of power may be corrected so that the reference amount becomes 60% of the maximum value (rated power) and an output is increased by 10% as a whole. Meanwhile, in the high-temperature environment, extra heating is not necessary. Therefore, for preventing excessive heating, the reference amount of power may be corrected so that the reference amount of power is changed to 30% of the maximum value and the output is decreased by 20% as a whole Further, the present embodiment is not limited to the configuration in which the amount of power is corrected in accordance with the environmental temperature. The amount of power may be corrected in accordance with a relative humidity. For example, in a case where the relative humidity is 65% or more, the amount of power to be supplied may be corrected so as to increase by 10%. Meanwhile, in a case where the relative humidity is less than 30%, the amount of power to be supplied may be corrected so as to decrease by 20%.

Alternatively, in accordance with a size and a weight of a sheet of recording material, the amount of power to be supplied may be changed. That is, the amount of power may be increased in a case where the recording material is thick and heavy; whereas, the amount of power to be supplied may be decreased in a case where the recording material is thin and light. For example, in a case where the weight is 90 g/m$^2$ or more, the amount of power to be supplied may be increased by 10%; whereas, in a case where the weight is less than 60 g/m$^2$, the amount of power to be supplied may be decreased by 20%.

Alternatively, the amount of power to be supplied may be corrected in accordance with an operation state of the fixing device 30 (e.g., in warming up, in a standby state before a predetermined time (e.g., 5 minutes) elapses after warming up, in printing, in printing before the elapse of a predetermined time, in a state before the elapse of a predetermined time after the completion of printing, on standby for preheating, in a cooling operation, in recovering, etc.), an operation state of the image forming apparatus 100 (e.g., in warming up, in reading images, in process adjustment, in printing, in preheating, in receiving image data, in recovering, etc.), or a combination of operation states of the fixing device 30 and the image forming apparatus 100. For example, it may be arranged such that: the amount of power to be supplied may be increased by 10% for printing to be executed within 5 minutes after activation of the image forming apparatus 100 whose power has been turned off; for printing after the 5 minutes, the amount of power to be supplied is not corrected. Alternatively, it may be arranged such that: in a case where a temperature inside the image forming apparatus 100 rises by a predetermined value or more or in the case of printing right after execution of continuous printing of a predetermined number of sheets (e.g. 500 sheets) or more sheets, the amount of power to be supplied is decreased by 20% for printing that is to be carried out within a predetermined period (e.g., within 3 minutes); after the predetermined period, the amount of power to be supplied is set back at the original amount of power to be supplied and no correction of the amount of power is performed.

Alternatively, the amount of power obtained from the output setting table may be corrected based on a preset correction value, for example, when an image forming operation (printing operation) is temporarily interrupted for toner supply and/or adjustment of members provided in the image forming apparatus 100 and then an image forming operation is resumed.

In a case where the image forming operation is interrupted, carrying of recording material stops. This may cause a temperature of each of the fixing belt 33 and the pressure roller 34 to be higher than a target temperature due to a heat quantity that is assumed to be absorbed by the recording paper. Accordingly, when the image forming operation is resumed, a defect in an image may occur due to overheating if the temperature is controlled in the same method as a method that had been used before the image forming operation was interrupted. In particular, such a defect tends to occur in a case of a low-heat-capacity fixing device employing a low heat capacity fixing member (member to be heated such as a fixing belt, a thin-wall fixing roller, and the like.

However, as described above, the amount of power obtained from the output setting table is corrected by using a preset correction value in consideration of the interruption of the image forming operation. This makes it possible to appropriately control power to each of the fixing belt 33 and the pressure roller 34. Further, it also becomes possible to prevent overheating and excessive rise of temperature of each of the fixing belt 33 and the pressure roller 34. In addition, by suppressing excessive energy consumption, energy can be saved. Furthermore, even in the case of the low-heat-capacity fixing device, the defect as described above can be appropriately prevented.

Alternatively, output setting tables (output direct setting tables) may be prepared in a plurality of ways for the heating member 32 and the heater lamp 36. Then, depending on an operation state of the fixing device 30, an operation state of the image forming apparatus 100, or a combination of the operation states of the fixing device 30 and the image forming apparatus 100, output setting tables to be used may be switched.

Further, in the present embodiment, the first detected temperature and the second detected temperature are stored in the temperature storage section 52. In addition to the first and second detected temperatures, it is also possible to cause the temperature storage section 52 to store the first temperature difference, the second temperature difference, a setting record of the amount of power to be supplied to the heating member 32, and the like. As a result, these pieces of information can be used for analysis of a trouble, determination and analysis of an abnormal state, and/or the like in a case where a trouble occurs in the fixing device 30.

Further, the present embodiment explains a configuration in which the heating member 32 uniformly heats the fixing belt 33 in the width direction of the fixing belt 33. However, the present invention is not limited to this configuration. For example, it is also possible to provide a heating member (center heating member) for heating a center section of the fixing belt 33 in a width direction of the fixing belt 33 and another heating member (end section heating member) for heating end sections of the fixing belt 33 in the width direction of the fixing belt 33. In this case, for example, a temperature of the center heating member may be controlled in accordance with a combination of a first temperature difference and a second temperature difference based on temperature detection results of the thermistor (center temperature detecting section) 35*a*; meanwhile, temperatures of the end section heating member may be controlled based on a combination of (i) a fifth temperature difference that is a difference between (a) a fifth detected temperature that is a temperature currently detected by the thermistor (end section temperature detecting section) 35*b* and (b) a target temperature; and (ii) a sixth temperature difference that is a difference between (a) the fifth temperature difference and (b) a sixth detected temperature that is a temperature detected by the thermistor 35*b* at a time a predetermined period earlier than the current time. That is, in the table storage section 54, a third output setting table (table for end section, end section table) may be stored. The third output setting table shows amounts of power to be supplied to the heating member of the end sections each of which amounts of power corresponds to each combination of the fifth temperature difference and the sixth temperature difference. Then, by reading out an amount of power from the third output setting table, the amount of power to be supplied may be determined.

Note that the present embodiment explains a case where the present invention applied to a fixing-belt-type fixing device having: a fixing speed (a process speed, a recording material carrying speed) of 225 mm/sec; and a copying speed (number of copies per minute) of 51 sheets/min on assumption that sheets of A4 size are carried so that a length side of each sheet is along a sheet carrying path. However, the present invention is not limited to this. Further, a configuration, a size, control conditions, and/or the like of each member provided in the fixing device 30 are not limited to the examples shown in the present embodiment, but may be modified as appropriate. In addition, the output setting table is not limited to the example described above. The output setting table may be set as appropriate in accordance with, for example, a fixing speed, a copying speed, a fixing system, and/or a configuration, a size, control conditions of each member.

For example, in five types of image forming apparatuses A through E shown in FIG. 23, a temperature ripple can be suppressed as described above by performing a fixing process according to the same control method as the control method of the present embodiment.

The image forming apparatus A is configured by using a fixing device of a conventional roller fixing system (a configuration in which a fixing roller abuts on a pressure roller and recording paper passes a nip area (abutting area) between the fixing roller and the pressure roller). More specifically, in place of the fixing roller 31, the heating member 32, and the fixing belt 33 in the fixing device 30 of FIG. 3, the image forming apparatus A is provided with a fixing roller configured in the same manner as the pressure roller 34 so that the fixing roller abuts on the pressure roller 34. Inside this fixing roller, a heater lamp having the same configuration as the heater lamp 36 is provided. The thermistor 35*a* is provided in a position facing the fixing roller and detects a surface temperature of the fixing roller. The image forming apparatus A has a copying speed of 20 sheets/min, a fixing speed (process speed) of 104 mm/s, and a set temperature (control target temperature) of the fixing roller at 160° C.

Each of the image forming apparatuses B to E employs a fixing device of a belt fixing system which fixing device is configured in the same manner as the fixing device 30 as shown in FIG. 3. However, a copying speed, a fixing speed (process speed), and a set temperature (control target temperature) of each of the image forming apparatuses B to E are set as shown in FIG. 23. That is, the image forming apparatus B has a copying speed of 23 sheets/min, a fixing speed of 104 mm/s, and a set temperature (control target temperature) of 145° C.; the image forming apparatus C has a copying speed of 26 sheets/min, a fixing speed of 140 mm/s, and a set temperature (control target temperature) of 150° C.; the image forming apparatus D has a copying speed of 31 sheets/min, a fixing speed of 140 mm/s, and a set temperature (control target temperature) of 155° C.; and the image forming apparatus E has a copying speed of 36 sheets/min, a fixing speed of 165 mm/s, and a set temperature (control target temperature) of 160° C.

Further, as setting tables used for controlling the image forming apparatuses A to E, a table A shown in FIG. 24 is used for the image forming apparatuses A and B; a table B shown in FIG. 24 is used for the image forming apparatuses C and D; and a table C shown in FIG. 24 is used for the image forming apparatus E. Each table (tables A to C) shows ratios of respective amounts of power to a heater lamp (in the case of the image forming apparatus A) or a heating member 32 (in the case of each of the image forming apparatuses B to E) provided inside the fixing roller with respect to a maximum amount of power (rated power) that is suppliable to the heater lamp or the heating member 32. As shown in FIG. 24, all ratios of the leftmost column are arranged to be 100% (the maximum amount of suppliable power) and all values of the rightmost column are arranged to be 0% (no power supplied). That is, in a case where the first detected temperature is lower to a large extent than the control target temperature, the amount of power is set to the maximum (100%) so that the first detected temperature immediately rises. On the other hand, in a case where the first detected temperature is higher to a large extent than the control target temperature, the amount of power is set to the minimum (0%) so that heating is stopped and excessive temperature rise can be prevented.

Note that a temperature ripple can be suppressed by the same control method as the control method of the present embodiment in an image forming apparatus of a system employing the same fixing system as the fixing system of the image forming apparatus of the present embodiment or even in an image forming apparatus whose fixing system is different from that of the present embodiment but whose conditions such as a process speed and a copying speed are close to those of the present embodiment. In such a case, an output setting table similar to that of the present embodiment may be used or an output setting table obtained by correcting a little the contents of the output setting table of the present embodiment may also be used.

For example, though the image forming apparatuses A and B shown in FIG. 23 have different fixing systems, respectively, a temperature ripple can be suppressed in both of the image forming apparatuses A and B by control with use of one output setting table (table A). Further, though the image forming apparatuses C and D shown in FIG. 23 have different copying speeds, respectively, a temperature ripple can be suppressed in both of the image forming apparatuses C and D by control with use of one output setting table (table B).

In other words, by controlling a fixing process by use of three kinds of output setting table as shown in FIG. 24, a temperature ripple can be suppressed in at least five types of image forming apparatuses. That is, one output setting table can be applied to control of a fixing process under a wide range of conditions including a process speed, a copying speed, a fixing system, a control target temperature, environmental conditions, and the like.

Accordingly, in a plurality of types of image forming apparatuses, a temperature ripple can be suppressed by using a common output setting table. Accordingly, an output setting table does not necessarily need to be prepared for each type of image forming apparatuses (for each image forming apparatus whose process speed, copying speed or fixing system is different). This makes it possible to save work of developers for development of an image forming apparatus as well as reducing cost for the development.

Further, in the present embodiment, the output setting table has five rows (there are five levels in regard to divisions of the second temperature difference) and seven columns (there are seven levels in regard to divisions of the first temperature difference). That is, a temperature state of the fixing device is classified, in accordance with the second temperature difference, into one of five temperature slopes in total including two types of temperature slopes (a sharp temperature slope and a gentle temperature slope) corresponding to a temperature rise, a temperature equilibrium state (no temperature slope) and two types of temperature slopes (a sharp temperature slope and a gentle temperature slope) corresponding to a temperature fall. Then, the amount of power to be supplied is set in accordance with a result of this classification and a classification result of the first temperature difference into one of the seven levels. Note that the present invention is not limited to this but the number of rows (the number of divisions of the second temperature difference) and the number of columns (the number of divisions of the first temperature difference) may be changed as appropriate. That is, in a case where more precise control is required, the number of columns and/or the number of rows should be increased. Meanwhile, in a case where the contents of setting is to be simplified, the number of columns and/or the number of rows should be decreased. Note that too large number of rows and columns makes setting more complex though a temperature ripple suppressing effect can be improved; meanwhile, too small number of columns and rows deteriorates a temperature ripple suppressing effect though the setting can be simplified. Therefore, in the output setting table, the number of columns is preferably in a range of 5 to 8; the number of rows is preferably in a range of 5 to 10.

In the above example, the output setting table is set, on assumption that sheets of recording material are carried into the fixing device 30 successively at a predetermined process speed and a predetermined fixing speed. However, when the image forming apparatus is actually operated, process control such image quality adjustment or toner supply may be required during an image forming operation. In such a case, during the process control, carrying of sheets of recording material may be interrupted. If, in a state where carrying of sheets of recording material is interrupted, temperature control is carried out by using an output setting table set on an assumption that sheets of recording material are being successively carried, heat assumed to be used for melting toner and heat assumed to be absorbed by the sheets of recording material stay in the fixing device. This may cause an excessive temperature rise. Consequently, a problem such as winding of recording material onto the fixing belt 33, hot offset, or a coarse image may occur. In order to solve this problem, it is possible to switch output setting tables or to adjust the amount of power in accordance with a change in load of the image forming apparatus 100 in an image forming operation (in printing).

FIG. 25 shows an example of an output setting table used in a case where recording material is being carried (in a case where sheets of recording material are successively carried and in a case where only one sheet of recording material is carried). FIG. 26 shows an example of an output setting table used in a case where carrying of recording material is interrupted temporarily due to the occurrence of a change in load of the image forming apparatus 100. Note that the output setting table shown in FIG. 26 may be used (i) in a period from a time when an image forming operation is started to a time when a sheet of recording material is carried into the fixing device 30 and/or (ii) in a period of post-rotation at the time when a transition to a standby state occurs after the last sheet of recording material has passed. As shown in FIGS. 25 and 26, in a case where carrying of recording material is temporarily interrupted, the temperature control is performed by switching the output setting table to an output setting table in which a lower amount of power to be supplied is set. This can prevent an excessive temperature rise of the fixing belt 33, and further prevent the occurrence of a problem such as winding of recording material onto the fixing belt, hot offset, or a coarse image.

The present invention is not limited to a method in which output setting tables are switched in accordance with a change in load of the image forming apparatus 100 in an image forming operation (in printing). Alternatively, by using one output setting table, an amount of power calculated based on this output setting table may be corrected in accordance with the change in load of the image forming apparatus 100.

FIGS. 27(*a*) to 27(*c*) are explanatory diagrams each illustrating one correction method in a case where the amount of power calculated based on an output setting table is corrected in accordance with a change in load of the image forming apparatus 100.

FIG. 27(*a*) shows correction values (correction rates) in a case where the amount of power is corrected in accordance with an elapsed time (idling time) for which the fixing device 30 keeps operating (idling) in a state where carrying of recording material is interrupted. In the example of FIG. 27(*a*), in a period within five seconds from the beginning of interruption in carrying the recording material, 2% of the maximum amount of power (rated power) that is suppliable to the heating member 32 is subtracted from the amount of power calculated based on the output setting table; in a period longer than 5 seconds to 10 seconds from the beginning of the interruption, 5% of the maximum amount is subtracted; in a period longer than 10 seconds to 20 seconds from the beginning of the interruption, 10% of the maximum amount is subtracted; in a period longer than 20 seconds to 30 seconds from the beginning of the interruption, 15% of the maximum amount is subtracted; in a period longer than 30 seconds to 45 seconds from the beginning of the interruption, 20% of the maximum amount is subtracted; in a period longer than 45 seconds to 60 seconds from the beginning of the interruption, 25% of the maximum amount is subtracted; and in a period longer than 60 seconds from the beginning of the interruption, 30% of the maximum amount is subtracted.

FIG. 27(*b*) shows correction values (correction rates) in a case where the amount of power is corrected in accordance of a rotation speed of each of the fixing roller 31, the fixing belt 33, and the pressure roller 34 in a state (an idling state) in which the fixing device 30 keeps operating (idling) in a state where carrying of recording material is interrupted. In the example of FIG. 27(*b*), the rotation speed of each of the fixing roller 31, the fixing belt 33, and the pressure roller 34 can be switched among 5 levels including Low Speed, Middle Speed 1, Middle Speed 2, Middle Speed 3, and High Speed. At Low Speed, 5% of the maximum amount of power (rated power) that is suppliable to the heating member 32 is subtracted from the amount of power calculated based on the output setting table; at Middle Speed 1, 10% of the maximum amount is subtracted; at Middle Speeds 2 and 3, 15% of the maximum amount is subtracted; and at High Speed, 20% of the maximum amount is subtracted.

FIG. 27(*c*) shows correction values (correction rates) in a case where the amount of power is corrected in accordance with a temperature transition state in a case where the first detected temperature exceeds the control target temperature in a state (an idling state) in which the fixing device 30 keeps operating (idling) in a state where carrying of recording material is interrupted, in the image forming apparatuses A to E as shown in FIG. 23. In the example shown in FIG. 27(*c*), regarding the image forming apparatuses A to E, in a case where the first detected temperature exceeds the control target temperature, whether a surface temperature of the fixing belt (or a fixing roller) is being decreased, at an equilibrium, or being increased is determined based on the second temperature difference. Then, by using a correction value from among correction values set in accordance with respective states, the amount of power calculated based on the output setting table is corrected.

Note that though in the examples of FIGS. 27(*a*) and 27(*b*), the correction values (correction rates) are switched in accordance with an idling time and a rotation speed, respectively, the present invention is not limited to this. The correction values may be a constant value regardless of the idling time and the rotation speed.

Further, the present invention is not limited to a configuration in which the output setting table is switched or the amount of power calculated by using the output setting table is corrected in a case where carrying of recording material is interrupted. The output setting table may be switched or the amount of power calculated by using the output setting table may be corrected (i) at the time when preliminary rotation of each of the fixing roller 31, the fixing belt 33, and the pressure roller 34 occurs before carrying of recording material starts at the start of an image forming operation (printing operation), (ii) at the time when post-rotation of each of the fixing roller 31, the fixing belt 33, and the pressure roller 34 occurs at completion of the image forming operation, (iii) in a case where a power supply voltage changes, (iv) in a case where an operation mode of the image forming apparatus 100 is switched, (v) in a case where a type of the heating member is changed, or the like. In such a case, an identical output setting table and/or identical correction values (correction rates) may be used at the interruption of carrying of recording material, at the preliminary rotation, and at the post-rotation. Alternatively, different output setting tables and/or correction values (correction rates) may be set separately for the interruption of carrying of recording material, the preliminary rotation, and the post-rotation. As a further alternative, output setting tables may be set as appropriate in accordance with types of heating members, rated powers, or the like.

FIG. 28 shows an example of an output setting table in a case where an output setting table is set for each operation mode of the image forming apparatus 100. In the example of FIG. 28, three kinds of output setting tables are set. One of the three kinds of output setting tables is for an image forming mode (printing mode); another is for a preliminary rotation mode, a post-rotation mode, and an idling mode (a mode in which carrying of recording material is interrupted during the image forming operation); and the other is for a standby mode (a Ready standby mode in which the image forming apparatus is on standby while keeping a temperature state that allows a fixing process to be started immediately).

FIG. 29 shows examples of output setting tables in a case where an output setting table is set for each voltage value of a power supply voltage. In the example shown in FIG. 29, three kinds of output setting tables in total are set for respective cases where the power supply voltages are 100 V, 120 V and 230 V. Note that a voltage value for a commercial power source is different in each country. The voltage value is set at 100 V in Japan; the voltage value is set at 120 V in US, etc.; and the voltage value is set in a range of 220 V to 230 V in a part of European countries.

Further, by using, as the heating member 32 for heating the fixing belt 33, (i) a full-width heating section whose heating covers a full width of the fixing belt 33 and (ii) a center heating section for heating only a center section of the fixing belt 33 in the width direction of the fixing belt 33, the amount of power supplied to these heating sections may be controlled by separate output tables. FIG. 30 shows an example of a case where an output setting table is set separately for each of the full-width heating section and the output setting table for the center heating section. Configurations of the full-width heating section and the center heating section are not specifically limited. For example, the full-width heating section may be a heating member of 100 V and 930 W; the center heating section may be a heating member of 100 V and 530 W.

FIG. 31(*a*) to FIG. 31(*d*) show examples of output setting tables in a case where (i) an output setting table for the full-width heating section and an output setting table for the center heating section are separately set and (ii) in addition, output setting tables are switched in accordance with a power supply voltage and an operation mode.

More specifically, FIG. 31(*a*) shows output setting tables a to d. The output setting table a is an output setting table used under conditions at a power supply voltage in a range of 220 V to 240 V (200 V power supply system) in a standby mode; the output setting table b is an output setting table used under conditions at a power supply voltage in a range of 220 V to 240 V in an image forming operation (in a printing operation); the output setting table c is an output setting table used under conditions at a power supply voltage in a range of 100 V to 120 V (100 V power supply system) in a standby mode; and the output setting table d is an output setting table used under conditions at a power supply voltage in a range of 100 V to 120 V in an image forming operation (in a printing operation).

Further, FIG. 31(*b*) shows output setting tables e to h for the center heating section. The output setting table e is an output setting table used under conditions at a power supply voltage in a range of 220 V to 240 V in a standby mode; the output setting table f is an output setting table used under conditions at a power supply voltage in a range of 220 V to 240 V in an image forming operation (in a printing operation); the output setting table g is an output setting table used under conditions at a power supply voltage in a range of 100 V to 120 V in a standby mode; and the output setting table h is an output setting table used under conditions at a power supply voltage in a range of 100 V to 120 V in an image forming operation (in a printing operation).

For example, in a standby state in a case where the image forming apparatus is used in Japan in which the power supply voltage (commercial power source) is 100V, an amount of power to the full-width heating section is controlled by using the table c and an amount of power to the center heating section is controlled by the table g. Further, in an image forming operation in a case where the image forming apparatus is used in Japan, the amount of power to the full-width heating section is controlled by using the table d and the amount of power to the center heating section is controlled by the table h. Meanwhile, in a standby state in a case where the image forming apparatus is used in a country in which the power supply voltage is in a range of 220 V to 240 V, an amount of power to the full-width heating section is controlled by using the table a and an amount of power to the center heating section is controlled by the table e. Further, in an image forming operation in a case where the image forming apparatus is used in the country in which the power supply voltage is in a range of 220 V to 240 V, the amount of power to the full-width heating section is controlled by using the table b and the amount of power to the center heating section is controlled by the table f.

In this way, by switching a plurality of kinds of output setting tables in accordance with conditions such as a power supply voltage, an operation mode, and a type of the heating member, the temperature of the fixing device 30 can be controlled in accordance with conditions more appropriately as compared to a case where temperature control is carried out by using a single output setting table.

Note that the above example explains a case where the output setting tables are switched in accordance with a power supply voltage, an operation mode, and a type of the heating member, the output setting tables may be switched in accordance with conditions such as an environmental temperature, a type of recording material, a water content of recording material, etc., in addition to or instead of the above-described conditions.

Further, a flexible and stable temperature control can be carried out, by using a plurality of kinds of output setting tables and switching the plurality of kinds of output setting tables and in addition by correcting as appropriate, in accordance with conditions such as a power supply voltage, an operation mode, and a type of heating member, the amount of power to each heating member which amount is calculated by using an output setting table.

[Embodiment 2]

The following explains another embodiment of the present invention. For convenience of the explanation, members respectively having identical functions as members of Embodiment 1 are given the same reference signs as the members of Embodiment 1, respectively and explanations thereof are omitted.

Figure 11:
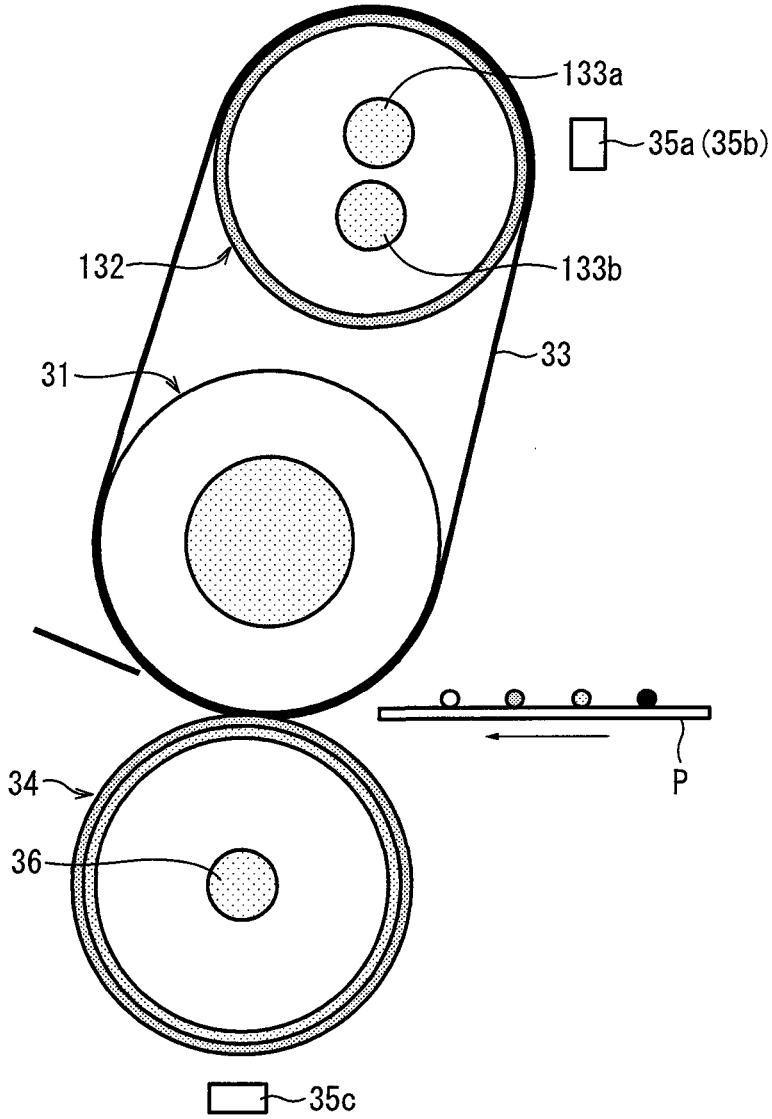
FIG. 11

FIG. 11 is a cross sectional view of the fixing device 30*b* according to the present embodiment. This fixing device 30*b* is provided in an image forming apparatus 100 in place of a fixing device 30 of Embodiment 1.

As shown in FIG. 11, the fixing device 30*b* includes a heating roller (heating member) 132 in place of the heating member 32 in the fixing device 30 of Embodiment 1. The heating roller 132 is provided therein with a heater lamp (center heating member) 133*a* and a heater lamp (end section heating member) 133*b* each made of a halogen lamp or the like.

The heating roller 132 is a hollow cylinder roller member made of aluminum having an outer diameter of 28 mm and a wall thickness of 0.5 mm. Both end sections of the heating roller 132 are rotatably held by support members each made of a heat insulating bush made of heat-resistant resin and a ball bearing. Further, these support members are fixed to a frame biased in a direction parting from the fixing roller 31 by a biasing member such as a spring. This provides a predetermined tension to the fixing belt 31 that is provided in a tensioned state over the fixing roller 31 and the heating roller 132. As a result, when the fixing roller 31 is driven to rotate, the fixing belt 33 is rotated so as to follow the fixing roller 31 and subsequently the heating roller 132 is rotated so as to follow the fixing belt 33.

Inside the heating roller 132, the heater lamps 133*a* and 133*b* are provided. Note that the heater lamp 133*a* is provided in an area having a predetermined width in a center section of the heating roller 132 in an axis direction of the heating roller 132. Meanwhile, the heater lamp 133*b* is provided in areas each having a predetermined width in end sections of the heating roller 132 in the axis direction of the heating roller 132. Further, a thermistor 35*a* is provided in a position that is opposed to the heater lamp 133*a* via the fixing belt 33 and the heating roller 132; a thermistor 35*b* is provided in a position that is opposed to the heater lamp 133*b* via the fixing belt 33 and the heating roller 132.

The heater lamps 133*a* and 133*b* are operated under operation control performed on heat source drive means 45 by a temperature control section 42. More specifically, the heat source drive means 45 controls power to be supplied to the heater lamps 133*a* and 133*b* from a power supply circuit 43, in accordance with a control signal from the temperature control section 42. Under the control, the heater lamps 133*a* and 133*b* emit light in accordance with the power supplied, and thereby, infrared ray is emitted from the heater lamps 133*a* and 133*b*. As a result, an inner peripheral surface of the heating roller 132 absorbs the infrared ray and is heated and subsequently, the entire heating roller 132 is heated. Note that for making it easy to absorb the infrared lay emitted from the heater lamps 133*a* and 133*b*, a heat-resistant black coating that has a preferable absorbing property in an wavelength range of the infrared ray may be applied to the inner surface of the heating roller 132.

Figure 12:
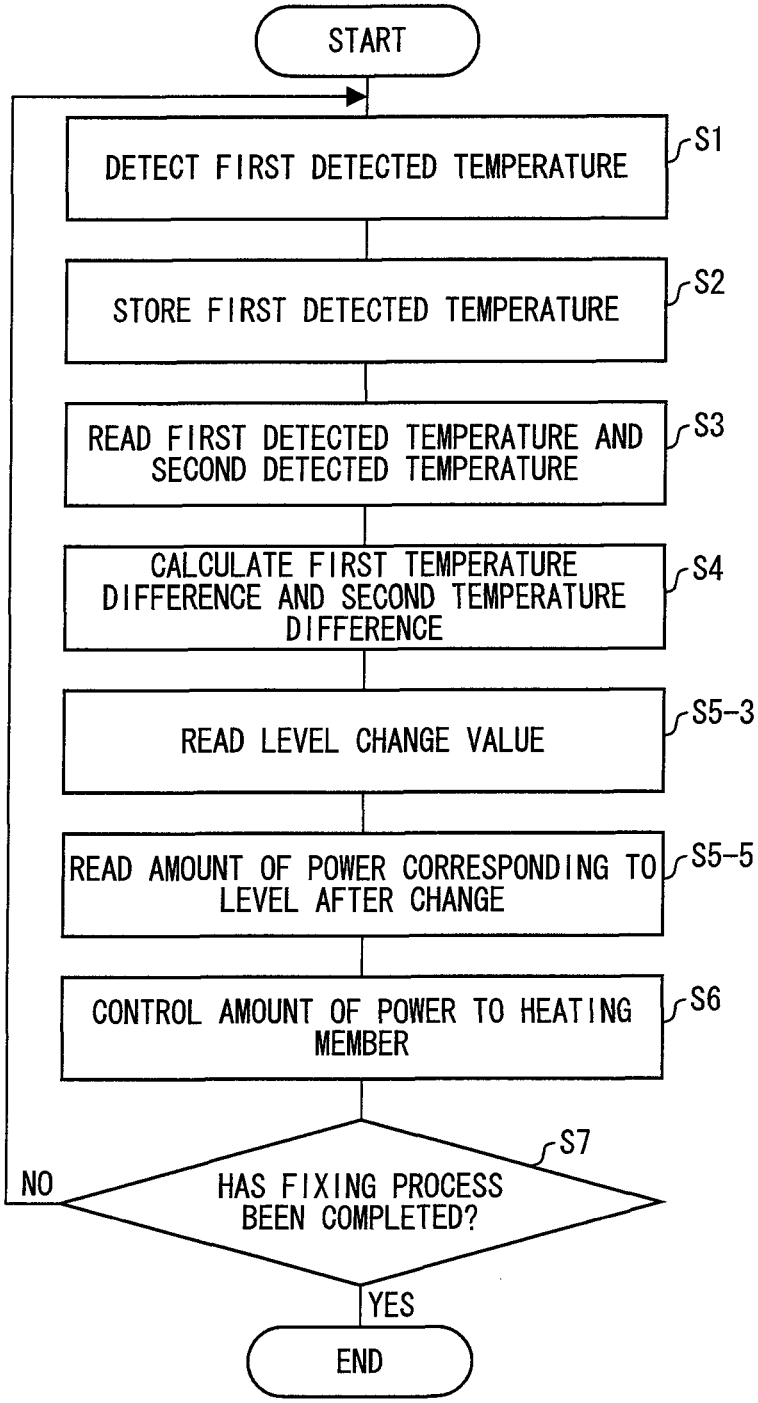
FIG. 12

FIG. 12 is a flowchart showing a flow of a temperature control process of the heating member 32 in the temperature control section 42 provided in the fixing device 30*b* of the present embodiment.

Processes of S1 to S4 are substantially the same as those of FIG. 1 in Embodiment 1. However, in the present embodiment, a second detected temperature is a detected temperature that was detected 1.5 seconds earlier than the current time.

After a temperature difference calculating section 53 calculates a first temperature difference and a second temperature difference, an output determining section 55 reads out a level change value corresponding to the first temperature difference and the second temperature difference from a level change value table (output setting table) stored in the table storage section 54 (S5-3). Then, the output determining section 55 reads out an output value (amount of power) of a level corresponding to the level change value read out in S5-3 (S5-5), from an output specifying table stored in the table storage section 54.

More specifically, in the present embodiment, each amount of power to each heater lamp is divided into a plurality of levels in accordance with a ratio with respect to the rated power, and an output specifying table is set so as to indicate a level of an amount of power supplied to each heater lamp at a time a predetermined time earlier than the current time. This output specifying table is stored in the table storage section 54 for each heater lamp. FIG. 13(*a*) is an example of a first output specifying table that is an output specifying table of the heater lamp 133*a*. In this table, the amount of power to the heater lamp 133*a* is divided into 15 levels in accordance with a ratio of the mount of power with respect to the rated power. This example shows a case where the previous amount of power having been supplied to the heater lamp 133*a* is Level 5 that corresponds to 50% of the rated power.

Further, in the present embodiment, level change value tables (first level change value table (table for a center section, center section table), second level change value table (table for the pressure member, pressure member table), and a third level change value table (table for an end section, end section table)) are stored in the table storage section 54. In the level change value tables, each level change value of the amount of power is associated with a combination of (i) a temperature difference (first temperature difference, third temperature difference, or fifth temperature difference) between a target temperature and a currently detected temperature (first detected temperature, third detected temperature, or fifth detected temperature) and (ii) a temperature difference (second temperature difference, fourth temperature difference, or sixth temperature difference) between the currently detected temperature and a detected temperature that was detected at a time a predetermined time earlier than the current time (second detected temperature, fourth detected temperature, or sixth detected temperature). FIG. 13(*b*) shows one example of a level change value table that stores level change values of the amount of power to the heater lamp 133*a* which amount of power corresponds to a combination of the first temperature difference and the second temperature difference. Note that the level change values of FIG. 13(*b*) are set to be positive values for cases where a change between levels corresponds to an increase in the output value in the output specifying table of FIG. 13(*a*) (a level change value indicative of a change in a direction in which a value of the level decreases in (a) of FIG. 13 is expressed by a positive value).

For example, in a case where: a target temperature of the fixing belt 33 is set at 165° C.; a detected temperature (first detected temperature) of the thermistor 35*a* is 161° C.; a detected temperature (second detected temperature) that was detected by the thermistor 35*a* at a time a predetermined time (e.g., 1.5 seconds before) earlier than the current time is 165° C.; and the amount of power currently supplied to the heater lamp 133*a* is at Level 11 (10% of the rated power), the level change value is 2 according to the level change value table shown in FIG. 13(*b*). Accordingly, the level is changed to Level 9 based on the output specifying table shown in FIG. 13(*a*). As a result, the amount of power to the heater lamp 133*a* is changed to 25% of the rated power corresponding to Level 9.

Meanwhile, in a case where: a target temperature of the fixing belt 33 is set at 170° C.; a detected temperature (first detected temperature) of the thermistor 35*a* is 172° C.; a detected temperature (second detected temperature) detected by the thermistor 35*a* at a time a predetermined time (e.g., 1.5 seconds) earlier than the current time is 165° C.; and the amount of power currently supplied to the heater lamp 133*a* is at Level 5 (50% of the rated power), the level change value is −2 according to the level change value table shown in FIG. 13(*b*). Accordingly, the level is changed to Level 7 according to the output specifying table shown in FIG. 13(*a*). As a result, the amount of power to the heater lamp 133*a* is changed to 30% of the rated power corresponding to Level 7.

Note that in a case where a value obtained by adding a value corresponding to the level change value read out from the level change value table to a value of the current level is greater than the maximum value of the level (15 in the case of FIG. 13(*a*)), a level after the level change should be set at the maximum value. Meanwhile, in a case where a value obtained by adding a value corresponding to the level change value read out from the level change value table to a value of the current level is smaller than the minimum value of the level (1 in the case of FIG. 13(*a*)), a level after the level change should be set at the minimum value.

Subsequently, based on the amount of power determined by the output determining section 55, a power control section 56 controls an operation of the heat source drive means 45 so as to control the amount of power to be supplied to the heating member 32 from the power supply circuit 43 (S6). Then, the temperature control section 42 determines whether or not to end the fixing process (S7). In a case where the fixing process is not to be ended, the steps from S1 are repeated.

Note that respective temperatures of the heater lamps 133*b* and 36 are controlled in the substantially same manner as the temperature of the heater lamp 133*a*.

That is, in the present embodiment, the sensor data input section 51 accepts detection signals from the thermistors 35*a*, 35*b*, and 35*c*. Based on these detection signals, the sensor data input section 51 finds the first detected temperature, the third detected temperature, and the fifth detected temperature, respectively. Then, the sensor data input section 51 causes a temperature storage section 52 to store the detected temperatures.

Next, the temperature difference calculating section 53 reads out, from the temperature storage section 52, the first detected temperature and the second detected temperature (i.e., first detected temperature detected at a time a predetermined time (e.g., 1.5 seconds) earlier than the current time). Based on these first and second detected temperatures, the temperature difference calculating section 53 calculates the first temperature difference and the second temperature difference, and then outputs the first and second temperature differences to the output determining section 55. Further, the temperature difference calculating section 53 reads out, from the temperature storage section 52, the third detected temperature and the fourth detected temperature (i.e., third detected temperature detected at a time a predetermined time before the current time). Based on these third and fourth detected temperatures, the temperature difference calculating section 53 calculates the third temperature difference and the fourth temperature difference, and then outputs the third and fourth temperature differences to the output determining section 55. In addition, the temperature difference calculating section 53 reads out, from the temperature storage section 52, the fifth detected temperature and the sixth detected temperature (i.e., fifth detected temperature detected at a time a predetermined time before the current time). Based on these fifth and sixth detected temperatures, the temperature difference calculating section 53 calculates the fifth temperature difference and the sixth temperature difference. The fifth temperature difference is a difference between a target temperature of the fixing belt 33 and the fifth detected temperature; the sixth temperature difference is a difference between the sixth detected temperature and the fifth detected temperature. Then, the temperature difference calculating section 53 outputs the fifth and sixth temperature differences to the output determining section 55.

Next, the output determining section 55 determines an amount of power to be supplied to the heater lamp 133*a*, based on a combination of the first and second temperature differences which are calculated by the temperature difference calculating section 53. Further, the output determining section 55 determines an amount of power to be supplied to the heater lamp 36, based on a combination of the third and fourth temperature differences which are calculated by the temperature difference calculating section 53. In addition, the output determining section 55 determines an amount of power to be supplied to the heater lamp 133*b*, based on a combination of the fifth and sixth temperature differences which are calculated by the temperature difference calculating section 53.

Then, the output determining section 55 reads out, from the first level change value table, a level change value in accordance with a combination of the first temperature difference and the second temperature difference. Then, the output determining section 55 changes the current level in the first output specifying table in accordance with this level change value. The output determining section 55 also changes the amount of power to be supplied to the heater lamp 133*a* to an amount of power in accordance with a level after the change. Further, the output determining section 55 reads out, from a second level change value table, a level change value in accordance with a combination of the third temperature difference and the fourth temperature difference. Then, the output determining section 55 changes the current level in a second output specifying table in accordance with this level change value. The second output specifying table is an output specifying table for the heater lamp 36. The output determining section 55 also changes the amount of power to be supplied to the heater lamp 36 to an amount of power in accordance with a level after the change. In addition, the output determining section 55 reads out, from a third level change value table, a level change value in accordance with a combination of the fifth temperature difference and the sixth temperature difference. Then, the output determining section 55 changes the current level in a third output specifying table in accordance with this level change value. The third output specifying table is an output specifying table for the heater lamp 133*b*. The output determining section 55 also changes the amount of power to be supplied to the heater lamp 133*b* to an amount of power accordance with a level after the change.

Subsequently, the power control section 56 controls respective amounts of power to the heater lamps 133*a*, 133*b*, and 36, based on the amounts of power determined by the output determining section 55.

Note that the present embodiment is arranged so that temperature control of respective sections is performed based on the above described control method, not only during execution of the fixing process but also in a Ready standby state in which the fixing device 30*b* is on standby at a temperature that makes it possible to immediately carry out the fixing process.

As described above, the present embodiment includes: the heater lamp 133*a* provided in a position corresponding to a center section in the width direction of the fixing belt 33; the heater lamp 133*b* provided in a position corresponding to end sections in the width direction of the fixing belt 33; and the heater lamp 36 provided inside the pressure roller 34. The amount of power to the heater lamp 133*a* is controlled based on a combination of the first temperature difference and the second temperature difference. The first temperature difference is a difference between (a) the currently detected temperature in the center section in the width direction of the fixing belt 33 and (b) the target temperature of the fixing belt 33; the second temperature difference is a difference between (a) the currently detected temperature above and (b) the detected temperature in the center section in the width direction of the fixing belt 33 which detected temperature was detected at a time a predetermined time earlier than the current time. Further, the amount of power to the heater lamp 36 is controlled based on a combination of the third temperature difference and the fourth temperature difference. The third temperature difference is a difference between (a) the currently detected temperature of the pressure roller 34 and (b) the target temperature of the pressure roller 34; the fourth temperature difference is a difference between (a) the currently detected temperature of the pressure roller 34 and (b) the detected temperature of the pressure roller 34 which detected temperature was detected at a time a predetermined time earlier than the current time. In addition, the amount of power to the heater lamp 133*b* is controlled based on a combination of the fifth temperature difference and the sixth temperature difference. The fifth temperature difference is a difference between (a) the currently detected temperature at the end section in the width direction of the fixing belt 33 and (b) the target temperature of the fixing belt 33; the sixth temperature difference is a difference between (a) the currently detected temperature at the end section and (b) the detected temperature at the end section in the width direction of the fixing belt 33 which detected temperature was detected at a time a predetermined time earlier than the current time.

This makes it possible to reflect last output results in the past (control records) for the respective heater lamps, onto control of the next output values. Consequently, it becomes possible to effectively suppress a temperature ripple of the fixing belt 33 and the pressure roller 34 in a simple configuration. As a result, it becomes possible to prevent a problem such as deterioration in image quality or winding of recording material which problem is caused by excessive heating or insufficient amount of heat. In addition, because the overheating of the fixing belt 33 and the pressure roller 34 can be prevented, unnecessary energy consumption can be eliminated. This makes it possible to save energy.

FIG. 14(*a*) is a graph showing respective temperature detection results obtained by the thermistors 35*a* to 35*c* in a Ready standby state, in a case (Comparative Example 2) where temperature control on a fixing belt and a pressure roller was performed by on/off control based on only current temperature detection results of the fixing belt and the pressure roller. FIG. 14(*b*) is a graph illustrating respective temperature detection results of the thermistors 35*a* to 35*c* in a Ready standby state, in a case (Example 2) where temperature control of the fixing belt and the pressure roller was performed according to the control method of the present embodiment. Note that the Ready standby state means a standby mode in which a temperature of each member is kept at a target temperature so that a fixing process can be started immediately when an instruction to carry out the fixing process is given by a main control section. In the above cases of FIGS. 14(*a*) and 14(*b*), the target temperature of the fixing belt 33 (target temperature based on the detected temperature obtained by the thermistor 35*a*) was set at 180° C. and the target temperature of the pressure roller 34 was set at 170° C. Further, the amount of power to each of the heating member 32 and the heater lamp 36 was controlled based on an average value of amounts (two calculated values) of power which average value was calculated every 510 ms in an interval time. This calculation was on an assumption that: a calculation cycle (control cycle) of the amount of power to each of the heating member 32 and the heater lamp 36 was 510 ms; and an interval time was 1020 ms.

As shown in FIG. 14(*a*), under control by the control method of Comparative Example 2, a temperature ripple in which the temperature varied by approximately 10° C. occurred in each of the center section and the edge section of the fixing belt in the width direction of the fixing belt. On the other hand, by using the temperature control method according to the present embodiment, as shown in FIG. 14(*b*), the temperature of the fixing belt could be kept at the target temperature substantially uniformly while the temperature ripple hardly occurred. By controlling the temperature of the fixing belt 33 in the Ready standby state so that the temperature is substantially uniform, it is possible to suppress the occurrence of a large temperature ripple when a fixing process is subsequently started. Therefore, it becomes possible not only to immediately start the fixing process but also to prevent deterioration in image quality, winding of recording material onto the fixing belt 33, and the like.

Note that in the present embodiment, one output specifying table and one level change value table are used both in the Ready standby state and in the fixing process. However, the present invention is not limited to this configuration. For performing more precise temperature control, it is possible to use a plurality of kinds of output specifying tables and level change value tables depending on external disturbance factors such as an operation state or environmental conditions of the fixing device 30*b*. For example, when the fixing process is executed (in a printing operation), it is possible to use a first level change value table shown in FIG. 15 in place of the first level change value table as shown in FIG. 13(*b*).

Alternatively, a plurality of level change value tables may be provided so as to correspond to conditions at each of which an operation state of the fixing device 30*b* is changed. Such conditions are, for example: (i) a time when temperature control is started (e.g., a time when a power is turned on, a time for recovery from a sleep state, etc.); (ii) a time when a temperature control condition is changed (e.g., a time when a setting of a target temperature is changed, a time when a type of recording material is changed, a time when a print speed (process speed) is changed, etc.); (iii) a time when an operation state of an image forming apparatus is changed (e.g., a time for transition from the Ready standby state to a printing state (a state in a fixing process), a time for transition from a warming up state to the Ready standby state, a time for transition from a printing state to a cooling state (a standby state at a temperature that is lower than a temperature at the fixing process and a temperature at warming up), a time for transition from the cooling state to a standby state, a time for transition from the cooling state to a printing state, etc.); (iv) a time when a predetermined condition (e.g., an elapsed time from the start of printing, the number of sheets printed from the start of printing, a processing state in regard to the number of printed sheets printed during printing, the number of remaining sheets to be printed, etc.) in execution of a printing operation expires; (v) a time when other temperature control condition is changed; (vi) a time when an amount of power to be supplied is changed; (vii) a time when a predetermined condition in execution of a printing operation expires in the fixing device 30*b*; (viii) a time when a printing operation is completed; (ix) a time of an energy saving state in a preheating state; and the like. Alternatively, the above conditions are divided into a plurality of groups and for each group, a level change value table may be provided. Similarly, a plurality of output specifying tables may be provided for respective conditions described above or groups into which the conditions described above are classified.

As shown in FIG. 16, two level change value tables A and B are set as first level change value tables to be applied to the heater lamp 133*a*, and two output specifying tables A and B are set as first output specifying tables. Note that in an example of FIG. 16, amounts of power in the level change value table A are set so as to be larger than those in the level change value table B. Further, amounts of power in the output specifying table A is set so as to be larger than those in the output specifying table B. This makes it possible to switch to amount-of-power setting patterns in four ways, that is, minimum, small, large, and maximum amount-of-power setting patterns as shown in FIG. 16, in accordance with a combination of a level change value table and an output specifying table which are selected.

Figure 17:
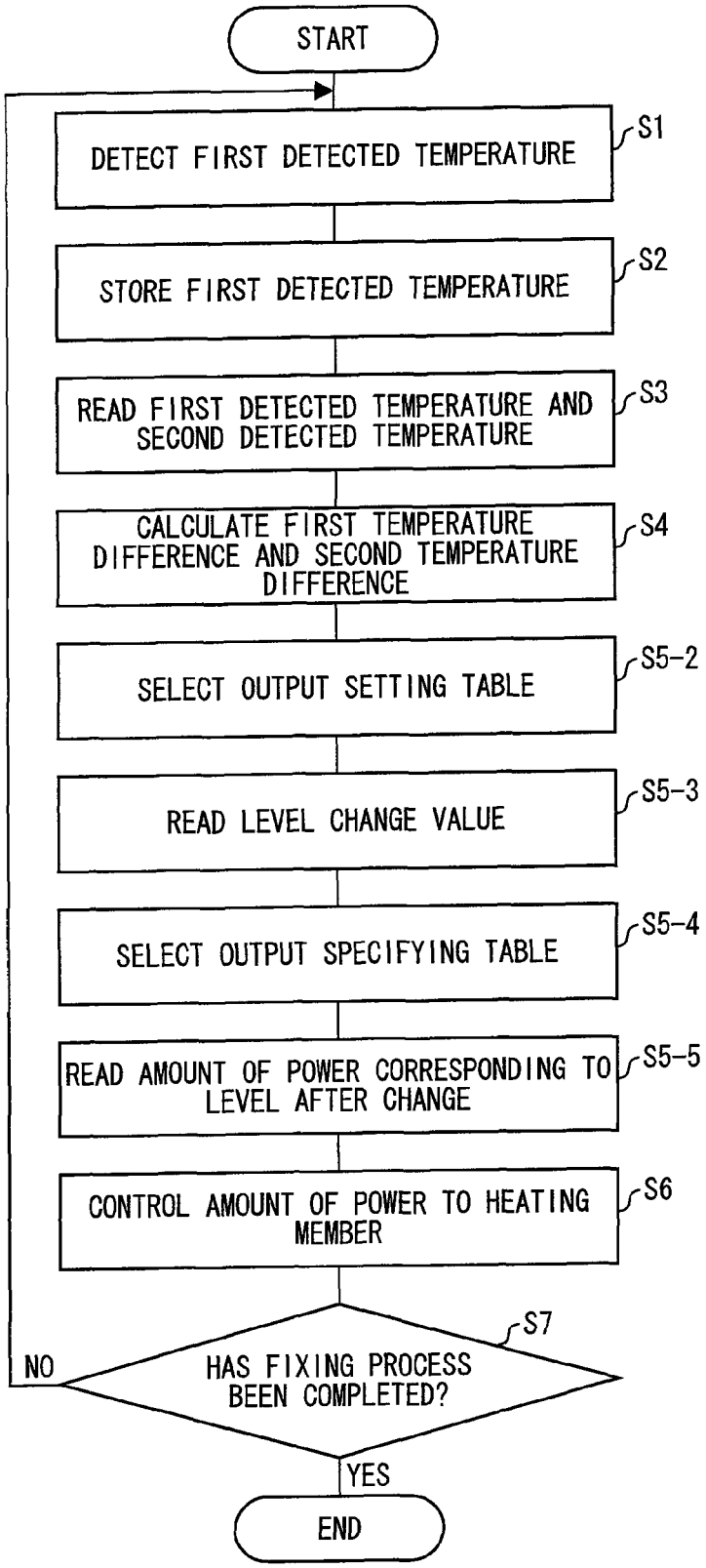
FIG. 17

FIG. 17 is a flowchart showing an example of a flow of a process in a case where a plurality of level change value tables are selectively used depending on conditions. Processes of S1 to S4 are the same as those in FIG. 12.

After the temperature difference calculating section 53 calculates the first temperature difference and the second temperature difference, the output determining section 55 selects a level change value table from among a plurality of level change value tables, according to a preset condition (S5-2). Then, the output determining section 55 reads out a level change value corresponding to the first temperature difference and the selected second temperature difference from the level change value table (S5-3).

Then, the output determining section 55 selects an output specifying table to be used in a process from among a plurality of output specifying tables, according to a preset condition (S5-4). The output determining section 55 reads out an output value (amount of power) at a level corresponding to the level change value, from the selected output specifying table (S5-5).

Subsequently, in accordance with the amount of power determined by the output determining section 55, the power control section 56 controls an operation of the heat source drive means 45 so as to control the amount of power to be supplied to the heating member 32 from the power supply circuit 43 (S6). Then, the temperature control section 42 determines whether or not to end the fixing process (S7). In a case where the fixing process is not to be ended, the steps from S1 are repeated.

For example, in a case where a printing operation is started from a Ready standby state, members having a small heat capacity, such as the heating roller 132, the fixing belt 33, the fixing roller 31, and the pressure roller 34 may not have a sufficient amount of required heat for a printing operation. This may occur depending on a time length of the standby state, due to dissipation of stored heat in the Ready standby state. In order to solve this problem, initially at the start of the printing operation, the amount of power is set at a larger amount, under control of power supply by use of the level change value table A and the output specifying table A. Then, when a temperature of the pressure roller 34 which temperature is detected by the thermistor 35*c* reaches a predetermined temperature, the power supply is controlled by use of the level change value table A and the output specifying table B. This makes it possible to set the amount of power at a slightly smaller amount than that at an initial stage of the start of the printing operation. Further, when the number of printed sheets reaches a predetermined number of printed sheets (e.g., the number set for each size of sheets of recording material or each printing mode such as a single-side printing mode or a double-side printing mode) is reached, the power supply is controlled by using the level change value table B and the output specifying table A. In addition, in a case where an uncompleted printing process is stopped or relatively light amount of heat is to be supplied, for example, in the Ready standby state, the power supply is controlled by using the level change value table B and the output specifying table B.

This makes it possible to control the temperature based on four ways of combinations of the level change value tables and the output specifying tables even in a state where a heat supply condition is different, for example, in a printing operation or in the Ready standby state. Therefore, the temperature can be more appropriately controlled. This makes it possible to prevent overheating or insufficient heating by preventing the occurrence of a temperature ripple even in a case where the heat supply state suddenly changes.

Note that the above description explains a case where the amount of power to be supplied is gradually reduced in accordance with heat supply conditions. However, in a case where it is preferable to increase the amount of power in accordance with a heat supply condition, a combination of a level change value table and an output specifying table should be changed as appropriate so that the amount of power increases.

The numbers of the level change value tables and the output specifying tables corresponding to one heater lamp are not limited to 2. The number may be changed as appropriate. Further, the number of the level change value tables is not required to be the same as the number of the output specifying tables.

Further, the present invention is not limited to a configuration in which both the level change value tables and the output specifying tables are switched. However, the amount of power determined based on either one or both of a value read out from a level change value table and a value read out from an output specifying table may be corrected in accordance with an operation state of the fixing device 30 (e.g., in warming up, in a standby state before 5 minutes elapse after warming up, in printing, in printing before elapse of five minutes after warming up, in printing, in printing before the elapse of a predetermined period, in a state before the elapse of a predetermined time after the completion of printing, on standby for preheating, in a cooling operation, in recovering, etc.), an operation state of the image forming apparatus 100 (e.g., in warming up, in reading images, in process adjustment, in printing, in preheating, in receiving image data, in recovering, etc.), or a combination of operation states of the fixing device 30 and the image forming apparatus 100.

Further, the output specifying table shown in FIG. 13(*a*) may be used in a case where transition of change in the temperature of the fixing belt 33 is gradual in the Ready standby state. In such a case, responsiveness of the temperature control with respect to an external disturbance factor may deteriorate. This is because, even when a certain degree of difference occurs between the first detected temperature and the target temperature, the level change value becomes ±0 due to a small difference between the first detected temperature and the second detected temperature and therefore the amount of power to the heater lamp 133*a* is kept at 0.

For suppressing this deterioration in responsiveness of the temperature control, the present embodiment may be arranged as follows. That is, first, the amount of power to the heater lamp 133*a* is set at zero when a level having been changed in accordance with the level change value read out from the level change value table is Level 15 (0% of the rated power). Then, when the electricity to the heater lamp 133*a* is to be turned on, the electricity may be turned on at a level that is not a level corresponding to the level value read out from the level change value table but at a level of a predetermined value (e.g., Level 11 (10% of the rated power)). Alternatively, the electricity may be turned on at a predetermined amount of power (e.g., a predetermined value set within a range of 30% or less of the rated power). This keeps the amount of power at 0% for a while, when supply of the electricity is resumed. As a result, the deterioration of responsiveness can be prevented and a large change in the temperature of the fixing belt 33 can also be suppressed.

Note that a setting level of the amount of power at the time when the supply of the electricity is resumed is not limited to the example described above (10% of the rated power). For example, the setting level may be set as appropriate in consideration of a degree of an external disturbance factor such as an environmental temperature or a printing condition. For example, the amount of power at the time when the supply of the electricity is resumed may be set in accordance with environmental temperature and humidity. For example, in an environment at a normal temperature and at a normal humidity, the supply of the electricity may be resumed at 10% of the rated power; in an environment at a low temperature and at a low humidity, the supply of the electricity may be resumed at 21% of the rated power; and in an environment at a high temperature and at a high humidity, the supply of the electricity may be resumed at 7% of the rated power. Further, the electricity may be turned on at a predetermined level, not only in a case where the supply of the electricity is resumed from the current amount of power which is set at 0 but also, for example, in a case where a level is changed so as to increase the amount of power from an amount of power of a predetermined level or less. On the contrary, in a case where a level is changed so as to decrease the amount of power from an amount of power of a predetermined level or more, the electricity may also be turned on at a predetermined level. This similarly applies to cases where the amount of power is changed after a predetermined period from the start of a printing operation, at completion of printing of a predetermined number of sheets, at completion of warming up, at the end of the Ready standby state, or the like.

The present invention is not limited to a configuration in which, when supply of the electricity is resumed from an amount of power at zero, the amount of power is set at a predetermined value or an amount of power that corresponds to a predetermined level. For example, (i) in a case where the current amount of power is equal to or less than the first predetermined value (e.g., a predetermined value set in a range of 25% or less of the rated power) and an amount of power determined based on the level change value table and the output specifying table is different from the current amount of power by a predetermined value (e.g., the first predetermined value above) or more, or (ii) in a case where the current amount of power is the second predetermined value (e.g., a predetermined value set in a range of 75% or more of the rated power) and an amount of power determined based on the level change value table and the output specifying table is different from the current amount of power by a predetermined value (e.g., the second predetermined value above) or more, the amount of power to be supplied may be set at an amount of power which does not correspond to an amount of power determined based on the level change value table and the output specifying table but corresponds to a predetermined value or an amount of power that corresponds to a predetermined level.

Further, it may be arranged to store, in the table storage section 54, an output setting table (for example, a table that is the same as a table of FIG. 7) that is the same as a table in Embodiment 1 and that shows amounts of power each corresponding to a first temperature difference and a second temperature difference, in addition to the output specifying table and the level change value table that shows level change values each corresponding to a first temperature difference and a second temperature difference. Then, (i) in a case where the current amount of power is the first predetermined value (e.g., a predetermine value set within a range of 25% or less of the rate power) or less and (ii) in a case where the current amount of power is the second predetermine value (e.g., a predetermined value set within a range of 75% or more of the rated power) or more, the amount of power to be supplied may be set based on this additionally stored output setting table. Meanwhile, in the other cases, the amount of power to be supplied to the heater lamp 133*a* may be set based on the output specifying table and the level change value table previously described. Note that similarly, for the heater lamps 36 and 133*b*, it is possible to use a combination of power supply control by use of the output specifying table and the level change value table previously described and power supply control by use of the additionally stored output setting table.

Figure 18:
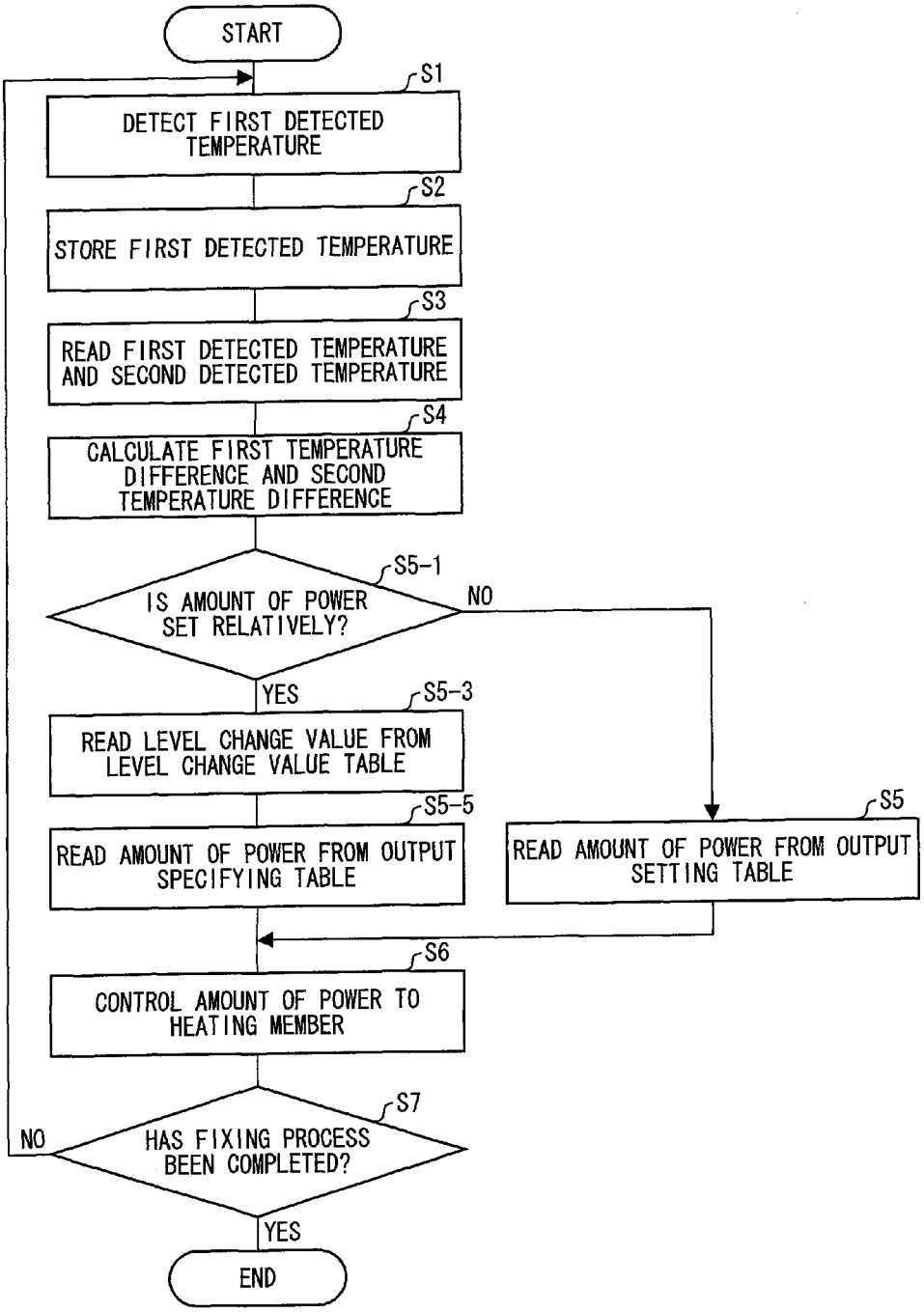
FIG. 18

FIG. 18 is a flowchart showing an example of a flow of a process carried out by switching a process (direct setting process) for determining the amount of power to be supplied by use of the output setting table and a process (indirect setting process) for determining the amount of power to be supplied by use of the level change value table and the output specifying table. Processes of S1 to S4 are the same as in FIG. 12.

After the temperature difference calculating section 53 calculates the first temperature difference and the second temperature difference in S4, the output determining section 55 determines whether to set the amount of power to the heater lamp 133*a* by the direct setting process or by the indirect setting process (S5-1). More specifically, in a case where the current amount of power is the first predetermined value or less and in a case where the current amount of power is the second predetermined value or more, the direct setting process is performed. Meanwhile, in a case where the current amount of power is more than the first predetermined value and less than the second predetermined value, the indirect setting process is performed.

Then, in a case where it is determined that the indirect setting process is to be performed, the output determining section 55 reads out a level change value corresponding to the first temperature difference and the second temperature difference from the level change value table (S5-3), and also reads out an output value (an amount of power) corresponding to a level changed in accordance with the level change value from the output specifying table (S5-5).

Meanwhile, in a case where it is determined that the direct setting process is to be performed, the output determining section 55 reads out, from the output setting table, an output value (an amount of power) corresponding to the first temperature difference and the second temperature difference (S5).

Then, the power control section 56 controls the operation of the heat drive means 45 based on the amount of power determined by the output determining section 55, and thereby controls the amount of power to be supplied to the heating member 32 from the power supply circuit 43 (S6). Then, the temperature control section 42 determines whether or not to end the fixing process (S7). In a case where the fixing process is not to be ended, the process from S1 is repeated.

Alternatively, for example, it may arranged to sequentially store calculation results of the second temperature difference into the temperature storage section 52, in addition to the first detected temperature and the second detected temperature, and then to change the level change value to be stored in the level change value table in accordance with a rate of change of the second temperature difference. Note that as the rate of change of the second temperature difference, for example, a difference between (i) the second temperature difference obtained a first predetermined time (e.g., 2 seconds) earlier than the current time and (ii) the second temperature difference obtained a second predetermined time (e.g., 1 second) earlier than the current time may be used. FIG. 19 shows an example of the level change value table in this case. According to this level change value table, a rate of change of the second temperature difference that corresponds to a temperature slope can be reflected on determination of the amount of power. Therefore, the temperature control can be more precisely performed. Note that the level change value to be stored in the level change value table may be more precisely set in accordance with a polarity and a scale of the rate of change of the second temperature difference.

Though in the present embodiment, the heating roller 132 provided therein with the heater lamps 133*a* and 133*b* is used as heating means for heating the fixing belt 33. However, the present invention is not limited to this configuration. For example, the heating member 32 shown in Embodiment 1 may be used.

Further, the above embodiments explain a case where a fixing device includes one set of the fixing roller, the fixing belt and the pressure roller. However, the present invention is not limited to this.

Figure 20:
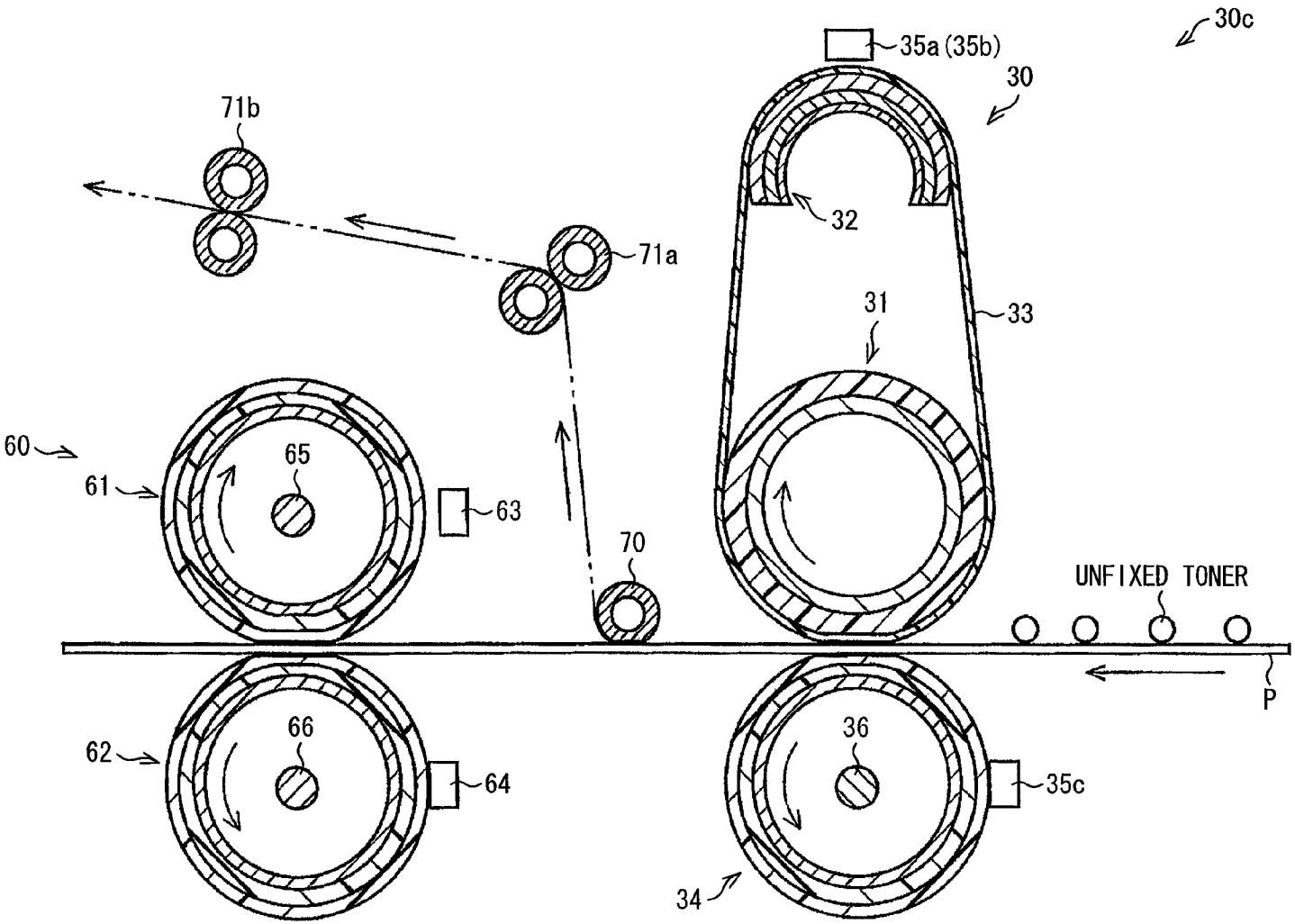
FIG. 20

For example, as shown in FIG. 20, it is possible to employ a fixing device 30*c* including the fixing device 30 of Embodiment 1 and a second fixing device 60 provided on a downstream side of the fixing device 30 in a direction in which recording material is carried.

This fixing device 30*c* has a configuration in which a fixing roller 61 including therein a heater lamp 65 abuts at a predetermined load on a pressure roller 62 including therein a heater lamp 66. The fixing roller 61 and the pressure roller are driven to rotate in opposite directions. Then, recording material is carried so as to pass between the fixing roller 61 and the pressure roller 62 which are being driven to rotate, so that a toner image having been subjected to first fixation onto the recording material by the fixing device 30 is more firmly fixed to this recording material.

Note that in a section opposing to the fixing roller 61, a thermistor 63 is provided; in a section opposing to the pressure roller 62, a thermistor 64 is provided. The temperature control section 42 is arranged to control the amount of power to each of the heater lamps 65 and 66, based on temperature detection results of the fixing roller 61 and the pressure roller 62 which temperature detection results are obtained by the thermistors 63 and 64. The temperature control method may be, for example, the same method as the temperature control method for the heating member 32 and the heater lamp 36.

The configurations of the fixing roller 61 and the pressure roller 62 are not specifically limited, and may be a fixing roller and a pressure roller each conventionally used in a fixing device of a heat roller fixing system. In the present embodiment, as the fixing roller 61 and the pressure roller 62, three layer structure rollers are used. In each of the three layer structure rollers, a core metal, an elastic layer and a release layer are formed in this order from an inner side. A material of the core metal may be, for example, metal such as iron, stainless steel, aluminum or copper, or an alloy thereof. A material of the elastic layer may be rubber material such as silicone rubber or fluorine rubber, which rubber material has heat resistance. Further, a suitable material of the release layer is fluorine resin such as PFA and PTFE.

Between the fixing devices 30 and 60, a guide member 70 such as a carrying guide plate or a carrying roller is provided. Recording paper P having been subjected to first fixation in the fixing device 30 is carried along the guide member and subjected to a second fixing process in the fixing device 60 and then outputted.

Further, in a case where the recording material is thin or in a case where it is desired to carry out the fixing process quickly, a direction in which the recording material having been subjected to the first fixing process by the fixing device 30 is carried may be switched by the guide member 70. Then the paper material may be carried to a roundabout route for outputting the paper material not via the fixing device 60, and subsequently outputted to the outside of the fixing device 30*c* by a plurality of carrying rollers 71*a* and 71*b* provided in this roundabout route.

Note that the heating means for heating each of the fixing roller 61 and the pressure roller 62 is not limited to a heater lamp. It is also possible to use as the heating means, (i) heating means of an induction heating system utilizing induction heating or (ii) an appropriate combination of a heater lamp and heating means of the induction heating system.

Figure 21:
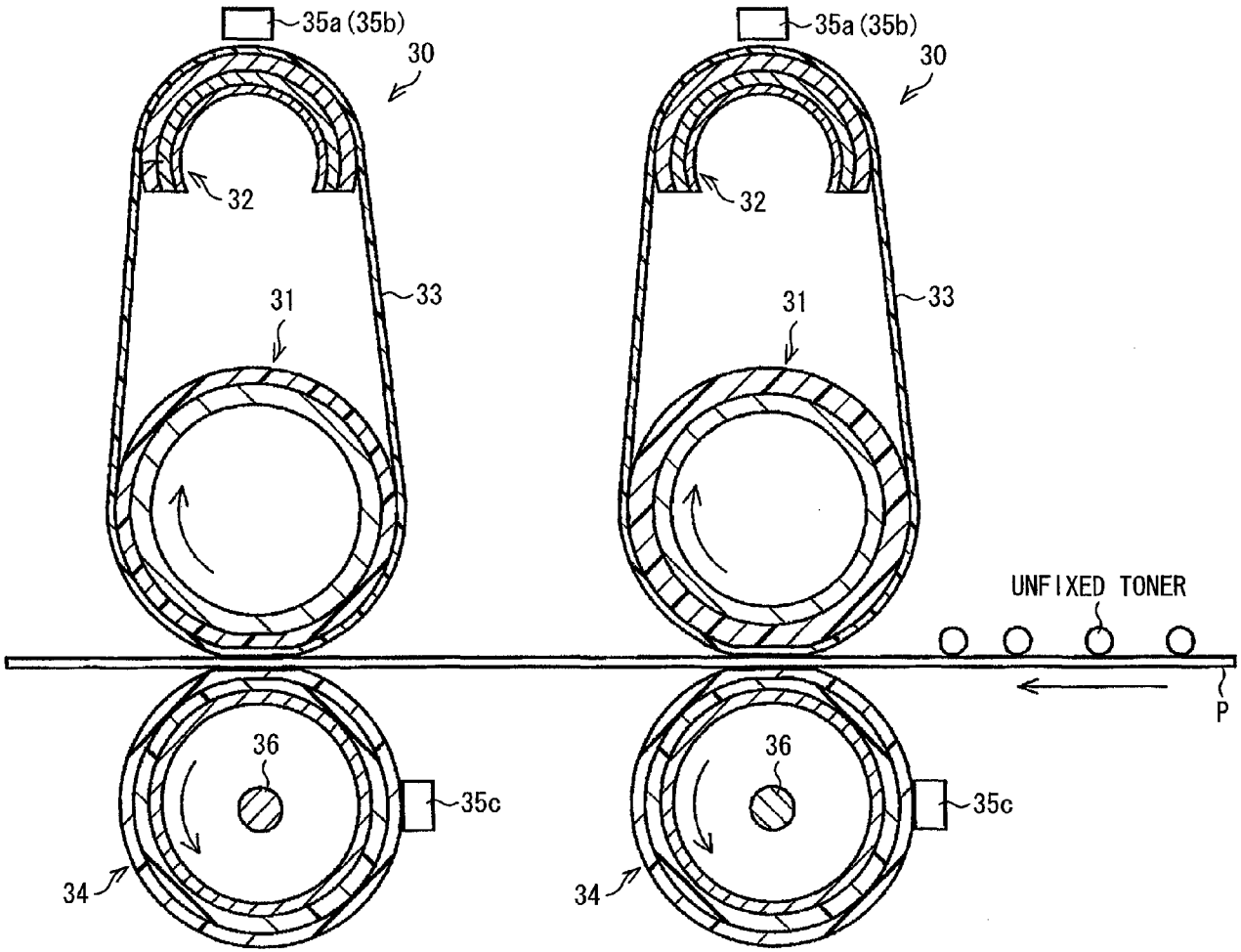
FIG. 21

Further, in place of the fixing device 60, it is also possible to use a fixing device 30*d* including the fixing device 30. That is, as shown in FIG. 21, it is possible to employ a configuration including two sets of the fixing device 30.

In a configuration in which a fixing device of a two-stage fixing system as described above is used, a heat capacity of each fixing device can be smaller. Therefore, it becomes possible to improve responsiveness to heat and thereby to rapidly perform the fixing process. Further, by applying the temperature control method according to the present embodiment, a temperature ripple can be reduced.

In each embodiment described above, as a pressure member, the pressure roller 34 is used. However, the present invention is not limited to this. For example, it is also possible to use a fixing device of a twin belt fixing system, as shown in FIG. 22, in which a pressure belt is used as the pressure member.

Figure 22:
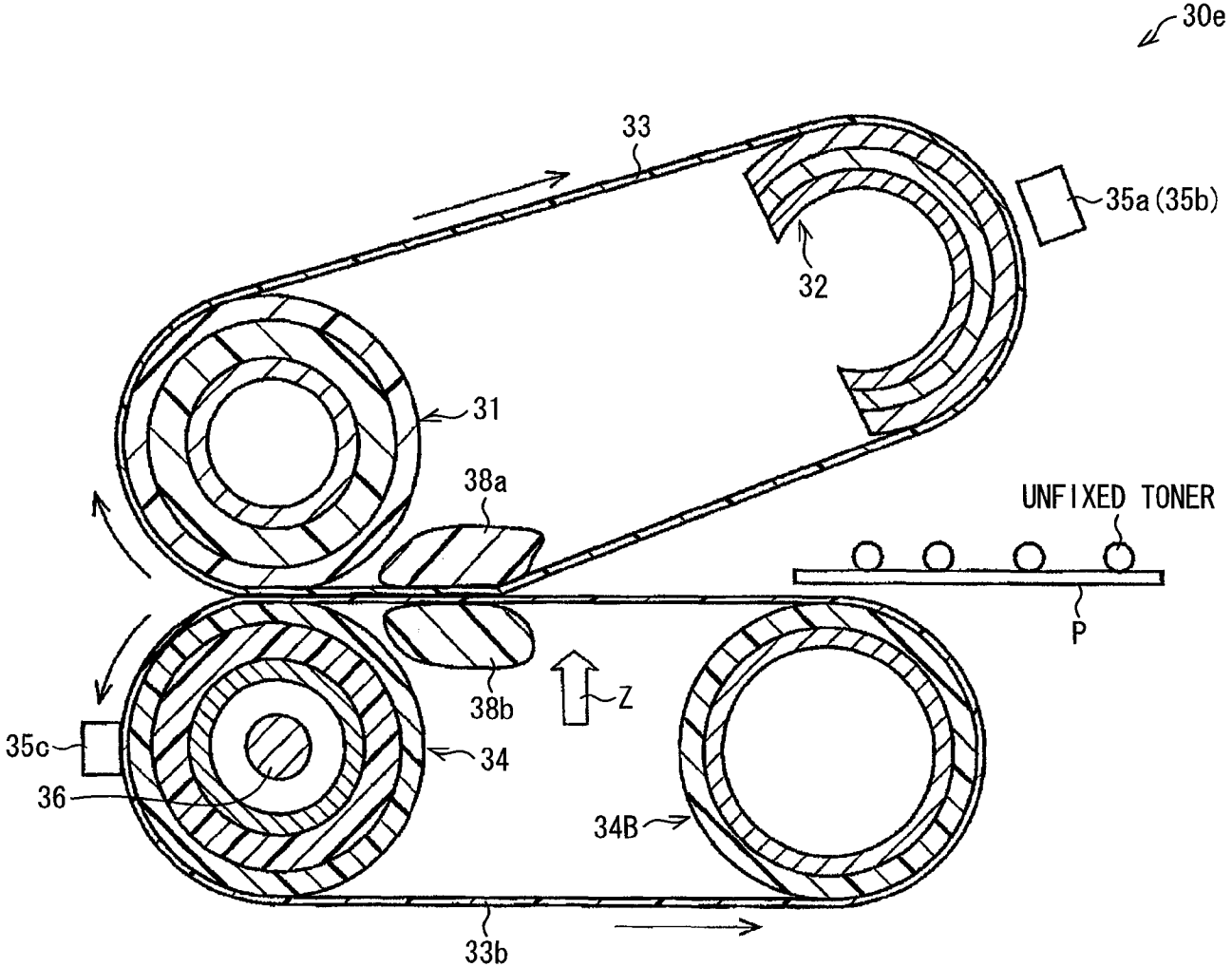
FIG. 22

A fixing device 30*e* of FIG. 22 includes a fixing roller 31, a heating member 32, a fixing belt 33, a fixing pad 38*a*, a pressure roller 34, a support roller (tension roller) 34B, a pressure belt 33*b*, and a pressure pad 38*b*. The fixing belt 33 is rotatably provided over the fixing pad 38*a*. The pressure belt 33*b* is rotatably provided over the pressure pad 38*b*. Note that thermistors 35*a* and 35*b* detects surface temperatures of the fixing belt 33 and transmits the surface temperatures to the temperature control section 24. A thermistor 35*c* detects a surface temperature of the pressure belt 33*b* and transmits the surface temperature to the temperature control section 42. The temperature control section 42 is arranged to control the amount of power to each of the heating member 32 and the heater lamp 36 according to the same method as in Embodiment 1.

Further, the fixing pad 38*a* and the pressure pad 38*b* are provided so as to press against each other at a predetermined load via the fixing belt 33 and the pressure belt 33*b*, on an upstream side in a recording material carrying direction with respect to a position where the fixing roller 31 and the pressure roller 34 press against each other via the fixing belt 33 and the pressure belt 33*b*. As a result, a fixing nip area is formed in a wide area from a section where the pads 38*a* and 38*b* are opposed to each other to a section where the fixing roller 31 and the pressure roller 34 are opposed to each other. This makes it possible to efficiently heat a sheet of recording material P being carried.

A pressure between the fixing pad 38*a* and the pressure pad 38*b* is set so as to be smaller than a pressure between the fixing roller 31 and the pressure roller 34. Accordingly, in this configuration, in a section where the fixing roller 31 and the pressure roller 34 are opposed to each other in an end section of the fixing nip area on a downstream side of the fixing nip area, pressure distribution in the recording material carrying direction becomes maximum. As a result, it becomes possible to prevent a slip at the time when the fixing belt 33 and the pressure belt 33*b* rotate.

As the fixing roller 31, the heating member 32, the fixing belt 33, and the pressure roller 34, those of Embodiment 1 can be used. Further, as the pressure belt 33*b*, the same belt as the fixing belt 33 can be used.

A material of which the fixing pad 38*a* and the pressure pad 38*b* are made can be, for example, PPS (polyphenylene sulfide resin).

The configuration of the support roller 34B is not specifically limited, but it is preferable to use a roller having a low heat conductivity. In the present embodiment, the support roller 34B is a roller member obtained by providing a silicone sponge layer around a core metal, made of iron alloy, which core metal has an outer diameter of 30 mm and an inner diameter of 26 mm.

Note that in a case where the fixing nip area is formed by the fixing pad 38*a* and the pressure pad 38*b* which are not a rotating member, inner peripheral surfaces of the fixing belt 33 and the pressure belt 33 are rubbed by the respective pads. As a result, a sliding resistance becomes large if friction coefficients between the inner peripheral surface of the fixing belt 33 and the pad 38*a* and between the inner peripheral surface of the pressure belt 33*b* and the pad 38*b* are large. This causes a problem such as displacement of an image, damage to a gear, and increase in power consumption of a drive motor. This problem is particularly noticeable in the twin belt system. In order to solve this problem, a contact surface of the fixing pad 38*a* onto the fixing belt 33 and a contact surface of the pressure pad 38*b* onto the fixing belt 33*b* is provided with a low friction sheet layer. This makes it possible to prevent the fixing pad 38*a* and the pressure pad 38*b* from being worn out due to rubbing between the fixing pad 38*a* and the fixing belt 33 and rubbing between the pressure pad 38*b* and the pressure belt 33*b*. Further, the sliding resistance can also be reduced. This makes it possible to obtain a preferable running property and durability of the belts 33 and 33*b*.

By applying the temperature control method of the present invention to the fixing device of the twin belt system, a temperature ripple can be reduced.

[Embodiment 3]

The following explains another embodiment of the present invention. Note that for convenience of explanation, members respectively having identical functions as members of Embodiment 1 are given the same reference signs as the members of Embodiment 1, respectively and explanations thereof are omitted.

Note that the present embodiment explains a case where the fixing device 30 as shown in FIG. 30 is used and a table A shown in FIG. 24 is used as an output setting table.

The table A is set on assumption that an image is formed under conditions such that an environmental temperature is in a range of 15° C. to 18° C. and recording material is thick (e.g., 90 g/m$^2$ by weight). This output setting table is set so that an amount of power to be supplied is largely increased in a case where a first detected temperature is lower temperature to a large extent than a control target. Thereby, the first detected temperature reaches the control target temperature. However, due to a change in external disturbance factor such an environmental temperature, a temperature of recording material, a water content of recording material and a power supply voltage, variation in performance of each apparatus, and/or the like, an amount of heat supplied by the heating member 32 may become insufficient and as a result the first detected temperature may only reach a temperature that is lower than the control target temperature by approximately 1° C. to 3° C.

That is, in a case where the amount of power to the heating member 32 is controlled only based on the output setting table set in advance, it may not be possible to cause the temperature of the fixing belt 33 to reach the control target temperature or to keep the temperature of the fixing belt 33 at the control target temperature, for example, due to a change in external disturbance factor such as an environmental temperature, a temperature of recording material, a water content of recording material and a power supply voltage, variation in performance of each apparatus, and/or the like.

In such a case, it may be possible to change an output setting table and use the output setting table thus changed. However, in such a case, an appropriate temperature control may not be performed under other condition. Consequently, a temperature ripple may occur.

In order to solve such a problem, in the present embodiment, when such a problem occurs, the amount of power to the heating member 32 which amount is calculated based on the output setting table is corrected in accordance with an elapsed time from a time when the amount of power to be supplied to the heating member 32 is previously set, the number of sheets printed (the number of sheets of recording material on which a fixing process is performed) from a time when the amount of power to be supplied to the heating member 32 is previously set, and/or the like.

Figure 32:
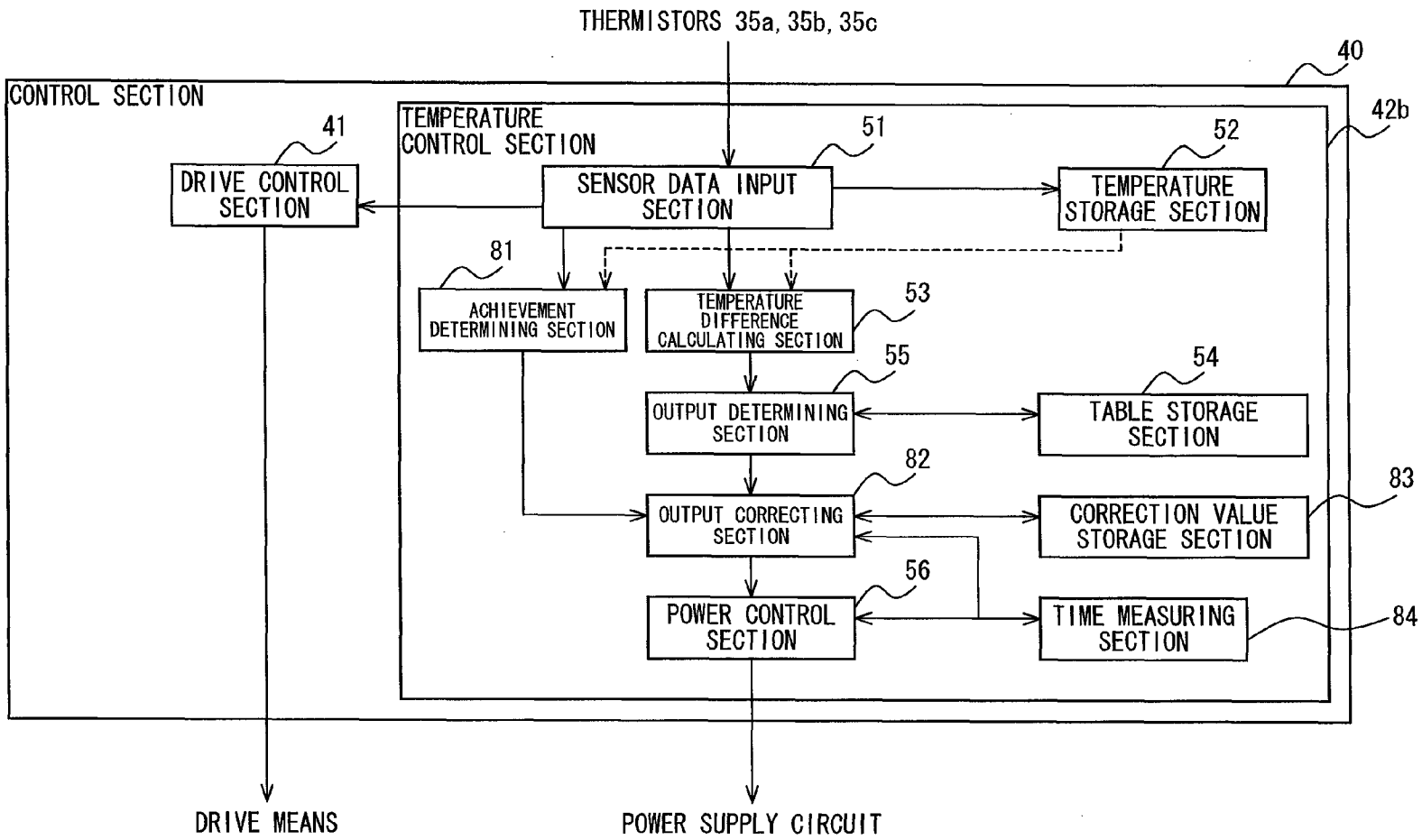
FIG. 32

FIG. 32 is a block diagram of a temperature control section 42*b* that is provided in place of a temperature control section 42 of Embodiment 1, in an image forming apparatus 100 of the present embodiment. As shown in FIG. 32, the temperature control section 42*b* includes an achievement determining section 81, an output correcting section 82, a correction value storage section 83, and a time measuring section 84, in addition to a configuration of the temperature control section 42 (see FIG. 3) in Embodiment 1.

The achievement determining section 81 determines whether or not the first detected temperature has reached the control target temperature and whether or not a state in which the first detected temperature is higher than a control target temperature continues for a predetermined time or more.

The correction value storage section 83 stores a correction value table that is a table for determining a correction value (correction rate) for correcting the amount of power set by an output determining section 55 based on the output setting table.

The output correcting section 82 corrects the amount of power set by the output determining section 55 based on the output setting table. This correction is carried out based on a correction value table stored in the correction value storage section 83.

The time measuring section 82 measures an elapsed time from the start of power supply to the heating member 32 or an elapsed time from a time when a predetermined time elapses in a state in which the temperature of the fixing belt 33 is below or above the control target temperature.

Figure 33:
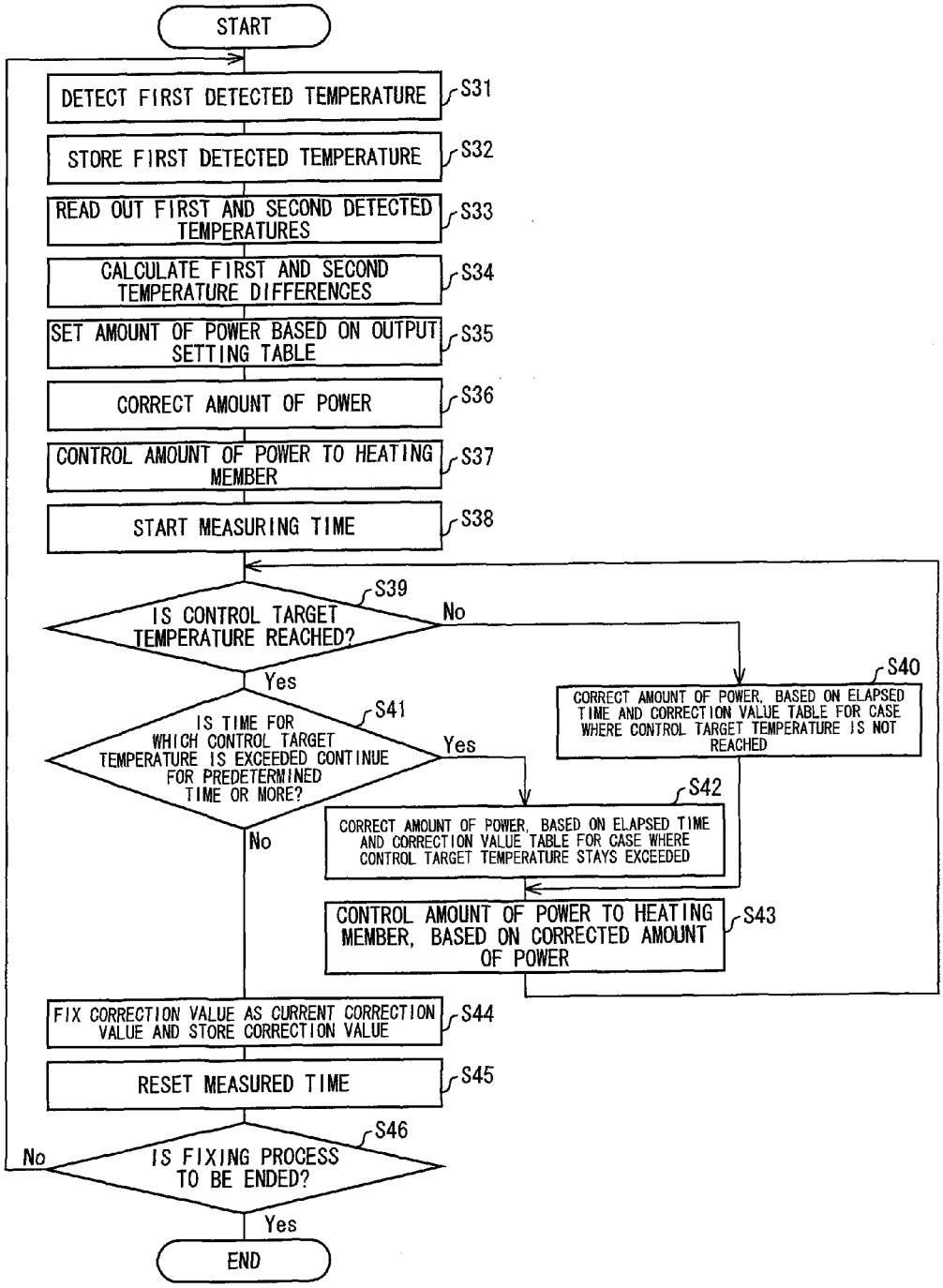
FIG. 33

FIG. 33 is a flowchart showing a temperature control process of the heating member 32. This temperature control process is performed by the temperature control section 42*b*.

First, a sensor data input section 51 accepts a detection signal from a thermistor 35*a* and detects a first detected temperature based on this detection signal (S31). Then, the sensor data input section 51 causes the temperature storage section 52 to store the detected first detected temperature (S32). Then, a temperature difference calculating section 53 reads out, from the temperature storage section 52, the first detected temperature and a second detected temperature (S33). Then, the temperature difference calculating section 53 calculates a first temperature difference and a second temperature difference based on these detected temperatures (S34) and sends the first temperature difference and the second temperature difference to an output determining section 55. The output determining section 55 sets the amount of power to the heating member 32, based on a combination of the first temperature difference and the second temperature difference each calculated by the temperature difference calculating section 53 and the output setting table stored in the table storage section 54.

Subsequently, the output correcting section 82 corrects the amount of power set by the output determining section 55, based a correction value stored then in the correction storage section 83 (S36). Note that at an initial state, the correction value is set to 0. Accordingly, the output correcting section 82 does not correct the amount of power set by the output determining section 55 but keeps the amount of power as it is. Further, in a case where the amount of power is corrected in S40 or S42 described later, the correction value set in S40 or S42 is stored in the correction value storage section 82. Then, the output correcting section 82 corrects the amount of power set by the output determining section 55, based on this correction value.

Next, a power control section 56 controls an operation of heat source drive means 45, based on the amount of power corrected by the output correcting section 82. By this control, the power control section 56 controls the amount of power supplied to the heating member 32 from a power supply circuit 43 (S37). Further, at this time, the time measuring section 84 starts measurement of an elapsed time (S38).

Next, the achievement determining section 81 determines whether or not the first detected temperature has reached the control target temperature (S39).

In a case where the first detected temperature is determined not to have reached the control target temperature, the output correcting section 82 reads out a correction value in accordance with an elapsed time (an elapsed time for which the first detected temperature stays below the control target temperature) measured by the time measuring section 84. The correction value is read out from a correction value table for a case where the temperature has not reached the control target temperature which correction value table is stored in the correction value storage section 83. Then, the output correcting section 82 corrects, based on this correction value, the amount of power which amount is set by the output determining section (S40).

FIG. 34(*a*) shows an example of a correction value table for a case where the temperature is below the temperature control target. This correction table is stored in the correction value table storage section 83. In the example shown in FIG. 34(*a*), a corrected amount of power to be supplied is set to a value that is obtained by adding, to the amount of power set by the output determining section 55, a value obtained by multiplying the amount of power set by the output determining section 55 by a correction value in accordance with an elapsed time (the correction value is 5% in a case where the elapsed time is less than 10 seconds; 10% in a case from 10 seconds to less than 15 seconds; 15% in a case from 15 seconds to less than 20 seconds; 20% in a case from 20 seconds to less than 25 seconds; 25% in a case from 25 seconds to less than 30 seconds; and 30% in a case over 30 seconds).

Meanwhile, in a case where the first detected temperature is determined to have reached the control target temperature in S39, the achievement determining section 81 determines whether or not a state in which the first detected temperature is above the control target temperature (or a predetermined temperature set at a temperature higher than the control target temperature) continues for a predetermined period or more (S41). This is determined based on a record of past first detected temperatures stored in the temperature storage section 20 and a current first detected temperature detected by a thermistor 35*a*.

Then, in a case where it is determined that the state where the first detected temperature is above the control target temperature continues for a predetermined period or more, the output correcting section 82 reads out a correction value in accordance with an elapsed time measured by the time measuring section 84 (an elapsed time after a predetermined period elapses in a state where the first detected temperature is above the control target temperature). The correction value is read out from the correction value table stored in the correction value storage section 83 for a case where the first detected temperature is above the control target temperature. Then, based on this correction value, the output correcting section 82 corrects the amount of power set by the output determining section 55 (S42).

Then, when the amount of power is corrected in S40 or S42, the power control section 56 controls the amount of power to the heating member 32, based on the corrected amount of power (S43), and then returns to a process of the step S39.

Meanwhile, in a case where it is determined that a state where the first detected temperature is above the control target temperature has not continued for a predetermined period or more, the output correcting section 82 causes the correction value storage section 83 to store a correction value employed then (S44) and the time measuring section 84 resets a measured time (a measurement value of an elapsed time) (S45).

Subsequently, the temperature control section 42 determines whether or not to end a fixing process (S46). In a case where the fixing process is not to be ended, the steps from S31 are repeated.

As described above, in the present embodiment, in a case where the first detected temperature is below the control target temperature or a state in which the temperature is above the control target temperature continues, the amount of power to the heating member 32 set based on the output setting table is corrected. Here, the amount of power is corrected in accordance with an elapsed time after the image forming apparatus turns to be in such a state. This makes it possible to perform stable temperature control, even in a case where an insufficient output occurs due to an external factor or difference in performance of each apparatus. As a result, the occurrence of defective fixing or a defect in an image can be prevented.

Note that in the present embodiment, the amount of power to the heating member 32 which amount is set based on the output setting table is corrected, in accordance with a time elapsed in a state where the first detected temperature is below the control target temperature or in a state where the first detected temperature is above the control target temperature. However, the present invention is not limited to this. For example, the amount of power to the heating member 32 which amount is set based on the output setting table may be corrected in accordance with the counted number of sheets of recording material onto which a fixing process is performed in a state where the first detected temperature is below the control target temperature or a state where the temperature is above the control target temperature.

Further, in the present embodiment, the correction value of the amount of power is set to 0 at an initial state. However, the present invention is not limited to this. For example, (i) a record of conditions such as environmental temperature and humidity, contents of an image forming operation (printing operation), and the like may be stored together with (ii) a correction value with which appropriate temperature control could be performed under the conditions. Here, the record of conditions is stored in association with the correction value. Then, in a case where an image forming operation is subsequently carried out under identical conditions, the correction value stored may be used as an initial value for carrying out correction.

For example, by providing a power supply voltage monitoring section (not shown) for monitoring a power supply voltage, correction can be performed at the time when a power supply voltage is changed. The correction is performed by using, as an initial value, a correction value that was used at an identical power supply voltage for past temperature control that was appropriately completed. This makes it possible to perform stable temperature control even at an initial stage of the start of an operation.

Note that the correction tables shown in FIGS. 34(*a*) and 34*b* are merely examples. The correction values may be changed as appropriate in accordance with the number of set correction values, the number of classifications of levels of elapsed times, and respective elapsed times.

FIG. 34(*c*) shows a modified example of a correction value table for a case where the temperature is below the control target temperature. In the example shown in FIG. 34(*c*), the amount of power to the heating member 32 is set to a value obtained by adding, to the amount or power set by the output determining section 55, (a) 20% of the amount of power in a case where a time elapsed in a state where the temperature is below the control target temperature is less than 20 seconds, (b) 40% of the amount of power in a case where a time elapsed in a state where the temperature is below the control target temperature is from 20 seconds to less than 30 seconds, or (c) 50% of the amount of power in a case where a time elapsed in a state where the temperature is below the control target temperature is from 30 seconds to less than 40 seconds. Further in a case where the time elapsed in such a state is 40 seconds or more, the maximum value of power (output 100%) that is suppliable to the heating member 32 is set as the amount of power to the heating member 32. However, there may still be a case where the temperature does not reach the control target temperature, even when a predetermined time elapses after setting of the amount of power to the heating member 32 at the maximum value of power that is suppliable to the heating member 32. In such a case, the image forming apparatus 100 may be arranged to once stop an operation and to notify a user that there is possibility of abnormality or breakdown.

[Embodiment 4]

The following explains another embodiment of the present invention. Note that the present embodiment explains a case where the fixing device 30 shown in FIG. 3 is used. Accordingly, for convenience of explanation, members respectively having identical functions as members of Embodiment 1 are given the same reference signs as the members of Embodiment 1, respectively and explanations thereof are omitted.

Embodiment 3 mainly explains a configuration for preventing a state in which the temperature does not reach the control target temperature from continuously occurring. The present embodiment further develops a technique of Embodiment 3 and explains a configuration for preventing a case where a temperature ripple cannot be sufficiently prevented by use of a single output setting table because of the frequent occurrence of a temperature that exceeds or does not reach the control target temperature or because of too large change in external disturbance.

In the above embodiments, an output setting table is set so that: (a) by controlling an amount of power in consideration of a first temperature difference, an operation is arranged to reduce overshoot (that is, a case where a temperature of a member to be heated becomes higher than the control target temperature) or undershoot (that is, a case where a temperature of a member to be heated becomes lower than the control target temperature) by increasing or decreasing an output in a case where the temperature comes close to the control target temperature; and (b) the amount of power is controlled in consideration of a second temperature difference so that a trend of a temperature change is grasped and an output is changed.

The adjustment of the former (a) of an output value (an amount of power to the heating member 32) in accordance with the first temperature difference provides a similar effect mainly to a proportional control (P control) while the adjustment of the latter (b) of the output value in accordance with the second temperature difference provides a similar effect mainly to a derivative operation (D operation). Accordingly, by controlling the output value by use of such an output setting table, it is possible to obtain a similar effect as that of proportional-derivative control (PD control). However, only by such control, a steady-state deviation may occur with respect to the control target temperature, for example, in a case where an output is a little insufficient, a load is a little too heavy or an output is a little too large.

In order to solve this problem, in the present embodiment, an output value obtained from the output setting table is sequentially corrected in accordance with a state of a change in temperature then. Thereafter, an output value obtained from the output setting table is flexibly adjusted so as to rapidly cause a temperature of a fixing belt 33 to reach and converges to the control target temperature by eliminating the steady-state deviation.

Figure 35:
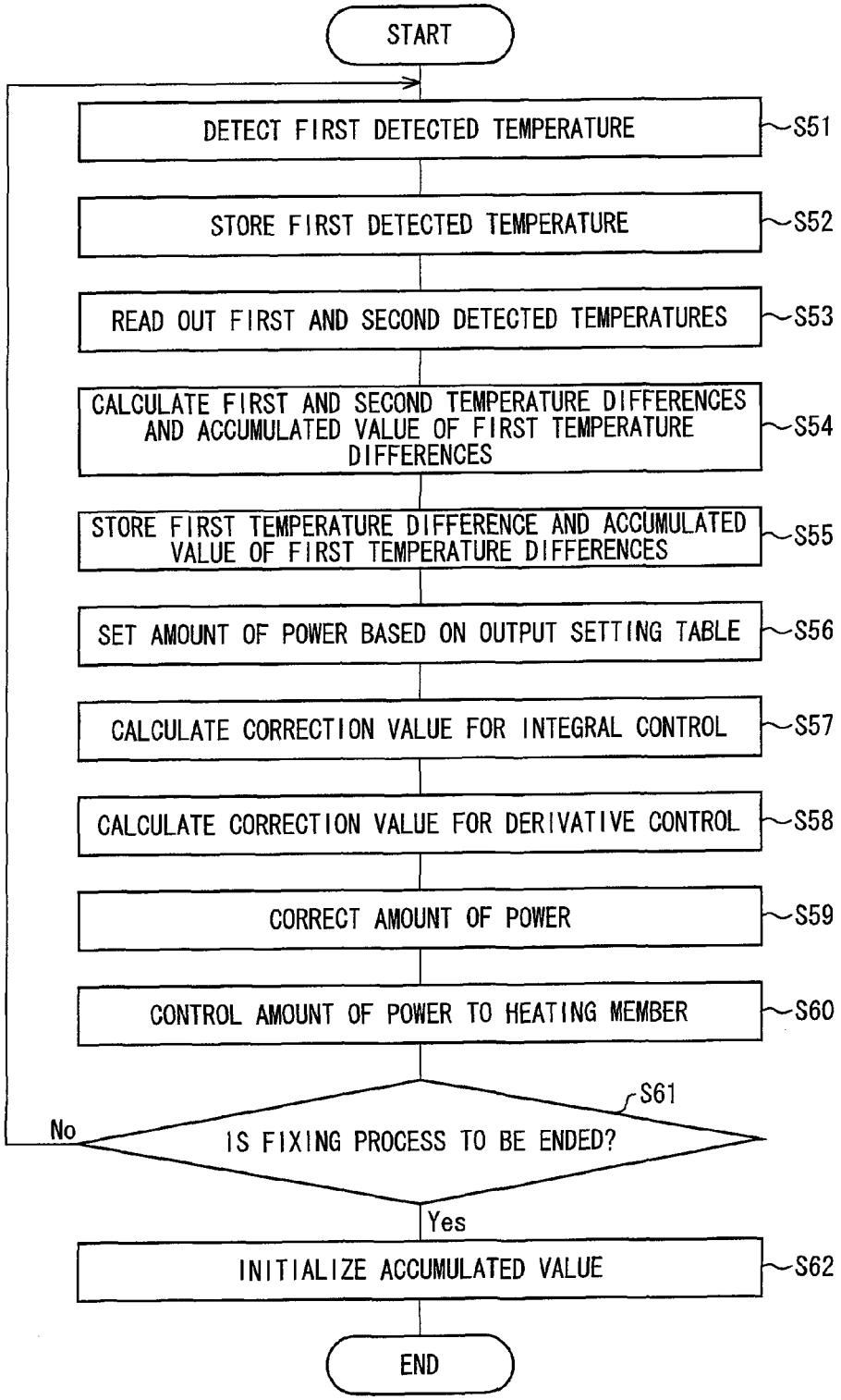
FIG. 35

FIG. 35 is a flowchart showing a flow of a temperature control process for the heating member 32 by a temperature control section 42 of the present embodiment.

First, a sensor data input section 51 accepts a detection signal from a thermistor 35*a*. Based on this detection signal, the sensor data input section 51 detects the first detected temperature (S51) and then causes a temperature storage section 52 to store the detected the detected first detected temperature (S52).

Next, a temperature difference calculating section 53 reads out, from the temperature storage section 52, the first detected temperature, a second detected temperature and a first-temperature-difference accumulated value of first temperature differences up to a point where the last first temperature difference was calculated (S53). Then, the temperature difference calculating section 53 calculates the first temperature difference the second temperature difference based on the first and second detected temperatures, and the first-temperature-difference accumulated value accumulated value obtained by adding the currently calculated first temperature difference (S54). Then, the temperature difference calculating section 53 causes the temperature storage section 52 to store the first temperature difference and the first-temperature-difference accumulated value (S55). The temperature difference calculating section 52 also outputs, to an output determining section 55, the first temperature difference, the second temperature difference, and the first-temperature-difference accumulated value.

Note that in the present embodiment, in a period from a time when an image forming operation (printing operation) is started to a time when the image forming operation ends, the steps of calculating the first-temperature-difference accumulated value and storing the first-temperature-difference accumulated value into the temperature storage section 52 are continuously performed. In a case where an image forming operation is interrupted before the image forming operation completes (e.g., in a case where the image forming operation is interrupted for adjustment of image quality or the like), accumulation of the first temperature difference may be continued in such an interruption period. Alternatively, the accumulation may be once stopped in such a period, and then calculation and storage of the first-temperature-difference accumulated value may be resumed when printing is restarted.

Next, the output determining section 55 reads out, from a first output setting table stored in the table storage section 54, an amount of power corresponding to a combination of the first temperature difference and the second temperature difference each of which is calculated by the temperature difference calculating section 53.

Further, the output determining section 55 calculates a correction value (a correction value for eliminating the steady-state deviation) for integral control, based on the first-temperature-difference accumulated value (S57). Further, the output determining section 55 calculates a correction value (a correction value at which fluctuation converges) for derivative control, based on a difference between the first temperature deviation last calculated and the first temperature deviation presently calculated (S58).

More specifically, the correction value for integral control is calculated by the following formula:

"correction value for integral control=integration constant×(−1)×Σ(first temperature difference)".

Note that Σ (first temperature difference) indicates a first-temperature-difference accumulated value. The first-temperature-difference accumulated value is multiplied by −1 so that the first-temperature-difference accumulated value is converted to a value whose sign is opposite to a positive or negative sign of the first-temperature-difference accumulated value. That is, if the first temperature difference is positive, the correction value is set to a negative value; if the first temperature difference is negative, the correction value is set to a positive value. This is for allowing the first detected temperature to converge to the control target temperature. In other words, in a case where the steady-state deviation occurs between the first detected temperature and the control target temperature, correction is carried out by applying a correction value whose sign is opposite to a negative or positive sign of the steady-state deviation so that the temperature comes closer to the control target temperature. Further, the integration constant (first constant) is set in advance based on experiments or the like by using an image forming apparatus that is to be controlled.

The correction value for derivative control is calculated by the following formula:

"correction value for derivative control=derivative constant×(current first temperature difference−last first temperature difference)=derivative constant×(second detected temperature−first detected temperature)=derivative constant×(last first detected temperature−current first detected temperature)".

Note that the derivative constant (second constant) is set in advance based on experiments or the like by using an image forming apparatus that is to be controlled.

Then, an output determining section 56 corrects the amount of power set based on the output setting table in S56, by using the correction value for integral control which correction value is calculated in S57 and the correction value for derivative control which correction value is calculated in S58 (S59).

Figure 36:
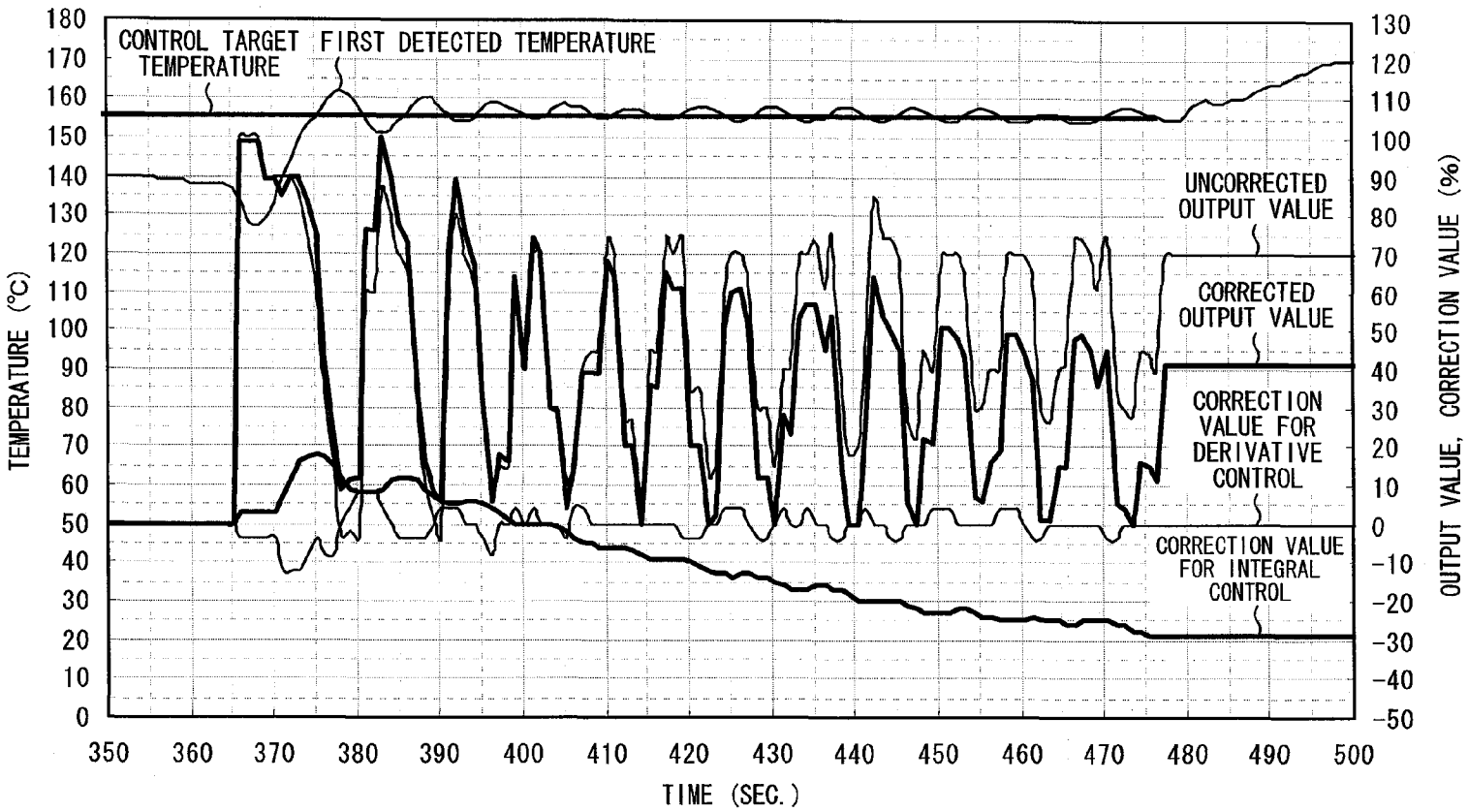
FIG. 36

FIG. 36 is a graph showing transition over time of the first detected temperature, the amount of power set based on the output setting table, the integral correction value, the derivative correction value, and a corrected amount of power, in a case where temperature control of the fixing belt 33 is performed according to the temperature control method of the present embodiment. More specifically, FIG. 36 is a graph showing a case where the temperature control is performed under the conditions such that: control target temperature is at 155° C.; an initial value of the first-temperature-difference accumulated value (first-temperature-difference accumulated value at the start of an image forming operation) is 0° C.; the integration constant is 0.2 (%/° C.); and the derivative constant is 4.1 (%/° C.).

For example, at a point of 370.1 second in FIG. 36, the last first detected temperature is 146° C.; the first-temperature-difference accumulated value of first temperature differences up to the last first temperature difference is −74° C.; the current first detected temperature is 149° C.; and the amount of power set based on the output setting table is 86% of the rated power.

Accordingly, the current first temperature difference is −6° C.=149° C.−155° C.; the first-temperature-difference accumulated value of first temperature differences up to the current first temperature difference is −80° C.=(−74° C.)+(−6° C.).

In such a case, the correction value for integral control is calculated as follows:

correction value for integral control=integration constant×(−1)×Σ(first temperature difference)=0.2×(−1)×(−80)=16%.

The correction value for derivative control is calculated as follows:

correction value for derivative control=derivative constant×(current first temperature difference−last first temperature difference)=4.1×(146−149)=−12.3%.

Accordingly, an amount of power (corrected amount of power) to be applied to the heating member 32 is set to a value obtained by adding, to the amount of power (86%) set based on the output setting table, the correction value (16%) for integral control and the correction value (−12.3%) for derivative control. That is, the (corrected) amount of power to be supplied to the heating member 32 is set to 89.7%.

Subsequently, a power control section 56 controls an operation of heat source drive means 45 based on the amount of power corrected by the output determining section 55 and thereby controls the amount or power supplied from the power source circuit 43 to the heating member 32 (S61).

Then, the temperature control section 42 determines whether or not to end the fixing process (S7). In a case where the fixing process is not to be ended, the steps from S51 are repeated.

Meanwhile, in a case where the fixing process is to be ended, the temperature control section 42 initialize the first-temperature-difference accumulated value which is stored in the temperature storage section 52 (S62), and then ends the fixing process.

Note that in the present embodiment, every time an image forming operation ends, the first-temperature-difference accumulated value is initialized and set back to 0. However, the configuration of the present invention is not limited to this. For example, it may be configured such that every time the image forming operation is initiated, the first-temperature-difference accumulated value is initialized. Alternatively, it may be arranged such that the first-temperature-difference accumulated value at the end of an image forming operation is stored and then, this first-temperature-difference accumulated value stored is used as an initial value at the start of a following image forming operation.

As described above, in the present embodiment, the amount of power determined based on the output setting table is corrected based on the correction value (correction value for integral control) in accordance with the first-temperature-difference accumulated value and the correction value (correction value for derivative control) in accordance with a difference between the current first temperature difference and the last first temperature difference.

In this way, the amount of power determined based on the output setting table is corrected by use of the correction value (correction value for integral control) in accordance with the first-temperature-difference accumulated value. This makes it possible to reflect, onto the correction value, an average degree of presence of the steady-state deviation as a result of past control, and thereby to set the amount of power for eliminating this steady-state deviation.

Further, the amount of power determined based on the output setting table is corrected by using the correction value (correction value for derivative control) in accordance with a difference between the current first temperature difference and the last first temperature difference. This makes it possible to apply a correction value whose sign is opposite to a positive or negative sign of a direction of a drastic change in a case where the drastic change occurs between the last first temperature difference and the current first temperature difference due to an external disturbance. Consequently, the first detected temperature can rapidly approach closer to the target control temperature.

Figure 37:
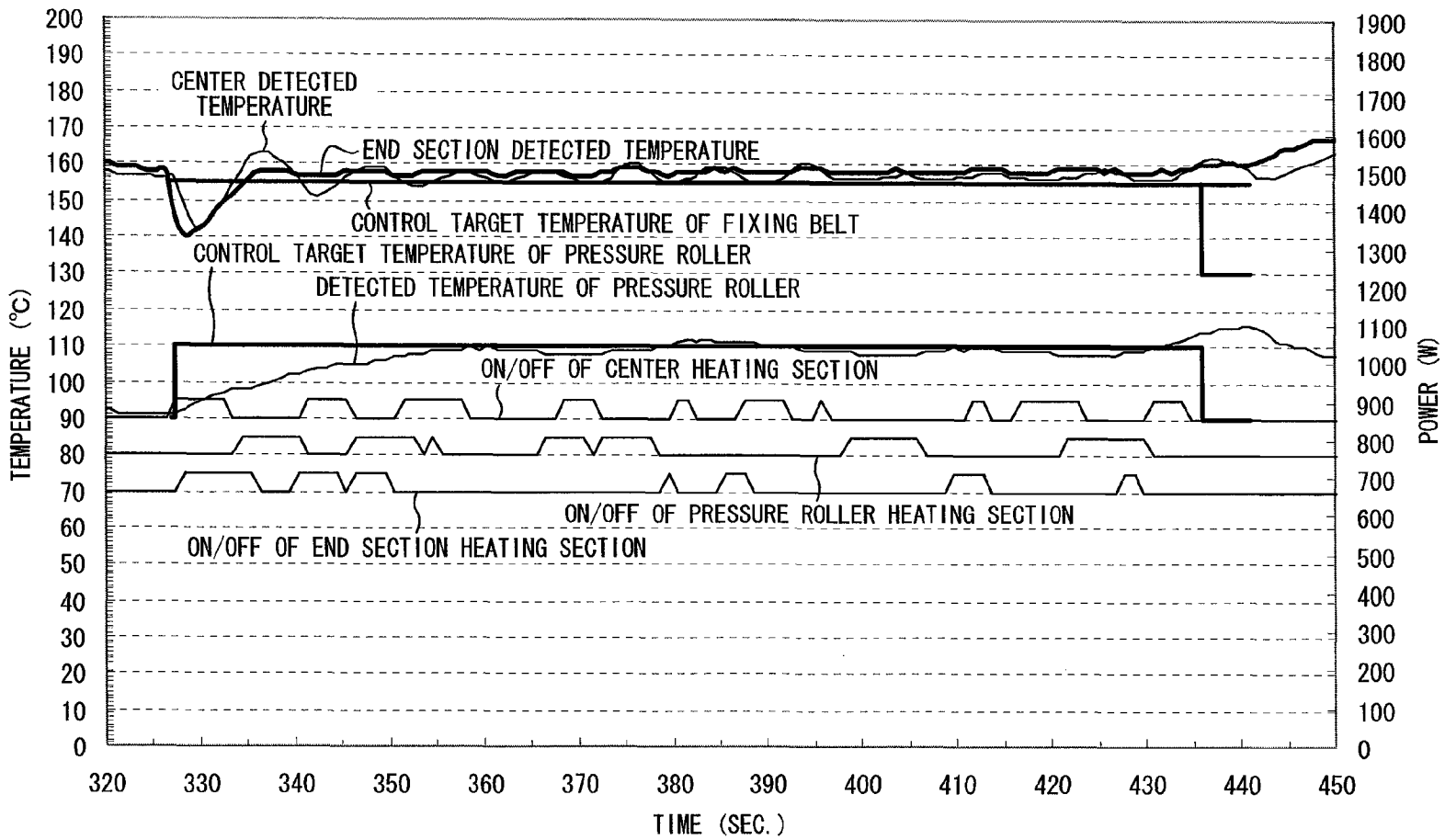
FIG. 37
Figure 38:
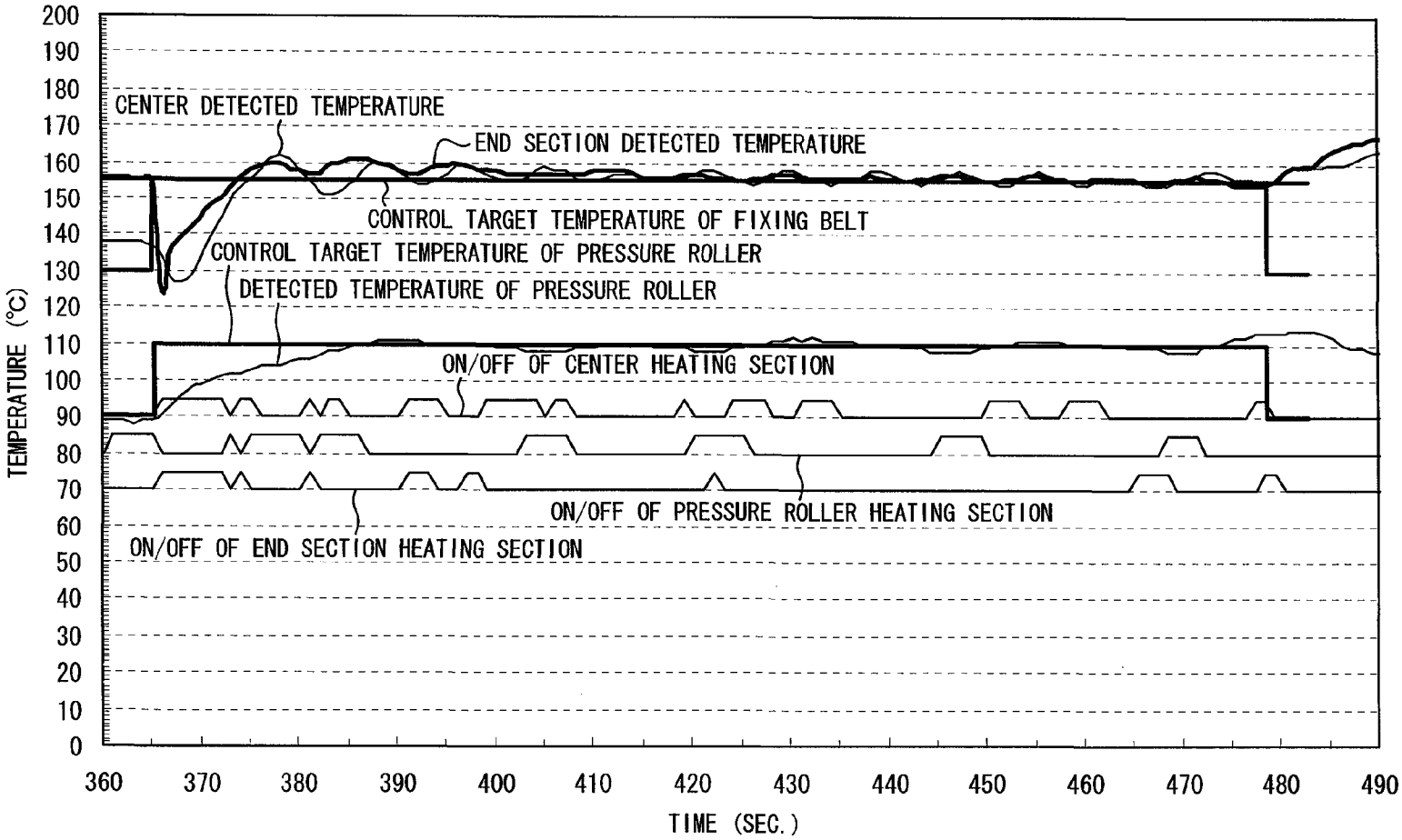
FIG. 38

FIG. 37 is a graph showing on/off states of heater lamps 133*a*, 133*b*, and 36 and temperature detection results obtained by thermistors 35*a*, 35*b*, and 35*c*, in a case where a temperature of each of the heater lamps 133*a*, 133*b*, and 36 in the fixing device 30*b* shown in FIG. 11 is controlled based on an amount of power set based on an output setting table. FIG. 38 is a graph showing on/off states of heater lamps 133*a*, 133*b*, and 36 and temperature detection results obtained by thermistors 35*a*, 35*b*, and 35*c*, in a case where a temperature of each of the heater lamps 133*a*, 133*b*, and 36 in the fixing device 30*b* shown in FIG. 11 is controlled based on an amount of power obtained by correcting an amount of power set based on an output setting table by using a correction value for integral control and a correction value for derivative control described above.

As is clear from FIGS. 37 and 38, by correcting, as in the present embodiment, the amount of power set based on the output setting table, control of each of the heater lamps can be individually optimized as compared to a case where the amount of power set based on the output setting table is directly used. As a result, the temperature of each of the fixing belt 33 and the pressure roller 34 can be controlled so that the temperature converges to the control target temperature.

That is, in the example of FIG. 37, a temperature ripple still occurs for a while directly after the start of an image forming operation and a steady-state deviation remains all the time. However, according to the temperature control method of the present embodiment, as shown in FIG. 38, the temperature ripple and the steady-state deviation can be suppressed.

In this way, by correcting the amount of power set based on the output setting table by using the correction value for integral control and the correction value for derivative control as in the present embodiment, it is possible to cause the temperature of a member whose temperature is to be controlled to come close to the control target temperature even in a case where only a single output setting table is used. Therefore, it becomes unnecessary to switch a plurality of output setting tables in accordance with conditions.

As compared to a normal PID control, in the present embodiment, a control specification may be roughly set in the output setting table. Then, in a case where a steady-state deviation or an external disturbance occurs, the temperature can be converged to the control target temperature by correction with the use of the correction value for integral control and the correction value for derivative control. As a result, without setting complex parameters, a detailed control model, or the like, preciseness of the temperature control can be improved.

Note that for example, in a case where a center heating section and an end section heating section are provided as in the fixing device 30*b* shown in FIG. 11, it may be configured to use a common output setting table for both of the center heating section and the end section heating section and to set the integration constant and the derivative constant separately for each of the center heating section and the end section heating section. This makes it possible to obtain the same effect as in a case where separate output setting tables are provided respectively for the center heating section and the end section heating section.

Further, it may be arranged to use a common output setting table for a heating member for heating the fixing belt 33 and a heating member for heating the pressure roller 34, and to set the integration constant and the derivative constant separately for each of the center heating section and the end section heating section. In addition, it may be arranged to use a common output setting table for a plurality of image forming apparatuses, like image forming apparatuses A to E described above, each having a different configuration, and further to set the integration constant and the derivative constant separately for each of the plurality of image forming apparatuses.

Furthermore, by combining Embodiment 3 and the present embodiment, the correction value calculated in Embodiment 3 and the correction value for integral control and the correction value for derivative control each calculated in the present embodiment may be used for performing temperature control. This makes it possible to further improve a temperature ripple suppressing effect.

In the above embodiments, the main control section of each of the image forming apparatuses 100 and A to E and the control section 40 of the fixing device 30 or 30*b* may be realized by software by using a processor such as a CPU. In such a configuration, each of the image forming apparatuses 100 and A to E and the fixing device 30 or 30*b* includes a CPU (central processing unit) that executes the order of a control program for realizing functions, a ROM (read only memory) that stores the control program, a RAM (random access memory) that develops the control program in an executable form, and a storage device (storage medium), such as memory, that stores the control program and various types of data therein. The object of the present invention can be achieved by a predetermined storage medium. The storage medium stores, in a computer-readable manner, program codes (executable code program, intermediate code program, and source program) of the control program of each of the image forming apparatuses 100 and A to E and the fixing device 30 or 30*b* of the present invention, which is software for realizing the aforesaid functions. The storage medium is provided to each of the image forming apparatuses 100 and A to E and the fixing device 30 or 30*b*. With this arrangement, each of the image forming apparatuses 100 and A to E and the fixing device 30 or 30*b* (alternatively, CPU or MPU) as a computer reads out and executes the program code stored in the storage medium provided.

The storage medium may be: tape based, such as a magnetic tape or a cassette tape; disc based, such as a magnetic disk including a Floppy® disc and a hard disk, and an optical disk including a CD-ROM, an MO, an MD, a DVD, and a CD-R; card based, such as an IC card (including a memory card) and an optical card; or a semiconductor memory, such as a mask ROM, an EPROM, an EEPROM, and a flash ROM.

Further, each of the image forming apparatuses 100 and A to E and the fixing device 30 or 30*b* of the present invention may be arranged so as to be connectable to a communications network so that the program code is supplied to each of the image forming apparatuses 100 and A to E and the fixing device 30 or 30*b* through the communications network. The communications network is not to be particularly limited. Examples of the communications network include the Internet, intranet, extranet, LAN, ISDN, VAN, CATV communications network, virtual private network, telephone network, mobile communications network, and satellite communications network. Further, a transmission medium that constitutes the communications network is not particularly limited. Examples of the transmission medium include (i) wired lines such as an IEEE 1394 cable, a USB cable, a power-line carrier, cable TV lines, telephone lines, and ADSL lines and (ii) wireless connections such as IrDA using infrared light, Bluetooth®, 802.11, HDR, mobile phone network, satellite connections, and terrestrial digital network. Note that the present invention can be also realized by the program codes in the form of a computer data signal embedded in a carrier wave which is embodied by electronic transmission.

Further, each of the main control section of each of the image forming apparatuses 100 and A to E and the control section 40 of the fixing device 30 or 30*b* is not necessarily realized by software but may be constituted by hardware logic. Alternatively, each of the main control section of each of the image forming apparatuses 100 A to E and the control section 40 of the fixing device 30 or 30*b* may be realized by a combination of (i) hardware performing a part of a process and (ii) computation means executing software performing (a) control of the hard ware and (b) a remaining part of the process.

As described above, a fixing device of the present invention includes: a fixing member; a pressure member; a heating member for heating the fixing member at a heat quantity corresponding to an amount of power supplied; and a temperature control section for controlling an amount of power to be supplied to the heating member, the fixing member and the pressure member being rotatably provided, the fixing member and the pressure member carrying recording material provided between the fixing member and the pressure member while sandwiching the recording material between the fixing member and the pressure member, the fixing member and the pressure member fixing, onto the recording material, an unfixed image formed on the recording material by heat and pressure while carrying the recording material, the control section including: a temperature detecting section for detecting a temperature of the fixing device; a temperature storage section for storing a temperature detection result obtained by the temperature detecting section; a temperature difference calculating section for calculating a first temperature difference and a second temperature difference, the first temperature difference being a difference between (a) a first detected temperature that is a current temperature of the fixing member which temperature is detected by the temperature detecting section and (b) a control target temperature of the fixing member, the second temperature difference being a difference between (a) the first detected temperature and (b) a past temperature of the fixing member which past temperature was detected by the temperature detecting section a predetermined time earlier than the current time; a table storage section for storing an output setting table in which a combination of the first temperature difference and the second temperature difference is associated with information for specifying the amount of power to be supplied to the heating member; an output determining section for reading out, from the output setting table, the information corresponding to the combination of the first temperature difference and the second temperature difference which are calculated by the temperature difference calculating section and for determining the amount of power to be supplied to the heating member based on the information; and a power control section for controlling an actual amount of power supplied to the heating member in accordance with the amount of power to be supplied to the heating member which amount is determined by the output determining section.

The above configuration includes the temperature detecting section for detecting a temperature of the fixing device and the temperature storage section for storing a temperature detection result obtained by the temperature detecting section. Then, the temperature difference calculating section calculates a first temperature difference and a second temperature difference. The first temperature difference is a difference between (a) a first detected temperature that is a current temperature of the fixing member which temperature is detected by the temperature detecting section and (b) a control target temperature of the fixing member; the second temperature difference is a difference between (a) the first detected temperature and (b) a past temperature of the fixing member which past temperature was detected by the temperature detecting section a predetermined time earlier than the current time. Subsequently, from an output setting table stored in the table storage section in which output setting table a combination of the first temperature difference and the second temperature difference is associated with information for specifying the amount of power to be supplied to the heating member, the output determining section reads out the information corresponding to the combination of the first temperature difference and the second temperature difference which are calculated by the temperature difference calculating section. The output determining section then determines the amount of power to be supplied to the heating member based on the information. Consequently, the power control section controls an actual amount of power supplied to the heating member in accordance with the amount of power to be supplied to the heating member which amount is determined by the output determining section.

In the configuration described above, the first temperature difference reflects how close to the control target temperature the temperature of the fixing device reaches; the second temperature difference reflects a trend of a change in the current temperature of the fixing member. Accordingly, in consideration of a degree of closeness to the control target temperature and the trend of the change in the current temperature, the amount of power to be supplied to the heating member can be appropriately controlled so that overheating or shortage of heating can be prevented. This makes it possible to reduce a temperature ripple. Consequently, it becomes possible to prevent winding of recording material onto the fixing member, hot offset, or a resultant coarse image each caused by excessive melting of toner or a defect in fixing caused by insufficient melting of toner. In addition, it is also possible to reduce power consumption. Further, as compared to a case where a PID control is performed, complex tuning in determining parameters for the PID control is not necessary. Therefore, it becomes possible to realize a fixing device capable of appropriately controlling an amount of power to be supplied to the heating member in a simple configuration.

Further, the fixing device may be configured such that: the temperature difference calculating section calculates a change rate that is an amount of change in the first temperature difference or the second temperature difference in each predetermined period; the output setting table stores a combination of the change rate, the first temperature difference, and the second temperature difference and the information so that the combination is associated with the information; and the output determining section reads out, from the output setting table, the information corresponding to the combination of the change ratio, the first temperature difference and the second temperature difference, and determines the amount of power to be supplied to the heating member based on the information, the first temperature difference and the second temperature difference being calculated by the temperature difference calculating section.

According to the above configuration, the change rate of the first difference temperature or the second difference temperature reflects a current trend of temperature change. Because an amount of power after the change is determined based on the change rate in addition to the first temperature difference and the second temperature difference, it is possible to more precisely control the temperature of the fixing member.

Further, the information stored in the output setting table may be information indicating, regardless of a current amount of power currently supplied to the heating member, a value of the amount of power to be supplied to the heating member.

In the above configuration, the value of the amount of power to be supplied to the heating member is directly set regardless of the current amount of power currently supplied to the heating member. This makes it possible to easily reflect data obtained by a preliminary experiment or the like on the output setting table. Further, the values stored in the output setting table can be easily adjusted and corrected. In addition, the output determining section can easily perform a process for determining the amount of power to be supplied to the heating member. Consequently, it is possible to shorten a time for steps up to the determination of the amount of power.

Further, the information stored in the output setting table may be information indicating a degree of change from a current amount of power currently supplied to the heating member.

For example, the fixing device may be arranged such that: the table storage section stores the output setting table and an output specifying table in which a level number of each of a plurality of levels is associated with a corresponding amount of power, the amount of power to be supplied to the heating member being classified into the plurality of levels in the order of amount; the output setting table is a level change value table in which a combination of the first temperature difference and the second temperature difference is associated with a level change value indicating an amount of change in level from a level corresponding to the current amount of power currently supplied to the heating member; and the output determining section (i) reads out, from the level change value table, the level change value corresponding to the combination of the first temperature difference and the second temperature difference each calculated by the temperature difference calculating section, (ii) specifies a level after a change, based on the level corresponding to the current amount of power currently supplied to the heating member and the level change value read out from the level change value table, and (iii) then, determines, as the amount of power to be supplied to the heating member, an amount of power corresponding to the level specified.

According to the above configuration, when power supply to the heating member is resumed, when temperature control is resumed after change on a temperature control condition of the fixing member, or the like, a reference amount of power indicative of an amount of power to be supplied to the heating member is adjusted or corrected. A result of the adjustment or correction can be reflected on subsequent temperature control. This makes it possible, for example, to easily perform a process for adjusting or correcting the amount of power to be supplied to the heating member, in accordance with a change in an environmental condition, a condition of recording material, or the like.

Further, the fixing device may be arranged such that: in a case where (i) the current amount of power currently supplied to the heating member is zero or equal to or less than a predetermined set value and (ii) a difference between the current amount of power and an amount of power specified by the information in the output setting table is equal to or more than a predetermined value which information corresponds to a combination of the first temperature difference and the second temperature difference, the output determining section changes the amount of power to be supplied to the heating member to a predetermined amount of power, the predetermined amount being set in advance so as to be greater than the amount of power specified by the information in the output setting table which information corresponds to the combination of the first temperature difference and the second temperature difference.

In the above configuration, it is possible to prevent deterioration in responsiveness of temperature control in a case where the amount of power supplied to the heating member shifts in a range of zero to the predetermined set value.

Further, the fixing device may be arranged such that: the table storage section stores an output direct setting table in which a combination of the first temperature difference and the second temperature difference is stored so as to be associated with information indicating, regardless of the current amount of power currently supplied to the heating member, an amount of power to be supplied to the heating member; in a case where the current amount of power currently supplied to the heating member is equal to or less than a predetermined set value, the output determining section determines an amount of power to be supplied to the heating member by reading out, from the output direct setting table, the information corresponding to the first temperature difference and the second temperature difference each calculated by the temperature difference calculating section; and in a case where the current amount of power currently supplied to the heating member is more than the predetermined set value, the output determining section (i) reads out, from the level change value table, a level change value corresponding to the combination of the first temperature difference and the second temperature difference each calculated by the temperature difference calculating section, (ii) specifies a level after a change, based on the level corresponding to the current amount of power currently supplied to the heating member and the level change value read out from the level change value table, and (iii) then, determines, as the amount of power to be supplied to the heating member, an amount of power corresponding to the level specified.

In the above configuration, it is possible to prevent deterioration in responsiveness of temperature control in a case where the amount of power supplied to the heating member shifts in a range of zero to the predetermined set value.

Further, the fixing device may be arranged such that: the information indicates a relative value with respect to a preset reference amount of power; the output determining section (i) reads out the relative value corresponding to a combination of the first temperature difference and the second temperature difference each calculated by the temperature difference calculating section, and determines, as the amount of power to be supplied to the heating member, an amount of power specified by the relative value read out and the reference amount of power; and in a case where an operation state or an environmental condition of the fixing device is changed, the output determining section corrects the reference amount of power in accordance with the operation state of the environmental condition which has been changed. Note that examples of a change in operation state of the fixing device are: transitions between states including a warming up state, a fixing processing state, a Ready state (a standby state in which a temperature of the fixing member is kept at a temperature of a control target temperature in a fixing process or a temperature close to the control target temperature so that a fixing process can be immediately started), a cooling state (a state where a temperature of the fixing member is set at a temperature that is lower than a temperature in the Ready state) and the like state, or a change in the control target temperature of the fixing member. The control target temperature may be changed, for example, when a predetermined time elapses after a transition from one state to another among from the above states, when a fixing process is performed on a predetermined number of sheets after the start of the fixing process, when a type (thickness, weight, or the like) of a recording material is changed, or when a mode change is performed between a color mode and a monochrome mode. The environmental condition may be, for example, an environmental temperature or an environmental humidity.

According to the above configuration, in a case where an operation state or an environmental condition of the fixing member is changed, the temperature of the fixing member can be appropriately controlled only by changing the reference amount of power, in accordance with an operation state or an environmental condition after the change.

Further, the fixing device may be arranged such that: the output setting table is plurally stored in the storage section so that there are a plurality of output setting tables; and the output determining section selects one output setting table from among the plurality of output setting tables, in accordance with an operation state or an environmental condition of the fixing device, the one output setting table being for use in determination of the amount of power to be supplied to the heating member.

In the above configuration, a plurality of output setting tables are stored in consideration of operation conditions or environmental conditions of the fixing device. This makes it possible to more appropriately determine the amount of power to be supplied to the heating member in accordance with an operation condition or an environmental condition of the fixing device. Further, because it is required only to store the plurality of output setting tables, it is possible to more appropriately determine the amount of power to be supplied to the heating member without causing complication in a device configuration or a cost increase.

Further, the fixing member may be arranged such that: the output determining section corrects, in accordance with an operation state or an environmental condition of the fixing device, the amount of power specified by the information read out from the output setting table; and the power control section controls the actual amount of power supplied to the heating member, in accordance with the amount of power obtained as a result of correction by the output determining section.

In the above configuration, the amount of power to be supplied to the heating member is corrected in accordance with an operation condition or an environmental condition of the fixing member. This makes it possible to more appropriately determine the amount of power to be supplied to the heating member.

Further, the fixing device may be arranged such that: the power control section controls the actual amount of power supplied to the heating member by use of either a phase control method for controlling a phase of an AC supply voltage supplied to the heating member from a power supply circuit or a duty control method for controlling a time for which electricity to the heating member from the power supply circuit is turned on in each predetermined period.

According to the above configuration, it is possible to control the actual amount of power actually supplied to the heating member can be controlled in accordance with the amount of power determined by the output determining section.

Further, the fixing device may be arranged such that: the power control section selects a control method that makes power consumption smaller, from a phase control method and a duty control method each being available to the power control section, so as to control the actual amount of power supplied to the heating member, the phase control method being for controlling a phase of an AC supply voltage supplied to the heating member from a power supply circuit, the duty control method being for controlling a time for which electricity to the heating member from the power supply circuit is turned on in each predetermined period.

According to the above configuration, it is possible to control the amount of power to be supplied to the heating member by using a control method whose power consumption is smaller between a phase control method and a duty control method. This makes it possible to further reduce power consumption.

Further, the fixing device may be arranged such that: the power control section controls the actual amount of power supplied to the heating member, by controlling a time for which electricity to the heating member from a power supply circuit is turned on in each predetermined period, as well as controlling a phase of an AC power supply voltage supplied to the heating member from the power supply circuit.

According to the above configuration, the actual amount of power supplied to the heating member is controlled by a combination of the phase control method for controlling a phase of an AC supply voltage supplied to the heating member from a power supply circuit and the duty control method for controlling a time for which electricity to the heating member from the power supply circuit is turned on in each predetermined period. This makes it possible to prevent overheating and/or insufficient heating by suppressing a temperature ripple, as well as preventing the occurrence of unnecessary power consumption by suppressing excessive current. As a result, it becomes possible to realize a fixing device excellent in an energy saving characteristic and a control characteristic.

Further, the fixing device may be arranged such that: the fixing member is an endless belt member supported by a plurality of belt supporting members; and at least one of the plurality of belt supporting members presses against the pressure member via the belt member.

According to the above configuration, it is possible to prevent the occurrence of a temperature ripple of the fixing member even in a configuration employing, as the fixing member, a belt member whose heat capacity is small.

Further, the fixing device may be arranged such that: the temperature control section further includes: a pressure member heating section for heating the pressure member at a heat quantity in accordance with an amount of power supplied; and a pressure member temperature detecting section for detecting a temperature of the pressure member; the temperature storage section stores a temperature detection result obtained by the pressure member temperature detecting section; the temperature difference calculating section calculates a third temperature difference and a fourth temperature difference, the third temperature difference being a difference between (a) a third detected temperature that is a current temperature of the pressure member which current temperature is detected by the pressure member temperature detecting section and (b) a control target temperature of the pressure member, the fourth temperature difference being a difference between (a) the third detected temperature and (a) a fourth detected temperature that is a past temperature of the pressure member which past temperature was detected by the temperature detecting section a predetermined time earlier than the current time; the table storage section stores a pressure member table in which a combination of the third temperature difference and the fourth temperature difference are associated with information for specifying an amount of power to be supplied to the pressure member heating section; the output determining section (i) reads out the information, from the pressure member table, the information corresponding to the combination of the third temperature difference and the fourth temperature difference each calculated by the temperature difference calculating section, and (ii) determines, based on the information, the amount of power to be supplied to the heating member; and the power control section controls an actual amount of power supplied to the pressure member heating section in accordance with the amount of power to be supplied to the pressure member heating section which amount is determined by the output determining section.

In the above configuration, it is possible to reduce a temperature ripple of the pressure member as in the case of the fixing member.

Further, the fixing device may be arranged such that: the heating member includes (i) a center heating member for heating a center section of the fixing member in a direction of an axis of rotation of the fixing member and (ii) an end section heating member for heating both end sections of the fixing member in the direction of the axis of rotation of the fixing member; the temperature detecting section includes (i) a center temperature detecting section for detecting a temperature of the center section of the fixing member in the direction of the axis of rotation of the fixing member and (ii) an end section temperature detecting section for detecting a temperature of an end section of the fixing member in the direction of the axis of rotation of the fixing member; the temperature difference calculating section calculates a first temperature difference and a second temperature difference, the first temperature difference being a difference between (a) a first detected temperature that is a current temperature of the center section in the direction of the axis of rotation of the fixing member which temperature is detected by the center temperature detecting section and (b) a control target temperature of the fixing member, the second temperature difference being a difference between (a) the first detected temperature and (b) a past temperature of the center section in the direction of the axis of rotation of the fixing member which past temperature was detected by the center temperature detecting section a predetermined time earlier than the current time; the temperature difference calculating section calculates a fifth temperature difference and a sixth temperature difference, the fifth temperature difference being a difference between (a) a fifth detected temperature that is a current temperature of the end section in the direction of the axis of rotation of the fixing member which temperature is detected by the end section temperature detecting section and (b) the control target temperature of the fixing member, the sixth temperature difference being a difference between (a) the fifth detected temperature and (b) a sixth detected temperature that is a past temperature of the end section in the direction of the axis of rotation of the fixing member which past temperature was detected by the end section temperature detecting section a predetermined time earlier than the current time; the table storage section stores, as the output setting table, (i) a center section table in which (a) a combination of the first temperature difference and the second temperature difference is associated with (b) information for specifying an amount of power to be supplied to the center heating member and (ii) an edge section table in which (a) a combination of the fifth temperature difference and the sixth temperature difference is associated with (b) information for specifying an amount of power to be supplied to the end section heating member; the output determining section reads out, from the center section setting table, the information corresponding to the combination of the first temperature difference and the second temperature difference which are calculated by the temperature difference calculating section and determines the amount of power to be supplied to the center heating member based on the information; the output determining section reads out, from the end section table, the information corresponding to the combination of the fifth temperature difference and the sixth temperature difference which are calculated by the temperature difference calculating section and determines the amount of power to be supplied to the end section heating member based on the information; and the power control section controls an actual amount of power supplied to the center heating member in accordance with the amount of power to be supplied to the center heating member and an actual amount of power supplied to the end section heating member in accordance with the amount of power to be supplied to the end section heating member which amounts of power to be supplied to the center heating member and the end section heating member are determined by the output determining section.

In the above configuration, for preventing the occurrence of a temperature ripple in a center section and end sections of the fixing device in an axis direction of the fixing device, it is possible to control the amount of power to be supplied to each of the center heating member and the end section heating member, in accordance with respective temperature detection results in the center section and the end section of the fixing device in the axis direction of the fixing device. This makes it possible to more preferably prevent the occurrence of a temperature ripple of the fixing member.

The fixing device may also be arranged such that: the temperature control section further includes: an achievement determining section for determining a achievement state of the first detected temperature in which state the first detected temperature approaches or reaches the control target temperature, (i) when a predetermined time elapses from a time when the amount of power to be supplied to the heating member was last set or (ii) when a fixing process is performed onto a predetermined number of sheets of recording material from a time when the amount of power to be supplied to the heating member was last set; a power correction coefficient calculating section for calculating a correction coefficient for correcting the amount of power to be supplied to the heating member, the amount of power being calculated, by the output setting section, based on the output setting table in accordance with a determination result obtained by the achievement determining section; and an output correcting section for correcting the amount of power to be supplied to the heating member, to a corrected amount of power obtained by correcting, by use of the correction coefficient, the amount of power calculated by the output determining section.

There may be a case where, because of a change in external disturbance factors such as an environmental temperature, a temperature of recording material, a water content of recording material, and a power supply voltage, variation in performance of each individual device, or the like, the first detected temperature cannot reach or cannot be kept at the control target temperature by setting the amount of power to be supplied to the heating member only based on the output setting table. Even in such a case, according to the above configuration, the first detected temperature can reach or be kept at the control target temperature, by correcting the amount of power which is calculated based on the output setting table.

The fixing device may also be arranged such that: the achievement determining section determines whether or not the first detected temperature has reached the control target temperature (i) when a predetermined time elapses from a time when the amount of power to be supplied to the heating member was last set or (ii) when a fixing process is performed onto a predetermined number of sheets of recording material from a time when the amount of power to be supplied to the heating member was last set; and the power correction coefficient calculating section calculates the correction coefficient so that the amount of power to be supplied to the heating member becomes larger than the amount of power calculated based on the output setting table, in a case where the achievement determining section determines that the first detected temperature has not reached the control target temperature.

There may be a case where, because of a change in external disturbance factors such as an environmental temperature, a temperature of recording material, a water content of recording material, and a power supply voltage, variation in performance of each individual device, or the like, the first detected temperature cannot reach the control target temperature by setting the amount of power to be supplied to the heating member only based on the output setting table. Even in such a case, according to the above configuration, the first detected temperature can reach the control target temperature, by correcting the amount of power which is calculated based on the output setting table.

The fixing device may also be arranged such that: the achievement determining section determines whether or not the first detected temperature is shifting to a value that makes a difference between the first detected temperature and the control target temperature smaller, (i) when a predetermined time elapses from a time when the amount of power to be supplied to the heating member was last set or (ii) when a fixing process is performed onto a predetermined number of sheets of recording material from a time when the amount of power to be supplied to the heating member was last set; and the power correction coefficient calculating section calculates the correction coefficient so that the amount of power to be supplied to the heating member becomes larger than the amount of power calculated based on the output setting table, in a case where the achievement determining section determines that the first detected temperature is not shifting to the value that makes the difference between the first detected temperature and the control target temperature smaller.

There may be a case where, because of a change in external disturbance factors such as an environmental temperature, a temperature of recording material, a water content of recording material, and a power supply voltage, variation in performance of each individual device, or the like, the first detected temperature cannot reach the control target temperature by setting the amount of power to be supplied to the heating member only based on the output setting table. Even in such a case, according to the above configuration, the first detected temperature can reach the control target temperature, by correcting the amount of power which is calculated based on the output setting table.

The fixing device may also be arranged such that: (a) the step of determining the achievement state of the first detected temperature by the achievement determining section, (b) the step of calculating the correction coefficient by the power correction coefficient calculating section, and (b) the step of correcting the amount of power by the output correcting section are repeatedly performed until the first detected temperature reaches the control target temperature or until a predetermined time or more elapses in a state where the first detected temperature stays at the control target temperature, the steps (a), (b), and (c) being performed every time a predetermined time elapses from a time when the amount of power to be supplied to the heating member was last set or every time a fixing process is performed onto a predetermined number of sheets of recording material from a time when the amount of power to be supplied to the heating member was last set.

According to the above configuration, even in a case where a change in external disturbance factor or the like occurs, it is possible to reliably cause the first detected temperature to come close to the control target temperature. Further, it may be arranged such that: the correction coefficient calculated by the power correction coefficient calculating section may be kept until an operation condition of the fixing device is changed; and the amount of power to the heating member is controlled based on the corrected amount of power that is obtained by the output correcting section by correcting the amount of power calculated based on the output setting table by the output determining section, the amount of power being corrected with use of the correction coefficient.

According to the above configuration, even in a case where a change in external disturbance factor or the like occurs, it is possible to cause the first detected temperature to come close to the control target temperature.

The fixing device may also be arranged such that: after the amount of power to be supplied to the heating member is set at the corrected amount of power obtained by the output correcting section, the amount of power to be supplied to the heating member is kept at the corrected amount of power obtained by the output correcting section until a predetermined time elapses from a time when the amount of power to be supplied to the heating member was last set or until a fixing process is performed onto a predetermined number of sheets of recording material from a time when the amount of power to be supplied to the heating member was last set.

According to the above configuration, an error in control caused by influence of the steady-state deviation or an external disturbance, or the like, can be reduced. Thereby, it becomes possible to cause the temperature of the member to be heated to come closer to the control temperature and also to steadily keep the temperature at a temperature close to the control target temperature.

The fixing device may also be arranged such that: each of the first constant and the second constant are plurally stored so that there are a plurality of first constants and a plurality of second constants; and the output determining section selects a first constant from among the plurality of first constants and a second constant from among the plurality of second constants and calculates the first correction value and the second correction value by use of the first constant and the second constant each selected, the first constant and the second constant being selected in accordance with one or a combination of two or more of conditions including an operation state of an image forming apparatus provided with the fixing device, an operation state of the fixing device, a type of the recording material, an water content of the recording material, environmental temperature and humidity, an image formation processing method in the image forming apparatus provided with the fixing device, a number of sheets of the recording material to be subjected to a fixing process, a carrying speed of the recording material, a number of sheets of the recording material carried for a predetermined time, a type of the heating member, performance of the heating member, and a power supply voltage of the fixing device.

According to the above configuration, the temperature of the heating member can be appropriately controlled in accordance with each of the above conditions. Further, as compared to a case where output tables respectively corresponding to the above conditions are stored, it is possible to reduce a storage capacity that the storage means for storing the output setting table is required to have. In addition, because this temperature control can be applied to various conditions only by changing the first constant and the second constant, contents of the control can be easily set depending on conditions.

The fixing device may also be arranged such that: the heating member has a plurality of heating sections each of which heats a different area of the fixing member; the output determining section (i) calculates the amount of power to be supplied to each of the plurality of heating sections based on the information read out from the output setting table common to the plurality of heating sections, (ii) calculates the first correction value and the second correction value for each of the plurality of heating sections, by using the first constant and the second constant set separately for each of the plurality of heating sections, and (iii) corrects the amount of power by use of the first correction value and the second correction value calculated for each of the plurality of heating sections, the amount of power being calculated based on the information for each of the plurality of heating sections; and the power control section controls the actual amount of power supplied to each of the plurality of heating sections, in accordance with the corrected amount of power for each of the plurality of heating sections, the corrected amount of power being obtained by correction by the output determining section.

Alternatively, the fixing device may also be arranged such that: the heating member includes a plurality of heating sections each of which heats a different area of the fixing member; the output setting table is plurally provided so that there are a plurality of output setting tables; the output determining section (i) selects, for each of the plurality of heating sections, an output setting table from among the plurality of output setting tables according to a preset condition, (ii) calculates the amount of power to be supplied to each of the plurality of heating members based on the information read out from the output setting table selected, (iii) calculates, for each of the plurality of heating members, the first correction value and the second correction value by using the first constant and the second constant set in the output setting table selected for each of the plurality of heating members, and (iv) corrects the amount of power by use of the first correction value and the second correction value calculated for each of the plurality of heating sections, the amount of power being calculated based on the information for each of the plurality of heating sections; and the power control section controls the actual amount of power supplied to each of the plurality of heating sections, in accordance with the corrected amount of power for each of the plurality of heating sections, the corrected amount of power being obtained by correction by the output determining section.

According to the above configurations, in a configuration where a plurality of heating sections are provided, a temperature of each of the heating sections can be separately and appropriately controlled. Further, as compared to a case where output setting tables respectively corresponding to the above conditions are stored, it is possible to reduce a storage capacity that the storage means for storing the output setting tables is required to have. In addition, because the temperature control of each of the plurality of heating sections can be carried out separately only by changing the first constant and the second constant, contents of the control can be easily set depending on conditions.

An image forming apparatus of the present invention includes any one of the fixing devices described above. Therefore, it is possible to reduce a temperature ripple of the fixing member. This makes it possible to prevent winding of recording material onto the fixing member, hot offset, or a resultant coarse image each caused by excessive melting of toner or a defect in fixing caused by insufficient melting of toner. In addition, it is also possible to reduce power consumption.

A method of controlling a temperature of a fixing device according to the present invention, the fixing device including: a fixing member; a pressure member; and a heating member for heating the fixing member at a heat quantity corresponding to an amount of power supplied, the fixing member and the pressure member being rotatably provided, the fixing member and the pressure member carrying recording material provided between the fixing member and the pressure member while sandwiching the recording material between the fixing member and the pressure member, the fixing member and the pressure member fixing, onto the recording material, an unfixed image formed on the recording material by heat and pressure while carrying the recording material, the method comprising the steps of: (i) detecting a temperature of the fixing device; (ii) storing a temperature detection result obtained in the step (i); (iii) calculating a first temperature difference and a second temperature difference, the first temperature difference being a difference between (a) a first detected temperature that is a current temperature of the fixing member which temperature is detected in the step (i) and (b) a control target temperature of the fixing member, the second temperature difference being a difference between (a) the first detected temperature and (b) a past temperature of the fixing member which past temperature was detected in the step (i) a predetermined time earlier than the current time; (iv) determining an amount of power to be supplied to the heating member based on information corresponding to a combination of the first temperature difference and the second temperature difference which are calculated in the step (iii), by reading out the information from an output setting table in which the information is associated with the combination of the first temperature difference and the second temperature difference, the information being for specifying the amount of power to be supplied to the heating member; and (v) controlling an actual amount of power supplied to the heating member in accordance with the amount of power to be supplied to the heating member which amount is determined in the step (iv).

According to the above method, the first temperature difference reflects how close to the control target temperature the temperature of the fixing device reaches; the second temperature difference reflects a trend of a change in the current temperature of the fixing member. Accordingly, in consideration of a degree of closeness to the control target temperature and the trend of the change in the current temperature, the amount of power to be supplied to the heating member can be appropriately controlled so that overheating or shortage of heating can be prevented. This makes it possible to reduce a temperature ripple. Consequently, it becomes possible to prevent winding of recording material onto the fixing member, hot offset, or a resultant coarse image each caused by excessive melting of toner or a defect in fixing caused by insufficient melting of toner. In addition, it is also possible to reduce power consumption. Further, as compared to a case where a PID control is performed, complex tuning in determining parameters for the PID control is not necessary. Therefore, it becomes possible to realize a fixing device capable of appropriately controlling an amount of power to be supplied to the heating member in a simple configuration.

Note that the temperature control section may be realized by a computer. In such a case, the scope of the present invention encompasses a program for causing the computer to operate as the temperature control section and thereby realizing the temperature control section by the computer, and a computer-readable storage medium storing the program.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is suitably applied to an image fixing device provided in an image forming apparatus and a temperature control method for the fixing device.

REFERENCE SIGNS LIST

30, 30*b*~30*e* Fixing Device
31 Fixing Roller (Belt Supporting Member)
32 Heating Member (Center Heating Member, End Section Heating Member)
33 Fixing Belt (Fixing Member)
33*b* Pressure Belt (Pressure Member)
34 Pressure Roller (Pressure Member)
35*a* Thermistor (Temperature Detecting Section, Center Temperature Detecting Section)
35*b* Thermistor (Temperature Detecting Section, End Section Temperature Detecting Section)
35*c* Thermistor (Pressure Member Temperature Detecting Section)
36 Heater Lamp (Pressure Member Heating Section)
38*a* Fixing Pad (Belt Supporting Member)
38*b* Pressure Pad (Pressure Member)
40 Control Section
41 Rotation Drive Control Section
42 Temperature Control Section
43 Power Supply Circuit
44 Rotation Drive Means
45 Heat Source Drive Means
51 Sensor Data Input Section
52 Temperature Storage Section
53 Temperature Difference Calculating Section
54 Table Storage Section
55 Output Determining Section
56 Power Control Section
100 Image Forming Apparatus
132 Heating Roller (Heating Member)
133*a* Heater Lamp (Center Heating Member)
133*b* Heater Lamp (End Section Heating Member)

The invention claimed is:

1. A fixing device comprising:

a fixing member;

a pressure member;

a heating member for heating the fixing member at a heat quantity corresponding to an amount of power supplied; and a temperature control section for controlling an amount of power to be supplied to the heating member, the fixing member and the pressure member being rotatably provided, the fixing member and the pressure member carrying recording material provided between the fixing member and the pressure member while sandwiching the recording material between the fixing member and the pressure member, the fixing member and the pressure member fixing, onto the recording material, an unfixed image formed on the recording material by heat and pressure while carrying the recording material, the control section including:

a temperature detecting section for detecting a temperature of the fixing device;

a temperature storage section for storing a temperature detection result obtained by the temperature detecting section;

a temperature difference calculating section for calculating a first temperature difference and a second temperature difference, the first temperature difference being a difference between (a) a first detected temperature that is a current temperature of the fixing member which temperature is detected by the temperature detecting section and (b) a control target temperature of the fixing member, the second temperature difference being a difference between (a) the first detected temperature and (b) a past temperature of the fixing member which past temperature was detected by the temperature detecting section a predetermined time earlier than the current time;

a table storage section for storing an output setting table in which a combination of the first temperature difference and the second temperature difference is associated with information for specifying the amount of power to be supplied to the heating member;

an output determining section for reading out, from the output setting table, the information corresponding to the combination of the first temperature difference and the second temperature difference which are calculated by the temperature difference calculating section and for determining the amount of power to be supplied to the heating member based on the information; and a power control section for controlling an actual amount of power supplied to the heating member in accordance with the amount of power to be supplied to the heating member which amount is determined by the output determining section.

2. The fixing device as set forth in claim 1, wherein:

the temperature difference calculating section calculates a change rate that is an amount of change in the first temperature difference or the second temperature difference in each predetermined period;

the output setting table stores a combination of the change rate, the first temperature difference, and the second temperature difference and the information so that the combination is associated with the information; and the output determining section reads out, from the output setting table, the information corresponding to the combination of the change ratio, the first temperature difference and the second temperature difference, and determines the amount of power to be supplied to the heating member based on the information, the first temperature difference and the second temperature difference being calculated by the temperature difference calculating section.

3. The fixing device as set forth in claim 1, wherein:

the information stored in the output setting table is information indicating, regardless of a current amount of power currently supplied to the heating member, a value of the amount of power to be supplied to the heating member.

4. The fixing device as set forth in claim 1, wherein:

the information stored in the output setting table is information indicating a degree of change from a current amount of power currently supplied to the heating member.

5. The fixing device as set forth in claim 4, wherein:

the table storage section stores the output setting table and an output specifying table in which a respective number identifying each of a plurality of levels is associated with a corresponding amount of power, the amount of power to be supplied to the heating member being classified into the plurality of levels in the order of amount;

the output setting table is a level change value table in which a combination of the first temperature difference and the second temperature difference is associated with a level change value indicating an amount of change in level from a level corresponding to the current amount of power currently supplied to the heating member; and the output determining section (i) reads out, from the level change value table, the level change value corresponding to the combination of the first temperature difference and the second temperature difference each calculated by the temperature difference calculating section, (ii) specifies a level after a change, based on the level corresponding to the current amount of power currently supplied to the heating member and the level change value read out from the level change value table, and (iii) then, determines, as the amount of power to be supplied to the heating member, an amount of power corresponding to the level specified.

6. The fixing device as set forth in claim 4, wherein:

in a case where (i) the current amount of power currently supplied to the heating member is zero or equal to or less than a predetermined set value and (ii) a difference between the current amount of power and an amount of power specified by the information in the output setting table is equal to or more than a predetermined value which information corresponds to a combination of the first temperature difference and the second temperature difference, the output determining section changes the amount of power to be supplied to the heating member to a predetermined amount of power, the predetermined amount being set in advance so as to be greater than the amount of power specified by the information in the output setting table which information corresponds to the combination of the first temperature difference and the second temperature difference.

7. The fixing device as set forth in claim 5, wherein:

the table storage section stores an output direct setting table in which a combination of the first temperature difference and the second temperature difference is stored so as to be associated with information indicating, regardless of the current amount of power currently supplied to the heating member, an amount of power to be supplied to the heating member;

in a case where the current amount of power currently supplied to the heating member is equal to or less than a predetermined set value, the output determining section determines an amount of power to be supplied to the heating member by reading out, from the output direct setting table, the information corresponding to the first temperature difference and the second temperature difference each calculated by the temperature difference calculating section; and in a case where the current amount of power currently supplied to the heating member is more than the predetermined set value, the output determining section (i) reads out, from the level change value table, a level change value corresponding to the combination of the first temperature difference and the second temperature difference each calculated by the temperature difference calculating section, (ii) specifies a level after a change, based on the level corresponding to the current amount of power currently supplied to the heating member and the level change value read out from the level change value table, and (iii) then, determines, as the amount of power to be supplied to the heating member, an amount of power corresponding to the level specified.

8. The fixing device as set forth in claim 1, wherein:

the information indicates a relative value with respect to a preset reference amount of power;

the output determining section (i) reads out the relative value corresponding to a combination of the first temperature difference and the second temperature difference each calculated by the temperature difference calculating section, and determines, as the amount of power to be supplied to the heating member, an amount of power specified by the relative value read out and the reference amount of power; and in a case where an operation state or an environmental condition of the fixing device is changed, the output determining section corrects the reference amount of power in accordance with the operation state of the environmental condition which has been changed.

9. The fixing device as set forth in claim 1, wherein:

the output setting table is plurally stored in the storage section so that there are a plurality of output setting tables; and the output determining section selects one output setting table from among the plurality of output setting tables, in accordance with an operation state or an environmental condition of the fixing device, the one output setting table being for use in determination of the amount of power to be supplied to the heating member.

10. The fixing device as set forth in claim 1, wherein:

the output determining section corrects, in accordance with an operation state or an environmental condition of the fixing device, the amount of power specified by the information read out from the output setting table; and the power control section controls the actual amount of power supplied to the heating member, in accordance with the amount of power obtained as a result of correction by the output determining section.

11. The fixing device as set forth in claims 1, wherein:

the power control section controls the actual amount of power supplied to the heating member by use of either a phase control method for controlling a phase of an AC supply voltage supplied to the heating member from a power supply circuit or a duty control method for controlling a time for which electricity to the heating member from the power supply circuit is turned on in each predetermined period.

12. The fixing device as set forth in claim 1, wherein:

the power control section selects a control method that makes power consumption smaller, from a phase control method and a duty control method each being available to the power control section, so as to control the actual amount of power supplied to the heating member, the phase control method being for controlling a phase of an AC supply voltage supplied to the heating member from a power supply circuit, the duty control method being for controlling a time for which electricity to the heating member from the power supply circuit is turned on in each predetermined period.

13. The fixing device as set forth in claim 1, wherein:

the power control section controls the actual amount of power supplied to the heating member, by controlling a time for which electricity to the heating member from a power supply circuit is turned on in each predetermined period, as well as controlling a phase of an AC power supply voltage supplied to the heating member from the power supply circuit.

14. The fixing device as set forth in claim 1, wherein:

the fixing member is an endless belt member supported by a plurality of belt supporting members; and at least one of the plurality of belt supporting members presses against the pressure member via the belt member.

15. The fixing device as set forth in claim 1, wherein:

the temperature control section further includes:

a pressure member heating section for heating the pressure member at a heat quantity in accordance with an amount of power supplied; and a pressure member temperature detecting section for detecting a temperature of the pressure member;

the temperature storage section stores a temperature detection result obtained by the pressure member temperature detecting section;

the temperature difference calculating section calculates a third temperature difference and a fourth temperature difference, the third temperature difference being a difference between (a) a third detected temperature that is a current temperature of the pressure member which current temperature is detected by the pressure member temperature detecting section and (b) a control target temperature of the pressure member, the fourth temperature difference being a difference between (a) the third detected temperature and (a) a fourth detected temperature that is a past temperature of the pressure member which past temperature was detected by the temperature detecting section a predetermined time earlier than the current time;

the table storage section stores a pressure member table in which a combination of the third temperature difference and the fourth temperature difference are associated with information for specifying an amount of power to be supplied to the pressure member heating section;

the output determining section (i) reads out the information, from the pressure member table, the information corresponding to the combination of the third temperature difference and the fourth temperature difference each calculated by the temperature difference calculating section, and (ii) determines, based on the information, the amount of power to be supplied to the heating member; and the power control section controls an actual amount of power supplied to the pressure member heating section in accordance with the amount of power to be supplied to the pressure member heating section which amount is determined by the output determining section.

16. The fixing device as set forth in claim 1, wherein:

the heating member includes (i) a center heating member for heating a center section of the fixing member in a direction of an axis of rotation of the fixing member and (ii) an end section heating member for heating both end sections of the fixing member in the direction of the axis of rotation of the fixing member;

the temperature detecting section includes (i) a center temperature detecting section for detecting a temperature of the center section of the fixing member in the direction of the axis of rotation of the fixing member and (ii) an end section temperature detecting section for detecting a temperature of an end section of the fixing member in the direction of the axis of rotation of the fixing member;

the temperature difference calculating section calculates a first temperature difference and a second temperature difference, the first temperature difference being a difference between (a) a first detected temperature that is a current temperature of the center section in the direction of the axis of rotation of the fixing member which temperature is detected by the center temperature detecting section and (b) a control target temperature of the fixing member, the second temperature difference being a difference between (a) the first detected temperature and (b) a past temperature of the center section in the direction of the axis of rotation of the fixing member which past temperature was detected by the center temperature detecting section a predetermined time earlier than the current time;

the temperature difference calculating section calculates a fifth temperature difference and a sixth temperature difference, the fifth temperature difference being a difference between (a) a fifth detected temperature that is a current temperature of the end section in the direction of the axis of rotation of the fixing member which temperature is detected by the end section temperature detecting section and (b) the control target temperature of the fixing member, the sixth temperature difference being a difference between (a) the fifth detected temperature and (b) a sixth detected temperature that is a past temperature of the end section in the direction of the axis of rotation of the fixing member which past temperature was detected by the end section temperature detecting section a predetermined time earlier than the current time;

the table storage section stores, as the output setting table, (i) a center section table in which (a) a combination of the first temperature difference and the second temperature difference is associated with (b) information for specifying an amount of power to be supplied to the center heating member and (ii) an edge section table in which (a) a combination of the fifth temperature difference and the sixth temperature difference is associated with (b) information for specifying an amount of power to be supplied to the end section heating member;

the output determining section reads out, from the center section setting table, the information corresponding to the combination of the first temperature difference and the second temperature difference which are calculated by the temperature difference calculating section and determines the amount of power to be supplied to the center heating member based on the information;

the output determining section reads out, from the end section table, the information corresponding to the combination of the fifth temperature difference and the sixth temperature difference which are calculated by the temperature difference calculating section and determines the amount of power to be supplied to the end section heating member based on the information; and the power control section controls an actual amount of power supplied to the center heating member in accordance with the amount of power to be supplied to the center heating member and an actual amount of power supplied to the end section heating member in accordance with the amount of power to be supplied to the end section heating member which amounts of power to be supplied to the center heating member and the end section heating member are determined by the output determining section.

17. The fixing device as set forth in claim 1, wherein the temperature control section further includes:

an achievement determining section for determining a achievement state of the first detected temperature in which state the first detected temperature approaches or reaches the control target temperature, (i) when a predetermined time elapses from a time when the amount of power to be supplied to the heating member was last set or (ii) when a fixing process is performed onto a predetermined number of sheets of recording material from a time when the amount of power to be supplied to the heating member was last set;

a power correction coefficient calculating section for calculating a correction coefficient for correcting the amount of power to be supplied to the heating member, the amount of power being calculated, by the output setting section, based on the output setting table in accordance with a determination result obtained by the achievement determining section; and an output correcting section for correcting the amount of power to be supplied to the heating member, to a corrected amount of power obtained by correcting, by use of the correction coefficient, the amount of power calculated by the output determining section.

18. The fixing device as set forth in claim 17, wherein:

the achievement determining section determines whether or not the first detected temperature has reached the control target temperature (i) when a predetermined time elapses from a time when the amount of power to be supplied to the heating member was last set or (ii) when a fixing process is performed onto a predetermined number of sheets of recording material from a time when the amount of power to be supplied to the heating member was last set; and the power correction coefficient calculating section calculates the correction coefficient so that the amount of power to be supplied to the heating member becomes larger than the amount of power calculated based on the output setting table, in a case where the achievement determining section determines that the first detected temperature has not reached the control target temperature.

19. The fixing device as set forth in claim 17, wherein:

the achievement determining section determines whether or not the first detected temperature is shifting to a value that makes a difference between the first detected temperature and the control target temperature smaller, (i) when a predetermined time elapses from a time when the amount of power to be supplied to the heating member was last set or (ii) when a fixing process is performed onto a predetermined number of sheets of recording material from a time when the amount of power to be supplied to the heating member was last set; and the power correction coefficient calculating section calculates the correction coefficient so that the amount of power to be supplied to the heating member becomes larger than the amount of power calculated based on the output setting table, in a case where the achievement determining section determines that the first detected temperature is not shifting to the value that makes the difference between the first detected temperature and the control target temperature smaller.

20. The fixing device as set forth in claim 17, wherein:

(a) the step of determining the achievement state of the first detected temperature by the achievement determining section, (b) the step of calculating the correction coefficient by the power correction coefficient calculating section, and (c) the step of correcting the amount of power by the output correcting section are repeatedly performed until the first detected temperature reaches the control target temperature or until a predetermined time or more elapses in a state where the first detected temperature stays at the control target temperature, the steps (a), (b) , and (c) being performed every time a predetermined time elapses from a time when the amount of power to be supplied to the heating member was last set or every time a fixing process is performed onto a predetermined number of sheets of recording material from a time when the amount of power to be supplied to the heating member was last set.

21. The fixing device as set forth in claim 20, wherein:

after the amount of power to be supplied to the heating member is set at the corrected amount of power obtained by the output correcting section, the amount of power to be supplied to the heating member is kept at the corrected amount of power obtained by the output correcting section until a predetermined time elapses from a time when the amount of power to be supplied to the heating member was last set or until a fixing process is performed onto a predetermined number of sheets of recording material from a time when the amount of power to be supplied to the heating member was last set.

22. The fixing device as set forth in claim 1, wherein:

the temperature difference calculating section calculates (i) a first-temperature-difference accumulated value for a period up to a current time from a predetermined time preceding a start of an image forming operation or an end of a last image forming operation and (ii) a difference between the second detected temperature and the first detected temperature;

the output determining section calculates a first correction value obtained by multiplying the first-temperature-difference accumulated value by a first constant and a second correction value obtained by multiplying the difference between the second detected temperature and the first detected temperature by a second correction value, and corrects the amount of power to be supplied to the heating member by using the first correction value and the second correction value, the amount of power to be supplied to the heating member being determined by the information read out from the output setting table; and the power control section controls the actual amount of power supplied to the heating member in accordance with a corrected amount of power obtained by correction by the output determining section.

23. The fixing device as set forth in claim 22, wherein:

each of the first constant and the second constant are plurally stored so that there are a plurality of first constants and a plurality of second constants; and the output determining section selects a first constant from among the plurality of first constants and a second constant from among the plurality of second constants and calculates the first correction value and the second correction value by use of the first constant and the second constant each selected, the first constant and the second constant being selected in accordance with one or a combination of two or more of conditions including an operation state of an image forming apparatus provided with the fixing device, an operation state of the fixing device, a type of the recording material, an water content of the recording material, environmental temperature and humidity, an image formation processing method in the image forming apparatus provided with the fixing device, a number of sheets of the recording material to be subjected to a fixing process, a carrying speed of the recording material, a number of sheets of the recording material carried for a predetermined time, a type of the heating member, performance of the heating member, and a power supply voltage of the fixing device.

24. The fixing device as set forth in claim 22, wherein:

the heating member has a plurality of heating sections each of which heats a different area of the fixing member;

the output determining section (i) calculates the amount of power to be supplied to each of the plurality of heating sections based on the information read out from the output setting table common to the plurality of heating sections, (ii) calculates the first correction value and the second correction value for each of the plurality of heating sections, by using the first constant and the second constant set separately for each of the plurality of heating sections, and (iii) corrects the amount of power by use of the first correction value and the second correction value calculated for each of the plurality of heating sections, the amount of power being calculated based on the information for each of the plurality of heating sections; and the power control section controls the actual amount of power supplied to each of the plurality of heating sections, in accordance with the corrected amount of power for each of the plurality of heating sections, the corrected amount of power being obtained by correction by the output determining section.

25. The fixing device as set forth in claim 22, wherein:

the heating member includes a plurality of heating sections each of which heats a different area of the fixing member;

the output setting table is plurally provided so that there are a plurality of output setting tables;

the output determining section (i) selects, for each of the plurality of heating sections, an output setting table from among the plurality of output setting tables according to a preset condition, (ii) calculates the amount of power to be supplied to each of the plurality of heating members based on the information read out from the output setting table selected, (iii) calculates, for each of the plurality of heating members, the first correction value and the second correction value by using the first constant and the second constant set in the output setting table selected for each of the plurality of heating members, and (iv) corrects the amount of power by use of the first correction value and the second correction value calculated for each of the plurality of heating sections, the amount of power being calculated based on the information for each of the plurality of heating sections; and the power control section controls the actual amount of power supplied to each of the plurality of heating sections, in accordance with the corrected amount of power for each of the plurality of heating sections, the corrected amount of power being obtained by correction by the output determining section.

26. The image forming apparatus comprising the fixing device as set forth in claim 1.

27. A non-transitory computer-readable storage medium having stored thereon a computer program comprising computer executable instructions for causing the fixing device as set forth in claim 1 to operate, the program causing a computer to function as the temperature control section.

28. The fixing device as set forth in claim 1, wherein the fixing member is a fixing belt.

* * * * *